US007933769B2

(12) United States Patent
Bessette

(10) Patent No.: US 7,933,769 B2
(45) Date of Patent: Apr. 26, 2011

(54) METHODS AND DEVICES FOR LOW-FREQUENCY EMPHASIS DURING AUDIO COMPRESSION BASED ON ACELP/TCX

(75) Inventor: Bruno Bessette, Rock Forest (CA)

(73) Assignee: Voiceage Corporation, Ville Mont-Royal (CA)

( * ) Notice: Subject to any disclaimer, the term of this patent is extended or adjusted under 35 U.S.C. 154(b) by 983 days.

(21) Appl. No.: 11/708,097

(22) Filed: Feb. 15, 2007

(65) Prior Publication Data

US 2007/0225971 A1 Sep. 27, 2007

Related U.S. Application Data

(63) Continuation of application No. 10/589,035, filed as application No. PCT/CA2005/000220 on Feb. 18, 2005.

(30) Foreign Application Priority Data

Feb. 18, 2004 (CA) ..... 2457988

(51) Int. Cl.
*G10L 19/04* (2006.01)

(52) U.S. Cl. ..... 704/219; 704/200.1; 704/500; 704/230; 704/229; 375/243; 375/240.13; 375/240.16

(58) Field of Classification Search ..... 704/219, 704/230, 500–504, 200.1, 205, 229, 203; 375/243, 240.13, 240.16
See application file for complete search history.

(56) References Cited

U.S. PATENT DOCUMENTS

| | | | | |
|---|---|---|---|---|
| 6,011,824 | A * | 1/2000 | Oikawa et al. | 375/377 |
| 6,029,128 | A | 2/2000 | Jarvinen et al. | |
| 6,092,041 | A * | 7/2000 | Pan et al. | 704/229 |
| 6,266,632 | B1 | 7/2001 | Kato et al. | |
| 6,691,082 | B1 * | 2/2004 | Aguilar et al. | 704/219 |
| 7,272,556 | B1 * | 9/2007 | Aguilar et al. | 704/230 |
| 7,693,710 | B2 * | 4/2010 | Jelinek et al. | 704/207 |
| 2002/0163455 | A1 | 11/2002 | Reefman et al. | |
| 2005/0154584 | A1 * | 7/2005 | Jelinek et al. | 704/219 |
| 2005/0261900 | A1 * | 11/2005 | Ojala et al. | 704/223 |
| 2005/0267742 | A1 * | 12/2005 | Makinen | 704/219 |

FOREIGN PATENT DOCUMENTS

CA 2388358 11/2003

(Continued)

OTHER PUBLICATIONS

Adoul et al., "Speech Coding and Synthesis," Elsvier, 1995, edited by Kleijn, pp. 291-308.

(Continued)

*Primary Examiner* — Vijay B Chawan
(74) *Attorney, Agent, or Firm* — Fay Kaplun & Marcin, LLP

(57) ABSTRACT

In a method and device for low-frequency emphasis, where the spectrum of a sound signal is transformed in a frequency domain and comprises transform coefficients grouped in a number of blocks, a maximum energy for one block having a position index is calculated. Also, a factor having a position index smaller than the position index of the block with maximum energy is calculated for each block. For each block, an energy of the block is calculated, the factor is computed from the calculated maximum energy and the computed energy of the block, and a gain is determined from the factor and applied to the transform coefficients of the block.

31 Claims, 26 Drawing Sheets

FOREIGN PATENT DOCUMENTS

| | | |
|---|---|---|
| JP | 61-242117 | 10/1986 |
| JP | 2000-117573 | 4/2001 |
| JP | 2002-189499 | 7/2002 |
| JP | 2003-177797 | 6/2003 |
| RU | 2 181 481 | 11/1999 |
| WO | 03/102923 | 12/2003 |

OTHER PUBLICATIONS

Gersho et al., "Vector Quantization and Signal Compression," Kluwer Academic Publishers, 1992, pp. 309-338.
Jayant et al., "Digital Coding of Waveforms—Principles and Applications to Speech and Video," Prentice-Hall, 1984, pp. 510-590.
Schroeder et al., Code-Excited Linear Prediction (CELP): High Quality Speech at Very Low Bit Rates, IEEE, 1985, pp. 937-940.
Bessette et al., "The adaptive multirate wideband speech codec (AMR-WB)", IEEE Transactions on Speech and Audio Processing, vol. 10, No. 8, Nov. 2002, pp. 620-636.
Bessette et al., "A wideband speech and audio codec at 16/24/32 kbit/s using hybrid ACELP/TCX techniques", Proceedings IEEE Workshop on Speech Coding Proceedings, Jun. 20-23, 1999, pp. 7-9.
Chen, "A candidate coder for the ITU-T's new wideband speech coding standard", Proceedings IEEE International Conference on Acoustics, Speech, and Signal Processing (ICASSP), vol. 2, Apr. 21-24, 1997, pp. 1359-1362.
Chen et al., "Transform predictive coding of wideband speech signals", Proceedings IEEE International Conference on Acoustics, Speech, and Signal Processing (ICASSP), vol. 1, May 7-10, 1996, pp. 275-278.
Combescure et al., "A 16, 24, 32 kbit/s wideband speech codec based on ATCELP", Proceedings IEEE International Conference on Acoustics, Speech, and Signal Processing (ICASSP), vol. 1, Mar. 15-19, 1999, pp. 5-8.
Gibson et al., "Lattice Quantization", Adv. Electron. Phys., vol. 72, 1988, pp. 259-331.
Jbira et al., "Low delay coding of wideband audio (20 Hz-15 kHz) at 64 kbps", Proceedings IEEE International Conference on Acoustics, Speech, and Signal Processing (ICASSP), vol. 6, May 12-15, 1998, pp. 3645-3648.
Lefebvre et al., "High quality coding of wideband audio signals using transform coded excitation (TCX)", Proceedings IEEE International Conference on Acoustics, Speech, and Signal Processing (ICASSP), vol. 1, Apr. 19-22, 1994, pp. I/193-I/196.
Moreau et al., "Successive orthogonalizations in the multistage CELP coder", Proceedings IEEE International Conference on Acoustics, Speech, and Signal Processing (ICASSP), 1992, pp. 61-64.
Ramprashad, "The multimode transform predictive coding paradigm", IEEE Transactions on Speech and Audio Processing, vol. 11, No. 2, Mar. 2003, pp. 117-129.
Schnitzler et al. "Wideband speech coding using forward/backward adaptive prediction with mixed time/frequency domain excitation", Proceedings IEEE Workshop on Speech Coding Proceedings, Jun. 20-23, 1999, pp. 4-6.
Xie et al., "Embedded algebraic vector quantizers (EAVQ) with application to wideband speech coding", Proceedings IEEE International Conference on Acoustics, Speech, and Signal Processing (ICASSP), vol. 1, May 7-10, 1996, pp. 240-243.
3GPP TS 26.173, ANSI-C code for the Adaptive Multi Rate—Wideband (AMR-WB) speech codec, 2004, pp. 1-19.
3GPP TS 26.190, Adaptive Multi-Rate—Wideband (AMR-WB) speech codec; Transcoding Functions, 2005, pp. 1-53.
3GPP TS 26.290 Audio codec processing functions; Extended AMR Wideband codec; Transcoding functions, 2004, pp. 1-72.
International Standard, "Information Technology-Coding of Audio-Visual Objects-Part 3: Audio", ISO/IEC 14496-3, 1985, 200, pp. 1-1178.
ITU-T Telecommunication Standardization Sector of ITU, "Series G: Transmission Systems and Media, Digital Systems and Networks, Digital Terminal Equipments-Coding of Analogue Signals by Methods other that PCM", May 2005, pp. 1-36.

* cited by examiner windowing in TCX 20+2.5 ms windowing in TCX 40+5 ms states initialized to 0 in $\frac{1}{\hat{A}(Z/\gamma_1)}$ and $1-\alpha Z^{-1}$ if past frame was encoded with ACELPÀ state initialized to past synthesis in $\frac{1}{\hat{A}(Z/\gamma_1)}$ otherwise

METHODS AND DEVICES FOR LOW-FREQUENCY EMPHASIS DURING AUDIO COMPRESSION BASED ON ACELP/TCX

PRIORITY CLAIM

The present application is a continuation application of a U.S. patent application Ser. No. 10/589,035 entitled "Method and Devices for Low-Frequency Emphasis During Audio Compression Based on ACELP/TCX", filed on Feb. 20, 2007 which claims priority to PCT/CA2005/000220 filed on Feb. 18, 2005 and CA Patent Application Serial No. 2,457,988 filed on Feb. 18, 2004. The specifications of the above-identified applications are incorporated herewith by reference.

FIELD OF THE INVENTION

The present invention relates to coding and decoding of sound signals in, for example, digital transmission and storage systems. In particular but not exclusively, the present invention relates to hybrid transform and code-excited linear prediction (CELP) coding and decoding.

BACKGROUND OF THE INVENTION

Digital representation of information provides many advantages. In the case of sound signals, the information such as a speech or music signal is digitized using, for example, the PCM (Pulse Code Modulation) format. The signal is thus sampled and quantized with, for example, 16 or 20 bits per sample. Although simple, the PCM format requires a high bit rate (number of bits per second or bit/s). This limitation is the main motivation for designing efficient source coding techniques capable of reducing the source bit rate and meet with the specific constraints of many applications in terms of audio quality, coding delay, and complexity.

The function of a digital audio coder is to convert a sound signal into a bit stream which is, for example, transmitted over a communication channel or stored in a storage medium. Here lossy source coding, i.e. signal compression, is considered. More specifically, the role of a digital audio coder is to represent the samples, for example the PCM samples with a smaller number of bits while maintaining a good subjective audio quality. A decoder or synthesizer is responsive to the transmitted or stored bit stream to convert it back to a sound signal. Reference is made to [Jayant, 1984] and [Gersho, 1992] for an introduction to signal compression methods, and to the general chapters of [Kleijn, 1995] for an in-depth coverage of modern speech and audio coding techniques.

In high-quality audio coding, two classes of algorithms can be distinguished: Code-Excited Linear Prediction (CELP) coding which is designed to code primarily speech signals, and perceptual transform (or sub-band) coding which is well adapted to represent music signals. These techniques can achieve a good compromise between subjective quality and bit rate. CELP coding has been developed in the context of low-delay bidirectional applications such as telephony or conferencing, where the audio signal is typically sampled at, for example, 8 or 16 kHz. Perceptual transform coding has been applied mostly to wideband high-fidelity music signals sampled at, for example, 32, 44.1 or 48 kHz for streaming or storage applications.

CELP coding [Atal, 1985] is the core framework of most modern speech coding standards. According to this coding model, the speech signal is processed in successive blocks of N samples called frames, where N is a predetermined number of samples corresponding typically to, for example, 10-30 ms. The reduction of bit rate is achieved by removing the temporal correlation between successive speech samples through linear prediction and using efficient vector quantization (VQ). A linear prediction (LP) filter is computed and transmitted every frame. The computation of the LP filter typically requires a look-ahead, for example a 5-10 ms speech segment from the subsequent frame. In general, the N-sample frame is divided into smaller blocks called sub-frames, so as to apply pitch prediction. The sub-frame length can be set, for example, in the range 4-10 ms. In each subframe, an excitation signal is usually obtained from two components, a portion of the past excitation and an innovative or fixed-codebook excitation. The component formed from a portion of the past excitation is often referred to as the adaptive codebook or pitch excitation. The parameters characterizing the excitation signal are coded and transmitted to the decoder, where the excitation signal is reconstructed and used as the input of the LP filter. An instance of CELP coding is the ACELP (Algebraic CELP) coding model, wherein the innovative codebook consists of interleaved signed pulses.

The CELP model has been developed in the context of narrow-band speech coding, for which the input bandwidth is 300-3400 Hz. In the case of wideband speech signals defined in the 50-7000 Hz band, the CELP model is usually used in a split-band approach, where a lower band is coded by waveform matching (CELP coding) and a higher band is parametrically coded. This bandwidth splitting has several motivations:

- Most of the bits of a frame can be allocated to the lower-band signal to maximize quality.
- The computational complexity (of filtering, etc.) can be reduced compared to full-band coding.
- Also, waveform matching is not very efficient for high-frequency components.

This split-band approach is used for instance in the ETSI AMR-WB wideband speech coding standard. This coding standard is specified in [3GPP TS 26.190] and described in [Bessette, 2002]. The implementation of the AMR-WB standard is given in [3GPP TS 26.173]. The AMR-WB speech coding algorithm consists essentially of splitting the input wideband signal into a lower band (0-6400 Hz) and a higher band (6400-7000 Hz), and applying the ACELP algorithm to only the lower band and coding the higher band through bandwidth extension (BWE).

The state-of-the-art audio coding techniques, for example MPEG-AAC or ITU-T G.722.1, are built upon perceptual transform (or sub-band) coding. In transform coding, the time-domain audio signal is processed by overlapping windows of appropriate length. The reduction of bit rate is achieved by the de-correlation and energy compaction property of a specific transform, as well as coding of only the perceptually relevant transform coefficients. The windowed signal is usually decomposed (analyzed) by a discrete Fourier transform (DFT), a discrete cosine transform (DCT) or a modified discrete cosine transform (MDCT). A frame length of, for example, 40-60 ms is normally needed to achieve good audio quality. However, to represent transients and avoid time spreading of coding noise before attacks (pre-echo), shorter frames of, for example, 5-10 ms are also used to describe non-stationary audio segments. Quantization noise shaping is achieved by normalizing the transform coefficients with scale factors prior to quantization. The normalized coefficients are typically coded by scalar quantization followed by Huffman coding. In parallel, a perceptual masking curve is computed to control the quantization process and optimize the subjective quality; this curve is used to code the most perceptually relevant transform coefficients.

To improve the coding efficiency (in particular at low bit rates), band splitting can also be used with transform coding. This approach is used for instance in the new High Efficiency MPEG-AAC standard also known as aacPlus. In aacPlus, the signal is split into two sub-bands, the lower-band signal is coded by perceptual transform coding (AAC), while the higher-band signal is described by so-called Spectral Band Replication (SBR) which is a kind of bandwidth extension (BWE).

In certain applications, such as audio/video conferencing, multimedia storage and internet audio streaming, the audio signal consists typically of speech, music and mixed content. As a consequence, in such applications, an audio coding technique which is robust to this type of input signal is used. In other words, the audio coding algorithm should achieve a good and consistent quality for a wide class of audio signals, including speech and music. Nonetheless, the CELP technique is known to be intrinsically speech-optimized but may present problems when used to code music signals. State-of-the art perceptual transform coding on the other hand has good performance for music signals, but is not appropriate for coding speech signals, especially at low bit rates.

Several approaches have then been considered to code general audio signals, including both speech and music, with a good and fairly constant quality. Transform predictive coding as described in [Moreau, 1992] [Lefebvre, 1994] [Chen, 1996] and [Chen, 1997], provides a good foundation for the inclusion of both speech and music coding techniques into a single framework. This approach combines linear prediction and transform coding. The technique of [Lefebvre, 1994), called TCX (Transform Coded eXcitation) coding, which is equivalent to those of [Moreau, 1992], [Chen, 1996] and [Chen, 1997] will be considered in the following-description.

Originally, two variants of TCX coding have been designed [Lefebvre, 1994]: one for speech signals using short frames and pitch prediction, another for music signals with long frames and no pitch prediction. In both cases, the processing involved in TCX coding can be decomposed in two steps:

1) The current frame of audio signal is processed by temporal filtering to obtain a so-called target signal, and then
2) The target signal is coded in transform domain.

Transform coding of the target signal uses a DFT with rectangular windowing. Yet, to reduce blocking artifacts at frame boundaries, a windowing with small overlap has been used in [Jbira, 1998] before the DFT. In [Ramprashad, 2001], a MDCT with windowing switching is used instead; the MDCT has the advantage to provide a better frequency resolution than the DFT while being a maximally-decimated filter-bank. However, in the case of [Ramprashad, 2001], the coder does not operate in closed-loop, in particular for pitch analysis. In this respect, the coder of [Ramprashad, 2001] cannot be qualified as a variant of TCX.

The representation of the target signal not only plays a role in TCX coding but also controls part of the TCX audio quality, because it consumes most of the available bits in every coding frame. Reference is made here to transform coding in the DFT domain. Several methods have been proposed to code the target signal in this domain, see for instance [Lefebvre, 1994], [Xie, 1996], [Jbira, 1998], [Schnitzler, 1999] and [Bessette, 1999]. All these methods implement a form of gain-shape quantization, meaning that the spectrum of the target signal is first normalized by a factor or global gain g prior to the actual coding. In [Lefebvre, 1994], [Xie, 1996] and [Jbira, 1998], this factor g is set to the RMS (Root Mean Square) value of the spectrum. However, in general, it can be optimized in each frame by testing different values for the factor g, as disclosed for example in [Schnitzler, 1999] and [Bessette, 1999]. [Bessette, 1999] does not disclose actual optimisation of the factor g. To improve the quality of TCX coding, noise fill-in (i.e. the injection of comfort noise in lieu of unquantized coefficients) has been used in [Schnitzler, 1999] and [Bessette, 1999].

As explained in [Lefebvre, 1994], TCX coding can quite successfully code wideband signals, for example signals sampled at 16 kHz; the audio quality is good for speech at a sampling rate of 16 kbit/s and for music at a sampling rate of 24 kbit/s. However, TCX coding is not as efficient as ACELP for coding speech signals. For that reason, a switched ACELP/TCX coding strategy has been presented briefly in [Bessette, 1999]. The concept of ACELP/TCX coding is similar for instance to the ATCELP (Adaptive Transform and CELP) technique of [Combescure, 1999]. Obviously, the audio quality can be maximized by switching between different modes, which are actually specialized to code a certain type of signal. For instance, CELP coding is specialized for speech and transform coding is more adapted to music, so it is natural to combine these two techniques into a multi-mode framework in which each audio frame is coded adaptively with the most appropriate coding tool. In ATCELP coding, the switching between CELP and transform coding is not seamless; it requires transition modes. Furthermore, an open-loop mode decision is applied, i.e. the mode decision is made prior to coding based on the available audio signal. On the contrary, ACELP/TCX presents the advantage of using two homogeneous linear predictive modes (ACELP and TCX coding), which makes switching easier; moreover, the mode decision is closed-loop, meaning that all coding modes are tested and the best synthesis can be selected.

Although [Bessette, 1999] briefly presents a switched ACELP/TCX coding strategy, [Bessette, 1999] does not disclose the ACELP/TCX mode decision and details of the quantization of the TCX target signal in ACELP/TCX coding. The underlying quantization method is only known to be based on self-scalable multi-rate lattice vector quantization, as introduced by [Xie, 1996].

Reference is made to [Gibson, 1988] and [Gersho, 1992] for an introduction to lattice vector quantization. An N-dimensional lattice is a regular array of points in the N-dimensional (Euclidean) space. For instance, [Xie, 1996] uses an 8-dimensional lattice, known as the gosset lattice, which is defined as:

$$RE_8 = 2D_8 \cup \{2D_8 + (1, \ldots, 1)\} \tag{1}$$

where $$D_8 = \{(x_1, \ldots, x_8) \in Z^8 \mid x_1 + \ldots + x_8 \text{ is odd}\} \tag{2}$$

and $$D_8 + (1, \ldots, 1) = \{(x_1+1, \ldots, x_8+1) \in Z^8 \mid (x_1, \ldots, x_8) \in D_8\} \tag{3}$$

This mathematical structure enables the quantization of a block of eight (8) real numbers. $RE_8$ can be also defined more intuitively as the set of points $(x_1, \ldots, x_8)$ verifying the properties:

i. The components $x_i$ are signed integers (for i=1, . . . , 8);
ii. The sum $x_1 + \ldots + x_8$ is a multiple of 4; and
iii. The components $x_i$ have the same parity (for i=1, . . . , 8), i.e. they are either all even, or all odd.

An 8-dimensional quantization codebook can then be obtained by selecting a finite subset of $RE_8$. Usually the mean-square error is the codebook search criterion. In the technique of [Xie, 1996], six (6) different codebooks, called $Q_0, Q_1, \ldots, Q_5$, are defined based on the $RE_8$ lattice. Each codebook $Q_n$ where n=0, 1, . . . , 5, comprises $2^{4n}$ points, which corresponds to a rate of 4n bits per 8-dimensional sub-vector or n/2 bits per sample. The spectrum of the TCX target signal, normalized by a scaled factor g, is then quantized by splitting it into 8-dimensional sub-vectors (or sub-bands). Each of these sub-vectors is coded into one of the codebooks $Q_0, Q_1, \ldots, Q_5$. As a consequence, the quantization of the TCX target signal, after normalization by the factor g produces for each 8-dimensional sub-vector a codebook number n indicating which codebook $Q_n$ has been used and an index i identifying a specific codevector in the codebook $Q_n$. This quantization process is referred to as multi-rate lattice vector quantization, for the codebooks $Q_n$ having different rates. The TCX mode of [Bessette, 1999] follows the same principle, yet no details are provided on the computation of the normalization factor g nor on the multiplexing of quantization indices and codebooks numbers.

The lattice vector quantization technique of [Xie; 1996] based on $RE_8$ has been extended in [Ragot, 2002] to improve efficiency and reduce complexity. However, the application of the concept described by [Ragot, 2002] to TCX coding has never been proposed.

In the device of [Ragot, 2002], an 8-dimensional vector is coded through a multi-rate quantizer incorporating a set of $RE_8$ codebooks denoted as $\{Q_0, Q_2, Q_3, \ldots, Q_{36}\}$. The codebook $Q_1$ is not defined in the set in order to improve coding efficiency. All codebooks $Q_n$ are constructed as subsets of the same 8-dimensional $RE_8$ lattice, $Q_n \subset RE_8$. The bit rate of the $n^{th}$ codebook defined as bits per dimension is 4n/8, i.e. each codebook $Q_n$ contains $2^{4n}$ codevectors. The construction of the multi-rate quantizer follows the teaching of [Ragot, 2002]. For a given 8-dimensional input vector, the coder of the multi-rate quantizer finds the nearest neighbor in $RE_8$, and outputs a codebook number n and an index i in the corresponding codebook $Q_n$. Coding efficiency is improved by applying an entropy coding technique for the quantization indices, i.e. codebook numbers n and indices i of the splits. In [Ragot, 2002], a codebook number n is coded prior to multiplexing to the bit stream with an unary code that comprises a number n−1 of 1's and a zero stop bit. The codebook number represented by the unary code is denoted by $n^E$. No entropy coding is employed for codebook indices i. The unary code and bit allocation of $n^E$ and i is exemplified in the following Table 1.

TABLE 1

The number of bits required to index the codebooks.

| Codebook number $n_k$ | Unary code $n_{Ek}$ in binary form | Number of bits for $n_{Ek}$ | Number of bits for $l_k$ | Number of bits per split |
|---|---|---|---|---|
| 0 | 0 | 1 | 0 | 1 |
| 2 | 10 | 2 | 8 | 10 |
| 3 | 110 | 3 | 12 | 15 |
| 4 | 1110 | 4 | 16 | 20 |
| 5 | 11110 | 5 | 20 | 25 |
| . . . | . . . | . . . | . . . | . . . |

As illustrated in Table 1, one bit is required for coding the input vector when n=0 and otherwise 5n bits are required.

Furthermore, a practical issue in audio coding is the formatting of the bit stream and the handling of bad frames, also known as frame-erasure concealment. The bit stream is usually formatted at the coding side as successive frames (or blocks) of bits. Due to channel impairments (e.g. CRC (Cyclic Redundancy Check) violation, packet loss or delay, etc.), some frames may not be received correctly at the decoding side. In such a case, the decoder typically receives a flag declaring a frame erasure and the bad frame is "decoded" by extrapolation based on the past history of the decoder. A common procedure to handle bad frames in CELP decoding consists of reusing the past LP synthesis filter, and extrapolating the previous excitation.

To improve the robustness against frame losses, parameter repetition, also know as Forward Error Correction or FEC coding may be used.

The problem of frame-erasure concealment for TCX or switched ACELP/TCX coding has not been addressed yet in the current technology.

SUMMARY OF THE INVENTION

In a first aspect, a method is provided for low-frequency emphasizing the spectrum of a sound signal transformed in a frequency domain and comprising transform coefficients grouped in a number of blocks. A maximum energy is calculated for one block having a position index. A factor is calculated for each block having a position index smaller than the position index of the block with maximum energy. The calculation of a factor comprises, for each block, computation of an energy of the block, and computation of the factor from the calculated maximum energy and from the computed energy of the block. For each block, a gain applied to the transform coefficients of the block is determined from the factor. The method for low-frequency emphasizing the spectrum of a sound signal also comprises an application of an adaptive low-frequency emphasis to the spectrum of the sound signal to minimize a perceived distortion in lower frequencies of the spectrum.

In a second aspect, a method is provided for low-frequency emphasizing the spectrum of a sound transformed in a frequency domain and comprising transform coefficients grouped in a number of blocks. A maximum energy is calculated for one block having a position index. A factor is calculated for each block having a position index smaller than the position index of the block with maximum energy. The calculation of a factor comprises, for each block, computation of an energy of the block, and computation of the factor from the calculated maximum energy and from the computed energy of the block. For each block, a gain applied to the transform coefficients of the block is determined from the factor. The method for low-frequency emphasizing the spectrum of a sound signal also comprises grouping the transform coefficients in blocks of a predetermined number of consecutive transform coefficients.

In a third aspect, a method is provided for low-frequency emphasizing the spectrum of a sound signal transformed in a frequency domain and comprising transform coefficients grouped in a number of blocks. A maximum energy is calculated for one block having a position index. A factor is calculated for each block having a position index smaller than the position index of the block with maximum energy. The calculation of a factor comprises, for each block, computation of an energy of the block, and computation of the factor from the calculated maximum energy and from the computed energy of the block. For each block, a gain applied to the transform coefficients of the block is determined from the factor. Calculating a maximum energy for one block comprises a computation of the energy of each block up to a given position in the spectrum and storage of the energy of the block with maximum energy. Determining a position index comprises storage of the position index of the block with maximum energy.

In a fourth aspect, a method is provided for low-frequency emphasizing the spectrum of a sound signal transformed in a frequency domain and comprising transform coefficients grouped in a number of blocks. A maximum energy is calculated for one block having a position index. A factor is calculated for each block having a position index smaller than the position index of the block with maximum energy. The calculation of a factor comprises, for each block, computation of an energy of the block, and computation of the factor from the calculated maximum energy and from the computed energy of the block. For each block, a gain applied to the transform coefficients of the block is determined from the factor. Calculating the factor for each block comprises computation of a ratio $E_m$ for each block with a position index m smaller than the position index of the block with maximum energy, using the relation $R_m=E_{max}/E_m$. $E_{max}$ is the calculated maximum energy and $E_m$ is the computed energy for block corresponding to position index m.

In a fifth aspect, a method is provided for low-frequency emphasizing the spectrum of a sound signal transformed in a frequency domain and comprising transform coefficients grouped in a number of blocks. A maximum energy is calculated for one block having a position index. A factor is calculated for each block having a position index smaller than the position index of the block with maximum energy. The calculation of a factor comprises, for each block, computation of an energy of the block, and computation of the factor from the calculated maximum energy and from the computed energy of the block. For each block, a gain applied to the transform coefficients of the block is determined from the factor. Calculating the factor comprises setting the factor to a predetermined value when the factor is larger than the predetermined value.

In a sixth aspect, a method is provided for low-frequency emphasizing the spectrum of a sound signal transformed in a frequency domain and comprising transform coefficients grouped in a number of blocks. A maximum energy is calculated for one block having a position index. A factor is calculated for each block having a position index smaller than the position index of the block with maximum energy. The calculation of a factor comprises, for each block, computation of an energy of the block, and computation of the factor from the calculated maximum energy and from the computed energy of the block. For each block, a gain applied to the transform coefficients of the block is determined from the factor. Computing the factor comprises setting the factor for one block to the factor of the preceding block when the factor of the one block is larger than the factor of the preceding block.

In a seventh aspect, a device is provided for low-frequency emphasizing the spectrum of a sound signal transformed in a frequency domain and comprising transform coefficients grouped in a number of blocks. The device comprises three calculators. One is a calculator of a maximum energy for one block having a position index. Another one is a calculator of a factor for each block having a position index smaller than the position index of the block with maximum energy. The factor calculator computes, for each block, an energy of the block and the factor from the calculated maximum energy and the computed energy of the block. A further calculator is a calculator of a gain, for each block and in response to the factor, the gain being applied to the transform coefficients of the block. The transform coefficients are grouped in blocks of a predetermined number of consecutive transform coefficients.

In an eighth aspect, a device is provided for low-frequency emphasizing the spectrum of a sound signal transformed in a frequency domain and comprising transform coefficients grouped in a number of blocks. The device comprises three calculators. One is a calculator of a maximum energy for one block having a position index. Another one is a calculator of a factor for each block having a position index smaller than the position index of the block with maximum energy. The factor calculator computes, for each block, an energy of the block and the factor from the calculated maximum energy and the computed energy of the block. A further calculator is a calculator of a gain, for each block and in response to the factor, the gain being applied to the transform coefficients of the block. The maximum energy calculator computes the energy of each block up to a predetermined position in the spectrum. The maximum energy calculator comprises a store for the maximum energy and a store for the position index of the block with maximum energy.

In a ninth aspect, a device is provided for low-frequency emphasizing the spectrum of a sound signal transformed in a frequency domain and comprising transform coefficients grouped in a number of. The device comprises three calculators. One is a calculator of a maximum energy for one block having a position index. Another one is a calculator of a factor for each block having a position index smaller than the position index of the block with maximum energy. The factor calculator computes, for each block, an energy of the block and the factor from the calculated maximum energy and the computed energy of the block. A further calculator is a calculator of a gain, for each block and in response to the factor, the gain being applied to the transform coefficients of the block. The factor calculator computes a ratio $R_m$ for each block with a position index m smaller than the position index of the block with maximum energy, using the relation $R_m=E_{max}/E_m$. $E_{max}$ is the calculated maximum energy and $E_m$ the computed energy for the block corresponding to the position index m.

In a tenth aspect, a device is provided for low-frequency emphasizing the spectrum of a sound signal transformed in a frequency domain and comprising transform coefficients grouped in a number of blocks. The device comprises three calculators. One is a calculator of a maximum energy for one block having a position index. Another one is a calculator of a factor for each block having a position index smaller than the position index of the block with maximum energy. The factor calculator computes, for each block, an energy of the block and the factor from the calculated maximum energy and the computed energy of the block. A further calculator is a calculator of a gain, for each block and in response to the factor, the gain being applied to the transform coefficients of the block. The factor calculator sets the factor to a predetermined value when the factor is larger than the predetermined value.

In an eleventh aspect, a device is provided for low-frequency emphasizing the spectrum of a sound signal transformed in a frequency domain and comprising transform coefficients grouped in a number of blocks. The device comprises three calculators. One is a calculator of a maximum energy for one block having a position index. Another one is a calculator of a factor for each block having a position index smaller than the position index of the block with maximum energy. The factor calculator computes, for each block, an energy of the block and the factor from the calculated maximum energy and the computed energy of the block. A further calculator is a calculator of a gain, for each block and in response to the factor, the gain being applied to the transform coefficients of the block. The factor calculator sets the factor for one block to the factor of the preceding block when the factor of the one block is larger than the factor of the preceding block.

In a twelfth aspect, a method is provided for processing a received, coded sound signal. Coding parameters are extracted from the received, coded sound signal, the extracted coding parameters including transform coefficients of a frequency transform of the sound signal. The transform coefficients are grouped in a number of blocks and are low-frequency emphasized using following steps. In a first step, a maximum energy is calculated for one block having a position index. In a second step, a factor is calculated for each block having a position index smaller than the position index of the block with maximum energy. In that second step, the factor calculation comprises, for each block, computation of an energy of the block and computation of the factor from the calculated maximum energy and the computed energy of the block. In a third step, for each block, a gain applied to the transform coefficients of the block is determined from the factor. The extracted coding parameters are processed to synthesize the sound signal. Processing the extracted coding parameters comprises low-frequency de-emphasizing the low-frequency emphasized transform coefficients.

In a thirteenth aspect, a decoder is provided for processing a received, coded sound signal. An input decoder portion is supplied with the received, coded sound signal and implements an extractor of coding parameters from the received, coded sound signal. The extracted coding parameters include transform coefficients of a frequency transform of the sound signal. The transform coefficients are low-frequency emphasized using a device for low-frequency emphasizing the spectrum of the sound signal transformed in a frequency domain. The extracted coding parameters comprise transform coefficients grouped in a number of blocks. The device includes three calculators. One is a calculator of a maximum energy for one block having a position index. Another one is a calculator of a factor for each block having a position index smaller than the position index of the block with maximum energy. The factor calculator, for each block, computes an energy of the block and computes the factor from the calculated maximum energy and the computed energy of the block. A third one is a calculator of a gain, for each block and in response to the factor, the gain being applied to the transform coefficients of the block. A processor of the extracted coding parameters synthesizes the sound signal. The processor comprises a low-frequency de-emphasis module supplied with the low-frequency emphasized transform coefficients.

DETAILED DESCRIPTION OF THE ILLUSTRATIVE EMBODIMENTS

The non-restrictive illustrative embodiments of the present invention will be disclosed in relation to an audio coding/ decoding device using the ACELP/TCX coding model and self-scalable multi-rate lattice vector quantization model. However, it should be kept in mind that the present invention could be equally applied to other types of coding and quantization models.

Overview of the Coder

High-Level Description of the Coder

Figure 1:
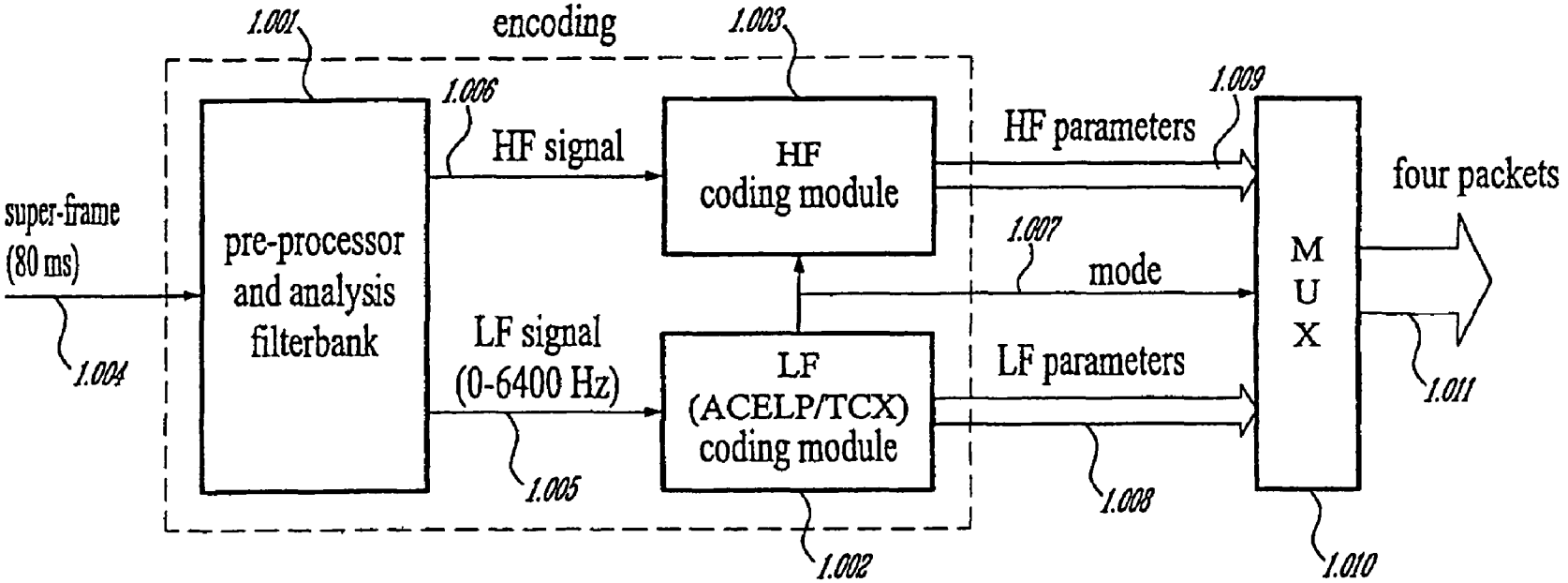
FIG. 1 is a high-level schematic block diagram of one embodiment of the coder in accordance with the present invention.

A high-level schematic block diagram of one embodiment of a coder according to the present invention is illustrated in FIG. 1.

Referring to FIG. 1, the input signal is sampled at a frequency of 16 kHz or higher, and is coded in super-frames such as 1.004 of T ms, for example with T=80 ms. Each super-frame 1.004 is pre-processed and split into two sub-bands, for example in a manner similar to pre-processing in AMR-WB. The lower-frequency (LF) signals such as 1.005 are defined within the 0-6400 Hz band while the higher-frequency (HF) signals such as 1.006 are defined within the 6400-$F_{max}$ Hz band, where $F_{max}$ is the Nyquist frequency. The Nyquist frequency is the minimum sampling frequency which theoretically permits the original signal to be reconstituted without distortion: for a signal whose spectrum nominally extends from zero frequency to a maximum frequency, the Nyquist frequency is equal to twice this maximum frequency.

Still referring to FIG. 1, the LF signal 1.005 is coded through multi-mode ACELP/TCX coding (see module 1.002) built, in the illustrated example, upon the AMR-WB core. AMR-WB operates on 20-ms frames within the 80-ms super-frame. The ACELP mode is based on the AMR-WB coding algorithm and, therefore, operates on 20-ms frames. The TCX mode can operate on either 20, 40 or 80 ms frames within the 80-ms super-frame. In this illustrative example, the three (3) TCX frame-lengths of 20, 40, and 80 ms are used with an overlap of 2.5, 5, and 10 ms, respectively. The overlap is necessary to reduce the effect of framing in the TCX mode (as in transform coding).

Figure 2:
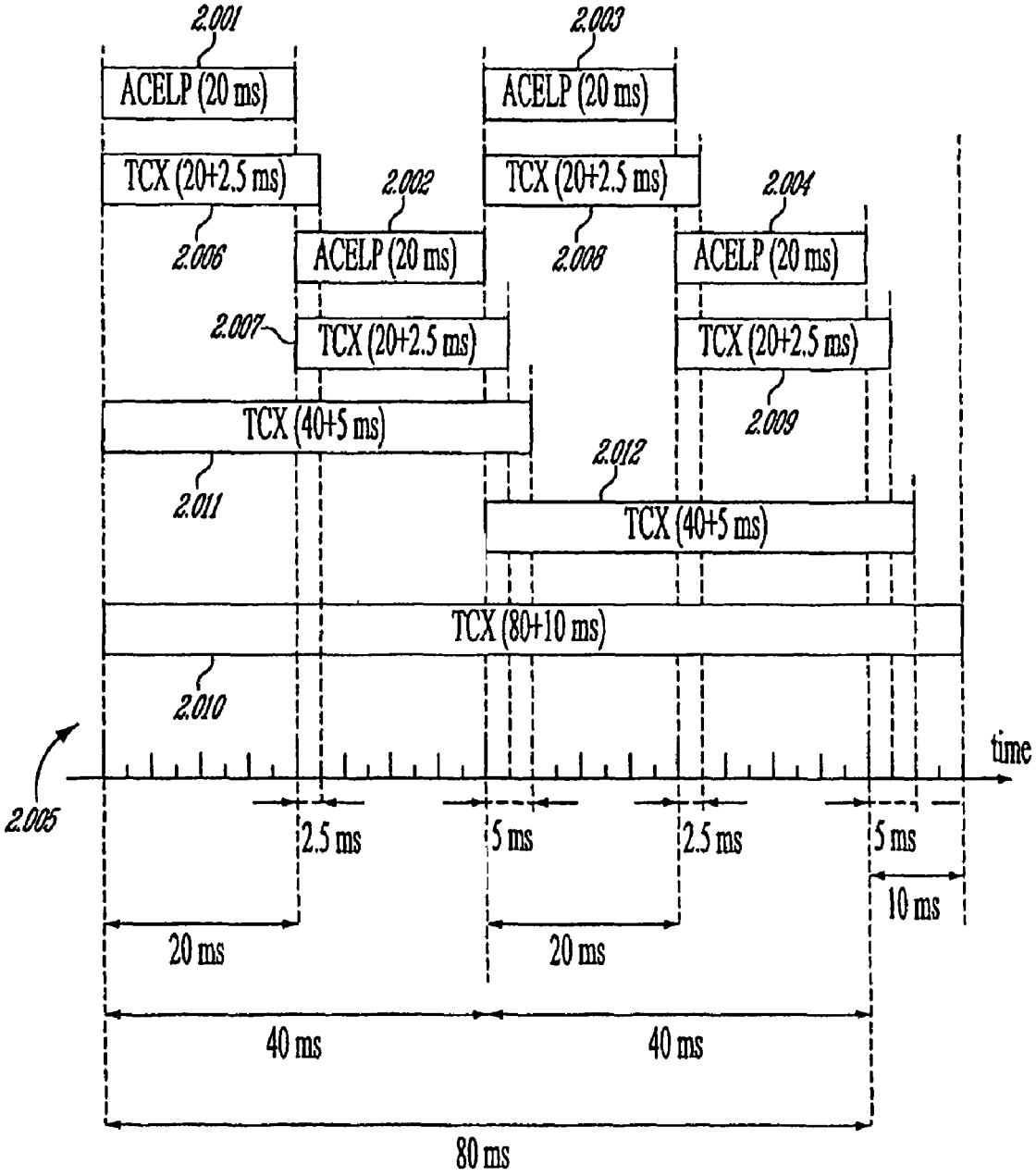
FIG. 2 is a non-limitative example of timing chart of the frame types in a super-frame.

FIG. 2 presents an example of timing chart of the frame types for ACELP/TCX coding of the LF signal. As illustrated in FIG. 2, the ACELP mode can be chosen in any of first 2.001, second 2.002, third 2.003 and fourth 2.004 20-ms ACELP frames within an 80-ms super-frame 2.005. Similarly, the TCX mode can be used in any of first 2.006, second 2.007, third 2.008 and fourth 2.009 20-ms TC x frames within the 80-ms super-frame 2.005. Additionally, the first two or the last two 20-ms frames can be grouped together to form 40-ms TCX frames 2.011 and 2.012 to be coded in TCX mode. Finally, the whole 80-ms super-frame 2.005 can be coded in one single 80-ms TCX frame 2.010. Hence, a total of 26 different combinations of ACELP and TCX frames are available to code an 80-ms super-frame such as 2.005. The types of frames, ACELP or TCX and their length in an 80-ms super-frame are determined in closed-loop, as will be disclosed in the following description.

Referring back to FIG. 1, the HF signal 1.006 is coded using a bandwidth extension approach (see HF coding module 1.003). In bandwidth extension, an excitation-filter parametric model is used, where the filter is coded using few bits and where the excitation is reconstructed at the decoder from the received LF signal excitation. Also, in one embodiment, the frame types chosen for the lower band (ACELP/TCX) dictate directly the frame length used for bandwidth extension in the 80-ms super-frame.

Super-Frame Configurations

All possible super-frame configurations are listed in Table 2 in the form ($m_1$, $m_2$, $m_3$, $m_4$) where—$m_k$ denotes the frame type selected for the $k^{th}$ frame of 20 ms inside the 80-ms super-frame such that $m_k$=0 for 20-ms ACELP frame, $m_k$=1 for 20-ms TCX frame, $m_k$=2 for 40-ms TCX frame, $m_k$=3 for 80-ms TCX frame.

For example, configuration (1, 0, 2, 2) indicates that the 80-ms super-frame is coded by coding the first 20-ms frame as a 20-ms TCX frame (TCX20), followed by coding the second 20-ms frame as a 20-ms ACELP frame and finally by coding the last two 20-ms frames as a single 40-ms TCX frame (TCX40) Similarly, configuration (3, 3, 3, 3) indicates that a 80-ms TCX frame (TCX80) defines the whole super-frame 2.005.

TABLE 2

| All possible 26 super-frame configurations | | | |
|---|---|---|---|
| (0, 0, 0, 0) | (0, 0, 0, 1) | (2, 2, 0, 0) | |
| (1, 0, 0, 0) | (1, 0, 0, 1) | (2, 2, 1, 0) | |
| (0, 1, 0, 0) | (0, 1, 0, 1) | (2, 2, 0, 1) | |
| (1, 1, 0, 0) | (1, 1, 0, 1) | (2, 2, 1, 1) | |
| (0, 0, 1, 0) | (0, 0, 1, 1) | (0, 0, 2, 2) | |
| (1, 0, 1, 0) | (1, 0, 1, 1) | (1, 0, 2, 2) | |
| (0, 1, 1, 0) | (0, 1, 1, 1) | (0, 1, 2, 2) | (2, 2, 2, 2) |
| (1, 1, 1, 0) | (1, 1, 1, 1) | (1, 1, 2, 2) | (3, 3, 3, 3) |

Mode Selection

The super-frame configuration can be determined either by open-loop or closed-loop decision. The open-loop approach consists of selecting the super-frame configuration following some analysis prior to super-frame coding in such as way as to reduce the overall complexity. The closed-loop approach consists of trying all super-frame combinations and choosing the best one. A closed-loop decision generally provides higher quality compared to an open-loop decision, with a tradeoff on complexity. A non-limitative example of closed-loop decision is summarized in the following Table 3.

In this non-limitative example of closed-loop decision, all 26 possible super-frame configurations of Table 2 can be selected with only 11 trials: The left half of Table 3 (Trials) shows what coding mode is applied to each 20-ms frame at each of the 11 trials. Fr1 to Fr4 refer to Frame 1 to Frame 4 in the super-frame. Each trial number (1 to 11) indicates a step in the closed-loop decision process. The final decision is known only after step 11. It should be noted that each 20-ms frame is involved in only four (4) of the 11 trials. When more than one (1) frame is involved in a trial (see for example trials 5, 10 and 11), then TCX coding of the corresponding length is applied (TCX40 or TCX80). To understand the intermediate steps of the closed-loop decision process, the right half of Table 3 gives an example of closed-loop decision, where the final decision after trial 11 is TCX80. This corresponds to a value 3 for the mode in all four (4) 20-ms frames of that particular super-frame. Bold numbers in the example at the right of Table 3 show at what point a mode selection takes place in the intermediate steps of the closed-loop decision process.

TABLE 3

Trials and example of closed-loop mode selection

| | TRIALS (11) | | | | Example of selection (in bold = comparison is made) | | | |
|---|---|---|---|---|---|---|---|---|
| | Fr 1 | Fr 2 | Fr 3 | Fr 4 | Fr 1 | Fr 2 | Fr 3 | Fr 4 |
| 1 | ACELP | | | | ACELP | | | |
| 2 | TCX20 | | | | **ACELP** | | | |
| 3 | | ACELP | | | ACELP | ACELP | | |
| 4 | | TCX20 | | | ACELP | **TCX20** | | |
| 5 | TCX40 | TCX40 | | | **ACELP** | **TCX20** | | |
| 6 | | | ACELP | | ACELP | TCX20 | ACELP | |
| 7 | | | TCX20 | | ACELP | TCX20 | **TCX20** | |
| 8 | | | | ACELP | ACELP | TCX20 | TCX20 | ACELP |
| 9 | | | | TCX20 | ACELP | TCX20 | TCX20 | **TCX20** |
| 10 | | | TCX40 | TCX40 | ACELP | TCX20 | **TCX40** | **TCX40** |
| 11 | TCX80 | TCX80 | TCX80 | TCX80 | **TCX80** | **TCX80** | **TCX80** | **TCX80** |

The closed-loop decision process of Table 3 proceeds as follows. First, in trials 1 and 2, ACELP (AMR-WB) and TCX20 coding are tried on 20-ms frame Fr1. Then, a selection is made for frame Fr1 between these two modes. The selection criterion can be the segmental Signal-to-Noise Ratio (SNR) between the weighted signal and the synthesized weighted signal. Segmental SNR is computed using, for example, 5-ms segments, and the coding mode selected is the one resulting in the best segmental SNR. In the example of Table 3, it is assumed that ACELP mode was retained as indicated in bold on the right side of Table 3.

In trial 3 and 4, the same comparison is made for frame Fr2 between ACELP and TCX20. In the illustrated example of Table 3, it is assumed that TCX20 was better than ACELP. Again TCX20 is selected on the basis of the above-described segmental SNR measure. This selection is indicated in bold on line 4 on the right side of Table 3.

In trial 5, frames Fr1 and Fr2 are grouped together to form a 40-ms frame which is coded using TCX40. The algorithm now has to choose between TCX40 for the first two frames Fr1 and Fr2, compared to ACELP in the first frame Fr1 and TCX20 in the second frame Fr2. In the example of Table 3, it is assumed that the sequence ACELP-TCX20 was selected in accordance with the above-described segmental SNR criterion as indicated in bold in line 5 on the right side of Table 3.

The same procedure as trials 1 to 5 is then applied to the third Fr3 and fourth Fr4 frames in trials 6 to 10. Following trial 10 in the example of Table 3, the four 20-ms frames are classified as ACELP for frame Fr1, TCX20 for frame Fr2, and TCX40 for frames Fr3 and Fr4 grouped together.

A last trial 11 is performed when all four 20-ms frames, i.e. the whole 80-ms super-frame is coded with TCX80. Again, the segmental SNR criterion is again used with 5-ms segments to compare trials 10 and 11. In the example of Table 3, it is assumed that the final closed-loop decision is TCX80 for the whole super-frame. The mode bits for the four (4) 20-ms frames would then be (3, 3, 3, 3) as discussed in Table 2.

Overview of the TCX Mode

The closed-loop mode selection disclosed above implies that the samples in a super-frame have to be coded using ACELP and TCX before making the mode decision. ACELP coding is performed as in AMR-WB. TCX coding is performed as shown in the block diagram of FIG. 5. The TCX coding mode is similar for TCX frames of 20, 40 and 80 ms, with a few differences mostly involving windowing and filter interpolation. The details of TCX coding will be given in the following description of the coder. For now, TCX coding of FIG. 5 can be summarized as follows.

The input audio signal is filtered through a perceptual weighting filter (same perceptual weighting filter as in AMR-WB) to obtain a weighted signal. The weighting filter coefficients are interpolated in a fashion which depends on the TCX frame length. If the past frame was an ACELP frame, the zero-input response (ZIR) of the perceptual weighting filter is removed from the weighted signal. The signal is then windowed (the window shape will be described in, the following description) and a transform is applied to the windowed signal. In the transform domain, the signal is first pre-shaped, to minimize coding noise artifact in the lower frequencies, and then quantized using a specific lattice quantizer that will be disclosed in the following description. After quantization, the inverse pre-shaping function is applied to the spectrum which is then inverse transformed to provide a quantized time-domain signal. After gain resealing, a window is again applied to the quantized signal to minimize the block effects of quantizing in the transform domain. Overlap-and-add is used with the previous frame if this previous frame was also in TCX mode. Finally, the excitation signal is found through inverse filtering with proper filter memory updating. This TCX excitation is in the same "domain" as the ACELP (AMR-WB) excitation.

Details of TCX coding as shown in FIG. 5 will be described herein below.

Overview of Bandwidth Extension (BWE)

Bandwidth extension is a method used to code the HF signal at low cost, in terms of both bit rate and complexity. In this non-limitative example, an excitation-filter model is used to code the HF signal. The excitation is not transmitted; rather, the decoder extrapolates the HF signal excitation from the received, decoded LF excitation. No bits are required for transmitting the HF excitation signal; all the bits related to the HF signal are used to transmit an approximation of the spectral envelope of this HF signal. A linear LPC model (filter) is computed on the down-sampled HF signal 1.006 of FIG. 1. These LPC coefficients can be coded with few bits since the resolution of the ear decreases at higher frequencies, and the spectral dynamics of audio signals also tends to be smaller at higher frequencies. A gain is also transmitted for every 20-ms frame. This gain is required to compensate for the lack of matching between the HF excitation signal extrapolated from the LF excitation signal and the transmitted LPC filter related to the HF signal. The LPC filter is quantized in the Immitance Spectral Frequencies (ISF) domain.

Coding in the lower- and higher-frequency bands is time-synchronous such that bandwidth extension is segmented over the super-frame according the mode selection of the lower band. The bandwidth extension module will be disclosed in the following description of the coder.

Coding Parameters

The coding parameters can be divided into three (3) categories as shown in FIG. 1; super-frame configuration information (or mode information) 1.007, LF parameters 1.008 and HF parameters 1.009.

The super-frame configuration can be coded using different approaches. For example, to meet specific system requirements, it is often desired or required to send large packets such as 80-ms super-frames, as a sequence of smaller packets each corresponding to fewer bits and having possibly a shorter duration. Here, each 80-ms super-frame is divided into four consecutive, smaller packets. For partitioning a super-frame into four packets, the type of frame chosen for each 20-ms frame within a super-frame is indicated by means of two bits to be included in the corresponding packet. This can be readily accomplished by mapping the integer $m_k \in \{0, 1, 2, 3\}$ into its corresponding binary representation. It should be recalled that $m_k$ is an integer describing the coding mode selected for the $k^{th}$ 20-ms frame within a 80-ms super-frame.

The LF parameters depend on the type of frame. In ACELP frames, the LF parameters are the same as those of AMR-WB, in addition to a mean-energy parameter to improve the performance of AMR-WB on attacks in music signals. More specifically, when a 20-ms frame is coded in ACELP mode (mode 0), the LF parameters sent for that particular frame in the corresponding packet are:

The ISF parameters (46 bits reused from AMR-WB);

The mean-energy parameter (2 additional bits compared to AMR-WB);

The pitch lag (as in AMR-WB);

The pitch filter (as in AMR-WB);

The fixed-codebook indices (reused from AMR-WB); and

The codebook gains (as in 3GPP AMR-WB).

Figure 6:
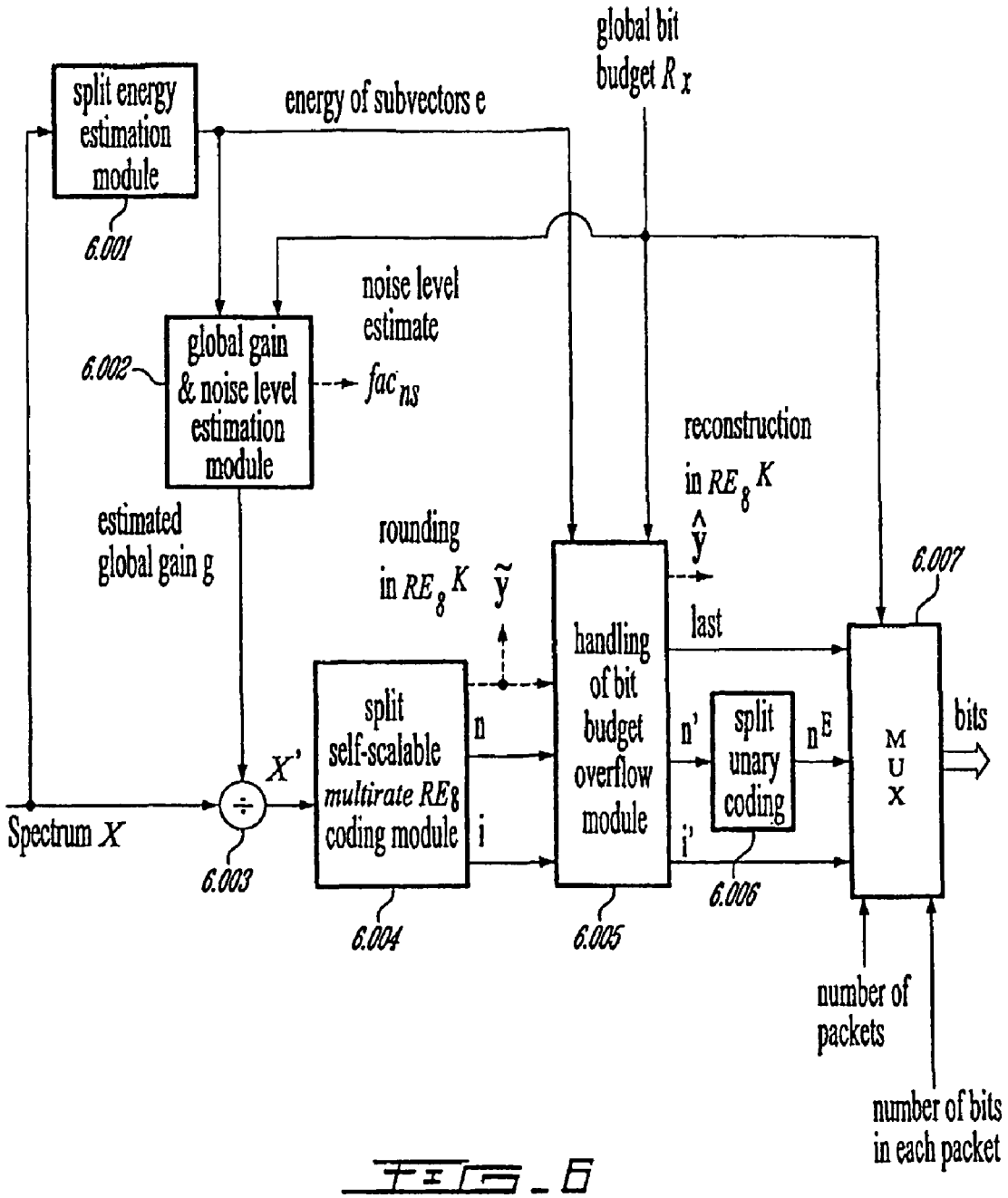
FIG. 6 is a schematic block diagram showing how algebraic coding is used to quantize a set of coefficients, for example frequency coefficients on the basis of a previously described self-scalable multi-rate lattice vector quantizer using a $RE_8$ lattice.

In TCX frames, the ISF parameters are the same as in the ACELP mode (AMR-WB), but they are transmitted only once every TCX frame. For example, if the 80-ms super-frame is composed of two 40-ms TCX frames, then only two sets of ISF parameters are transmitted for the whole 80-ms super-frame. Similarly, when the 80-ms super-frame is coded as only one 80-ms TCX frame, then only one set of ISF parameters is transmitted for that super-frame. For each TCX frame, either TCX20, TCX40 and TCX80, the following parameters are transmitted:

One set of ISF parameters (46 bits reused from AMR-WB);

Parameters describing quantized spectrum coefficients in the multi-rate lattice VQ (see FIG. 6);

Noise factor for noise fill-in (3 bits); and

Global gain (scalar, 7 bits).

These parameters and their coding will be disclosed in the following description of the coder. It should be noted that a large portion of the bit budget in TCX frames is dedicated to the lattice VQ indices.

The HF parameters, which are provided by the Bandwidth extension, are typically related to the spectrum envelope and energy. The following HF parameters are transmitted:

One set of ISF parameters (order 8, 9 bits) per frame, wherein a frame can be a 20-ms ACELP frame, a TCX20 frame, a TCX40 frame or a TCX80 frame;

HF gain (7 bits), quantized as a 4-dimensional gain vector, with one gain per 20, 40 or 80-ms frame; and HF gain correction for TCX40 and TCX80 frames, to modify the more coarsely quantized HF gains in these TCX modes.

Bit Allocations According to One Embodiment

The ACELP/TCX codec according to this embodiment can operate at five bit rates: 13.6, 16.8, 19.2, 20.8 and 24.0 kbit/s. These bit rates are related to some of the AMR-WB rates. The numbers of bits to encode each 80-ms super-frame at the five (5) above-mentioned bit rates are 1088, 1344, 1536, 1664, and 1920 bits, respectively. More specifically, a total of 8 bits are allocated for the super-frame configuration (2 bits per 20-ms frame) and 64 bits are allocated for bandwidth extension in each 80-ms super-frame. More or fewer bits could be used for the bandwidth extension, depending on the resolution desired to encode the HF gain and spectral envelope. The remaining bit budget, i.e. most of the bit budget, is used to encode the LF signal 1.005 of FIG. 1. A non-limitative example of a typical bit allocation for the different types of frames is given in appended Tables 4, 5a, 5b and 5c. The bit allocation for bandwidth extension is shown in Table 6. These tables indicate the percentage of the total bit budget typically used for encoding the different parameters. It should be noted that, in Tables 5b and 5c, corresponding respectively to TCX40 and TCX80 frames, the numbers in parentheses show a splitting of the bits into two (Table 5b) or four (Table 5c) packets of equal size. For example, Table 5c indicates that in TCX80 mode, the 46 ISF bits of the super-frame (one LPC filter for the entire super-frame) are split into 16 bits in the first packet, 6 bits in the second packet, 12 bits in the third packet and finally 12 bits in the last packet.

Similarly, the algebraic VQ bits (most of the bit budget in TCX modes) are split into two packets (Table 5b) or four packets (Table 5c). This splitting is conducted in such a way that the quantized spectrum is split into two (Table 5b) or four (Table 5c) interleaved tracks, where each track contains one out of every two (Table 5b) or one out of every four (Table 5c) spectral block. Each spectral block is composed of four successive complex spectrum coefficients. This interleaving ensures that, if a packet is missing, it will only cause interleaved "holes" in the decoded spectrum for TCX40 and TCX80 frames. This splitting of bits into smaller packets for TCX40 and TCX80 frames has to be done carefully, to manage overflow when writing into a given packet.

Description of a Non-Restrictive Illustrative Embodiment of the Coder

In this embodiment of the coder, the audio signal is assumed to be sampled in the PCM format at 16 kHz or higher, with a resolution of 16 bits per sample. The role of the coder is to compute and code parameters based on the audio signal, and to transmit the encoded parameters into the bit stream for decoding and synthesis purposes. A flag indicates to the coder what is the input sampling rate.

A simplified block diagram of this embodiment of the coder is shown in FIG. 1.

The input signal is divided into successive blocks of 80 ms, which will be referred to as super-frames such as 1.004 (FIG. 1) in the following description. Each 80-ms super-frame 1.004 is pre-processed, and then split into two sub-band signals, i.e. a LP signal 1.005 and an HF signal 1.006 by a pre-processor and analysis filterbank 1.001 using a technique similar to AMR-WB speech coding. For example, the LF and HF signals 1.005 and 1.006 are defined in the frequency bands 0-6400 Hz and 6400-11025 Hz, respectively.

As was disclosed in the coder overview, the LF signal 1.005 is coded by multimode ACELP/TCX coding through a LF (ACELP/TCX) coding module 1.002 to produce mode information 1.007 and quantized LF parameters 1.008, while the HF signal is coded through an HF (bandwidth extension)

coding module 1.003 to produce quantized HF parameters 1.009. As illustrated in FIG. 1, the coding parameters computed in a given 80-ms super-frame, including the mode information 1.007 and the quantized HF and LF parameters 1.008 and 1.009 are multiplexed into, for example, four (4) packets 1.011 of equal size through a multiplexer 1.010.

In the following description the main blocks of the diagram of FIG. 1, including the pre-processor and analysis filterbank 1.001, the LF (ACELP/TCX) coding module 1.002 and the HF coding module 1.003 will be described in more detail.

Pre-Processor and Analysis Filterbank 1.001

Figure 19:
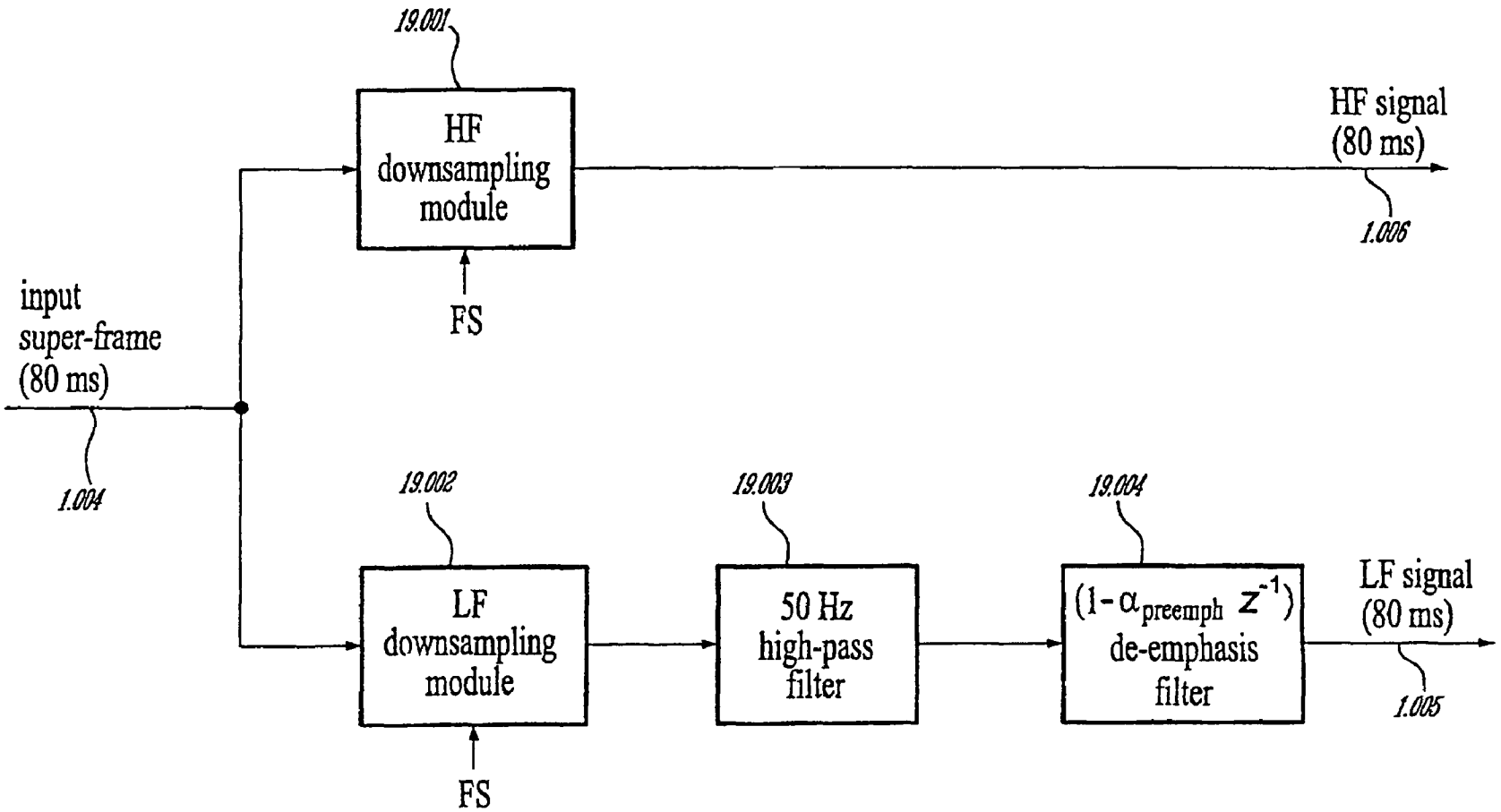
FIG. 19 is schematic block diagram showing a non-limitative example of pre-processing and sub-band decomposition applied at the coder side on each 80-ms super-frame.

FIG. 19 is a schematic block diagram of the pre-processor and analysis filterbank 1.001 of FIG. 1. Referring to FIG. 19, the input 80-ms super-frame 1.004 is divided into two sub-band signals, more specifically the LF signal 1.005 and the HF signal 1.006 at the output of pre-processor and analysis filterbank 1.001 of FIG. 1.

Still referring to FIG. 19, an HF downsampling module 19.001 performs downsampling with proper filtering (see for example AMR-WB) of the input 80-ms super-frame to obtain the HF signal 1.006 (80-ms frame) and a LF downsampling module 19.002 performs downsampling with proper filtering (see for example AMR-WB) of the input 80-ms super-frame to obtain the LF signal (80-ms frame), using a method similar to AMR-WB sub-band decomposition. The HF signal 1.006 forms the input signal of the HF coding module 1.003 in FIG. 1. The LF signal from the LF downsampling module 19.002 is further pre-processed by two filters before being supplied to the LF coding module 1.002 of FIG. 1. First, the LF signal from module 19.002 is processed through a high-pass filter 19.003 having a cut-off frequency of 50 Hz to remove the DC-component and the very low frequency components. Then, the filtered LF signal from the high-pass filter 19.003 is processed through a de-emphasis filter 19.004 to accentuate the high-frequency components. This de-emphasis is typical in wideband speech coders and, accordingly, will not be further discussed in the present specification. The output of de-emphasis filter 19.004 constitutes the LF signal 1.005 of FIG. 1 supplied to the LF coding module 1.002.

LF coding

Figure 18:
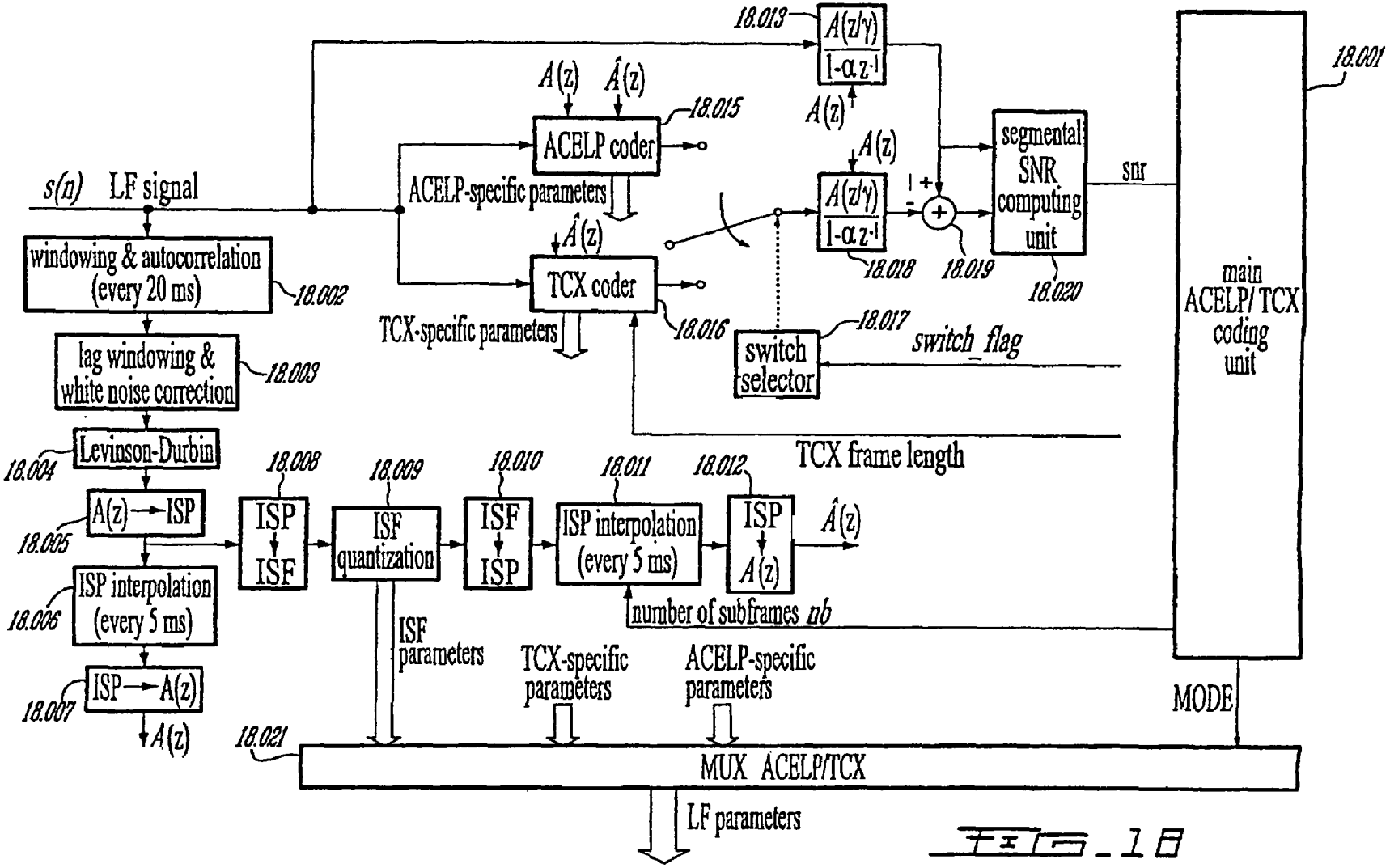
FIG. 18 is a schematic block diagram of a non-limitative example of LF coder, showing how ACELP and TCX coders are tried in competition, using a segmental SNR (Signal-to-Noise Ratio) criterion to select the proper coding mode for each frame in an 80-ms super-frame.

A simplified block diagram of a non-limitative example of LF coder is shown in FIG. 18. FIG. 18 shows that two coding modes, in particular but not exclusively ACELP and TCX modes are in competition within every 80-ms super-frame. More specifically, a selector switch 18.017 at the output of ACELP coder 18.015 and TCX coder 18.016 enables each 20-ms frame within an 80-ms super-frame to be coded in either ACELP or TCX mode, i.e. either in TCX20, TCX40 or TCX80 mode. Mode selection is conducted as explained in the above overview of the coder.

The LF coding therefore uses two coding modes: an ACELP mode applied to 20-ms frames and TCX. To optimize the audio quality, the length of the frames in the TCX mode is allowed to be variable. As explained hereinabove, the TCX mode operates either on 20-ms, 40-ms or 80-ms frames. The actual timing structure used in the coder is illustrated in FIG. 2.

Figure 3:
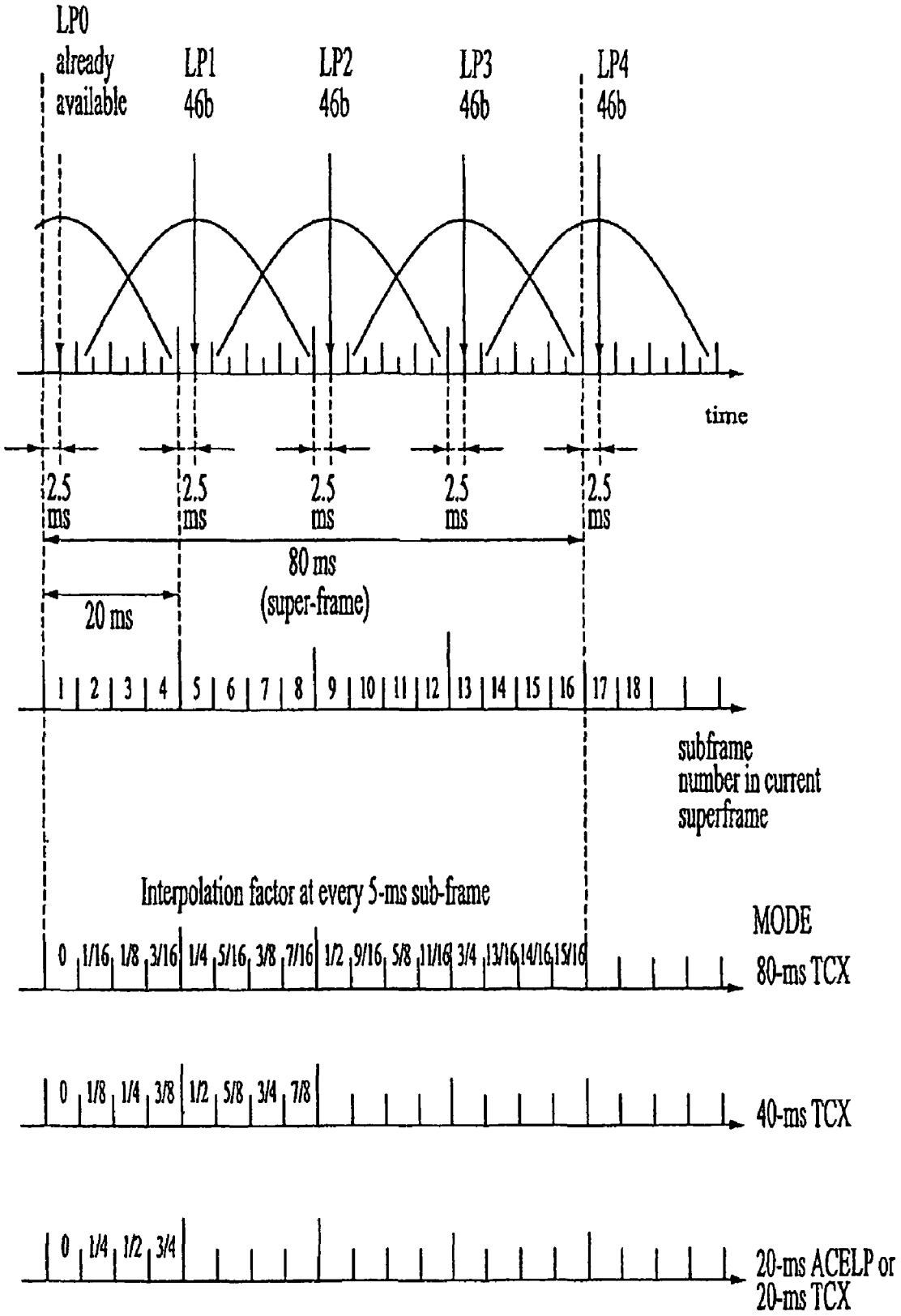
FIG. 3 is a chart showing a non-limitative example of windowing for linear predictive analysis, along with interpolation factors as used for 5-ms sub-frames and depending on the 20-ms ACELP, 20-ms TCX, 40-ms TCX or 80-ms TCX frame mode.

In FIG. 18, LPC analysis is first performed on the input LF signal s(n). The window type, position and length for the LPC analysis are shown in FIG. 3, where the windows are positioned relative to an 80-ms segment of LF signal, plus a given look-ahead. The windows are positioned every 20 ms. After windowing, the LPC coefficients are computed every 20 ms, then transformed into Immitance Spectral Pairs (ISP) representation and quantized for transmission to the decoder. The quantized ISP coefficients are interpolated every 5 ms to smooth the evolution of the spectral envelope.

More specifically, module 18.002 is responsive to the input LF signal s(n) to perform both windowing and autocorrelation every 20 ms. Module 18.002 is followed by module 18.003 that performs lag windowing and white noise correction. The lag windowed and white noise corrected signal is processed through the Levinson-Durbin algorithm implemented in module 18.004. A module 18.005 then performs ISP conversion of the LPC coefficients. The ISP coefficients from module 18.005 are interpolated every 5 ms in the ISP domain by module 18.006. Finally, module 18.007 converts the interpolated ISP coefficients from module 18.006 into interpolated LPC filter coefficients A(z) every 5 ms.

The ISP parameters from module 18.005 are transformed into ISF (Immitance Spectral Frequencies) parameters in module 18.008 prior to quantization In the ISF domain (module 18.009). The quantized ISF parameters from module 18.009 are supplied to an ACELP/TCX multiplexer 18.021.

Also, the quantized ISF parameters from module 18.009 are converted to ISP parameters in module 18.010, the obtained ISP parameters are interpolated every 5 ms in the ISP domain by module 18.011, and the interpolated ISP parameters are converted to quantized LPC parameters $\hat{A}(z)$ every 5 ms.

The LF input signal s(n) of FIG. 18 is encoded both in ACELP mode by means of ACELP coder 18.015 and in TCX mode by means of TCX coder 18.016 in all possible frame-length combinations as explained in the foregoing description. In ACELP mode, only 20-ms frames are considered within a 80-ms super-frame, whereas in TCX mode 20-ms, 40-ms and 80-ms frames can be considered. All the possible ACELP/TCX coding combinations of Table 2 are generated by the coders 18.015 and 18.016 and then tested by comparing the corresponding synthesized signal to the original signal in the weighted domain. As shown in Table 2, the final selection can be a mixture of ACELP and TCX frames in a coded 80-ms super-frame.

For that purpose, the LF signal s(n) is processed through a perceptual weighting filter 18.013 to produce a weighted LF signal. In the same manner, the synthesized signal from either the ACELP coder 18.015 or the TCX coder 18.016 depending on the position of the switch selector 18.017 is processed through a perceptual weighting filter 18.018 to produce a weighted synthesized signal. A subtractor 18.019 subtracts the weighted synthesized signal from the weighted LF signal to produce a weighted error signal. A segmental SNR computing unit 18.020 is responsive to both the weighted LP signal from filter 18.013 and the weighted error signal to produce a segmental Signal-to-Noise Ratio (SNR). The segmental SNR is produced every 5-ms sub-frames. Computation of segmental SNR is well known to those of ordinary skill in the art and, accordingly, will not be further described in the present specification. The combination of ACELP and/or TCX modes which minimizes the segmental SNR over the 80-ms super-frame is chosen as the best coding mode combination. Again, reference is made to Table 2 defining the 26 possible combinations of ACELP and/or TCX modes in a 80-ms super-frame.

ACELP Mode

The ACELP mode used Is very similar to the ACELP algorithm operating at 12.8 kHz in the AMR-WB speech coding standard. The main changes compared to the ACELP algorithm in AMR-WB are:

- The LP analysis uses a different windowing, which is illustrated in FIG. 3.
- Quantization of the codebook gains is done every 5-ms sub-frame, as explained in the following description.

The ACELP mode operates on 5-ms sub-frames, where pitch analysis and algebraic codebook search are performed every sub-frame.

Codebook Gain Quantization in ACELP Mode

In a given 5-ms ACELP subframe the two codebook gains, including the pitch gain $g_p$ and fixed-codebook gain $g_c$ are quantized jointly based on the 7-bit gain quantization of AMR-WB. However, the Moving Average (MA) prediction of the fixed-codebook gain $g_c$, which is used in AMR-WB, is replaced by an absolute reference which is coded explicitly. Thus, the codebook gains are quantized by a form of mean-removed quantization. This memoryless (non-predictive) quantization is well justified, because the ACELP mode may be applied to non-speech signals, for example transients in a music signal, which requires a more general quantization than the predictive approach of AMR-WB.

Computation and Quantization of the Absolute Reference (in Log Domain)

A parameter, denoted $\mu_{ener}$, is computed in open-loop and quantized once per frame with 2 bits. The current 20-ms frame of LPC residual $r=(r_0, r_1, \ldots, r_L)$ where L is the number of samples in the frame, is divided into four (4) 5-ms sub-frames, $r_i=(r_i(0), \ldots, r_i(L_{sub}-1))$, with $i=0, \ldots, 3$ and $L_{sub}$ is the number of sample in the sub-frame. The parameter $\mu_{ener}$ is simply defined as the average of energies of the sub-frames (in dB) over the current frame of the LPC residual:

$$\mu_{ener}\ (\text{dB}) = \frac{e_0\ (\text{dB}) + e_1\ (\text{dB}) + e_2\ (\text{dB}) + e_3\ (\text{dB})}{4}$$

where $$e_i = 1 + \frac{r_i(0)^2 + \ldots + r_i(L_{sub}-1)^2}{L_{sub}}$$

is the energy of the i-th sub-frame of the LPC residual and $e_i$ (dB)=10 $\log_{10}\{e_i\}$. A constant 1 is added to the actual sub-frame energy in the above equation to avoid the subsequent computation of the logarithmic value of 0.

A mean value of parameter $\mu_{ener}$ is then updated as follows:

$$\mu_{ener}\ (\text{dB}) := \mu_{ener}\ (\text{dB}) - 5*(\rho_1+\rho_2)$$

where $\rho_i$ (i=1 or 2) is the normalized correlation computed as a side product of the i-th open-loop pitch analysis. This modification of $\mu_{ener}$ improves the audio quality for voiced speech segments.

The mean $\mu_{ener}$ (dB) is then scalar quantized with 2 bits. The quantization levels are set with a step of 12 dB to 18, 30, 42 and 54 dB. The quantization index can be simply computed as:

$$tmp=(\mu_{ener}-18)/12$$

$$\text{index}=\text{floor}(tmp+0.5)$$

$$\text{if (index<0) index=0, if (index>3) index=3}$$

Here, floor means taking the integer part of the a floating-point number. For example floor(1.2)=1, and floor(7.9)=7. The reconstructed mean (in dB) is therefore:

$$\hat{\mu}_{ener}\ (\text{dB})=18+(\text{index}*12).$$

However, the index and the reconstructed mean are then updated to improve the audio quality for transient signals such as attacks as follows:

$$\max=\max(e_1\ (\text{dB}), e_2\ (\text{dB}), e_3\ (\text{dB}), e_4\ (\text{dB}))$$

$$\text{if } \hat{\mu}_{ener}\ (\text{dB})<(\max-27) \text{ and index}<3,$$

$$\text{index}=\text{index}+1 \text{ and } \hat{\mu}_{ener}\ (\text{dB})=\hat{\mu}_{ener}\ (\text{dB})+1$$

Quantization of the Codebook Gains

In AMR-WB, the pitch and fixed-codebook gains $g_p$ and $g_c$ are quantized jointly in the form of ($g_p$, $g_c*g_{c0}$) where $g_{c0}$ combines a MA prediction for $g_c$ and a normalization with respect to the energy of the innovative codevector.

The two gains $g_p$ and $g_c$ in a given sub-frame are jointly quantized with 7 bits exactly as in AMR-WB speech coding, in the form of ($g_p$, $g_c*g_{c0}$). The only difference lies in the computation of $g_{c0}$. The value of $g_{c0}$ is based on the quantized mean energy a $\mu_{ener}$ only, and computed as follows:

$$g_{c0}=10*((\hat{\mu}_{ener}\ (\text{dB})-\text{ener}_c\ (\text{dB}))/20)$$

where $$\text{ener}_c\ (\text{dB})=10*\log 10(0.01+(c(0)*2+\ldots+c(L_{sub}-1)*2)/L_{sub})$$

where $c(0), \ldots, c(L_{sub}-1)$ are samples of the LP residual vector in a subframe of length $L_{sub}$ samples, c(0) is the first sample, c(1) is the second sample, . . . , and $c(L_{sub})$ is the last LP residual sample in a subframe.

TCX Mode

In the TCX modes (TCX coder 18.016), an overlap with the next frame is defined to reduce blocking artifacts due to transform coding of the TCX target signal. The windowing and signal overlap depends both on the present frame type (ACELP or TCX) and size, and on the past frame type and size. Windowing will be disclosed in the next section.

Figure 5A:
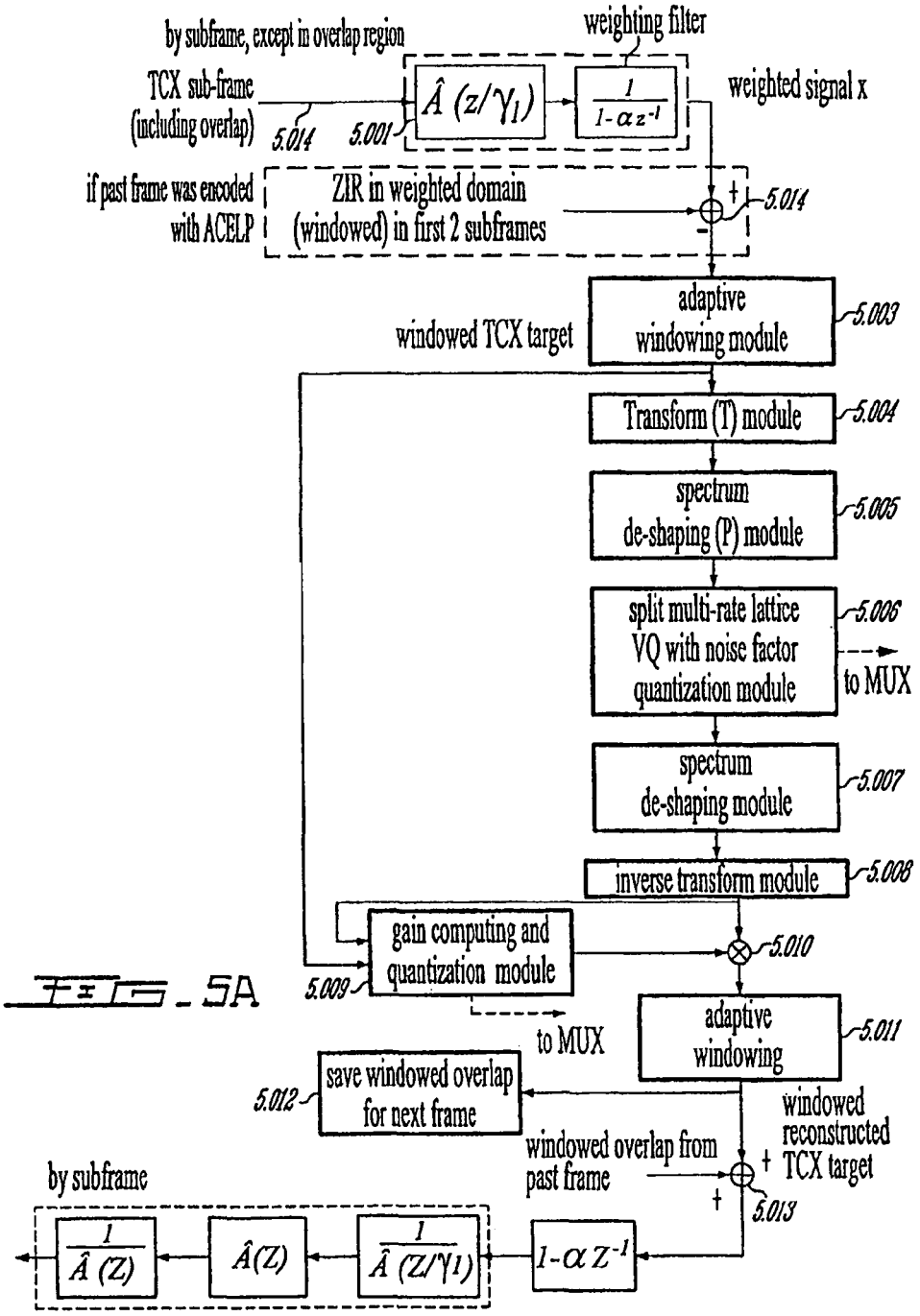
FIG. 5*a* is a high-level block diagram illustrating one embodiment of the the structure and method implemented by the coder according to the present invention, for TCX frames.

One embodiment of the TCX coder 18.016 is illustrated in FIG. 5*a*. The TCX encoding procedure will now be described and, then, description about the lattice quantization used to quantize the spectrum will follow.

TCX encoding according to one embodiment proceeds as follows.

First, as illustrated in FIG. 5*a*, the input signal (TCX frame) is filtered through a perceptual weighting filter 5.001 to produce a weighted signal. In TCX modes, the perceptual weighting filter 5.001 uses the quantized LPC coefficients $\hat{A}(z)$ instead of the unquantized LPC coefficients A(z) used in ACELP mode. This is because, contrary to ACELP which uses analysis-by-synthesis, the TCX decoder has to apply an inverse weighting filter to recover the excitation signal. If the previous coded frame was an ACELP frame, then the zero-input response (ZIR) of the perceptual weighting filter is removed from the weighted signal by means of an adder 5.014. In one embodiment, the ZIR is truncated to 10 ms and windowed in such a way that its amplitude monotonically decreases to zero after 10 ms (calculator 5.100). Several time-domain windows can be used for this operation. The actual computation of the ZIR is not shown in FIG. 5*a* since this signal, also referred to as the "filter ringing" in CELP-type coders, is well known to those of ordinary skill in the art. Once the weighted signal is computed, the signal is windowed in adaptive window generator 5.003, according to a window selection described in FIGS. 4*a*-4*c*.

After windowing by the generator 5.003, a transform module 5.004 transforms the windowed signal into the frequency-domain using a Fast Fourier Transform (FFT).

Windowing in the TCX Modes—Adaptive windowing Module 5.003

Figure 4A:
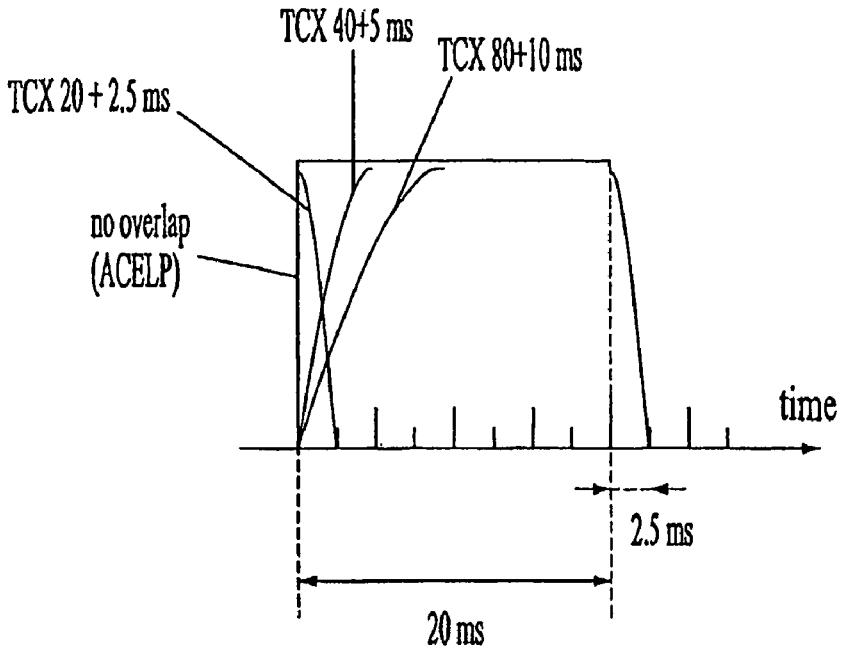
FIG. 4*a*-4*c* are charts illustrating a non-limitative example of frame windowing in an ACELP/TCX coder, depending on the current frame mode and length, and the past frame mode.
Figure 4B:
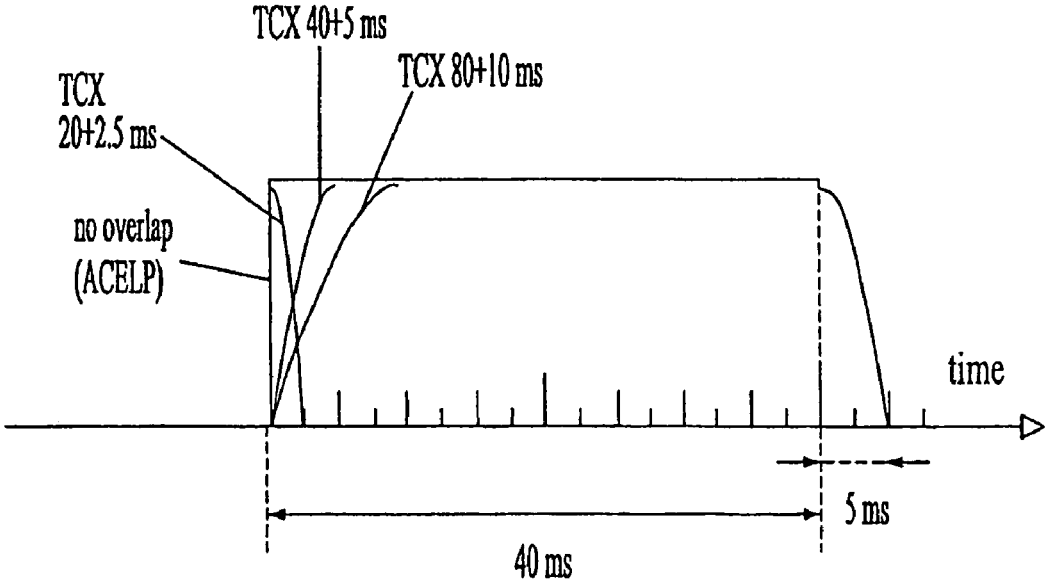
Figure 4C:
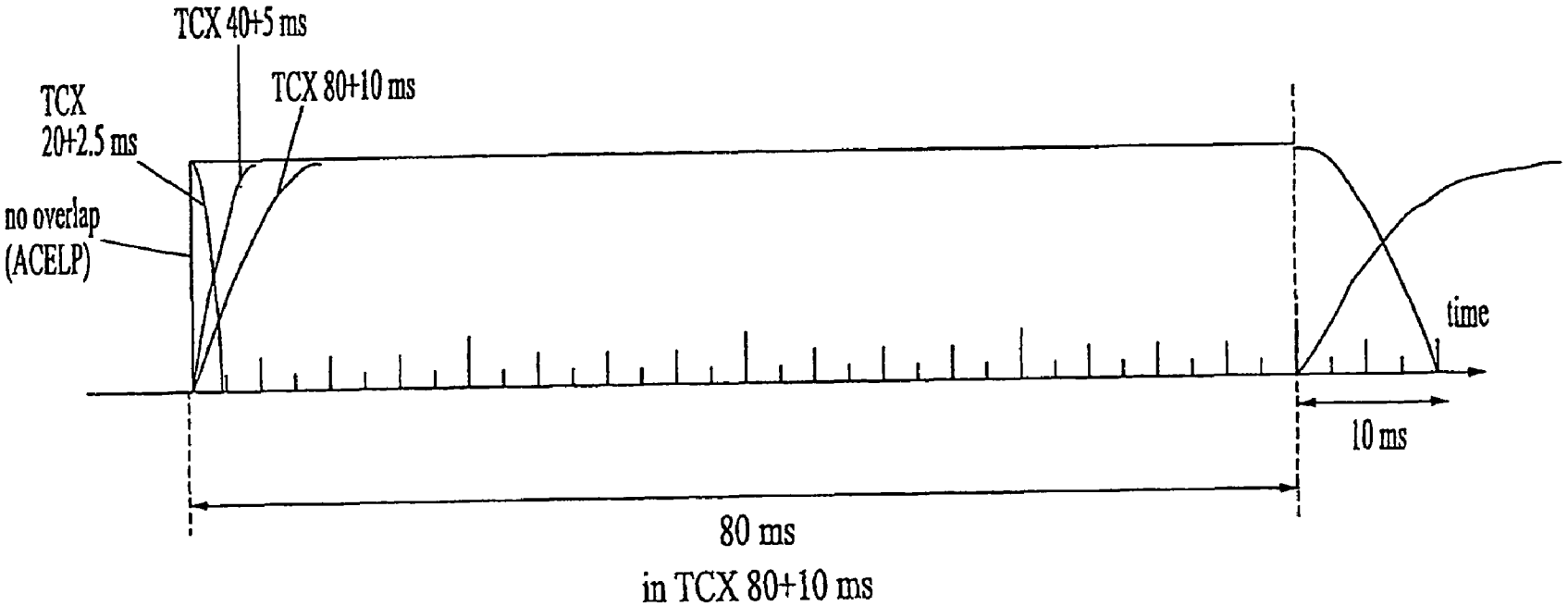

Mode switching between ACELP frames and TCX frames will now be described. To minimize transition artifacts upon switching from one mode to the other, proper care has to be given to windowing and overlap of successive frames. Adaptive windowing is performed by Processor 6.003. FIGS. 4*a*-4*c* show the window shapes depending on the TCX frame length and the type of the previous frame (ACELP of TCX).

In FIG. 4*a*, the case where the present frame is a TCX20 frame is considered. Depending on the past frame, the window applied can be:

1) If the previous frame was a 20-ms ACELP, the window is a concatenation of two window segments: a flat window of 20-ms duration followed by the half-right portion of the square-root of a Hanning window (or the half-right portion of a sine window) of 2.5-ms duration. The coder then needs a lookahead of 2.5 ms of the weighted speech.
2) If the previous frame was a TCX20 frame, the window is a concatenation of three window segments: first, the left-half of the square-root of a Hanning window (or the left-half portion of a sine window) of 2.5-ms duration, then a flat window of 17.5-ms duration, and finally the half-right portion of the square-root of a Hanning window (or the half-right portion of a sine window) of 2.5-ms duration. The coder again needs a lookahead of 2.5 ms of the weighted speech.
3) If the previous frame was a TCX40 frame, the window is a concatenation of three window segments: first, the left-half of the square-root of a Hanning window (or the left-half portion of a sine window) of 5-ms duration, then a flat window of 15-ms duration, and finally the half-right portion of the square-root of a Hanning window (or the half-right portion of a sine window) of 2.5-ms duration. The coder again heeds a lookahead of 2.5 ms of the weighted speech.
4) If the previous frame was a TCX80 frame, the window is a concatenation of three window segments: first, the left-half of the square-root of a Hanning window (or the left-half portion of a sine window) of 10 ms duration, then a flat window of 10-ms duration, and finally the half-right portion of the square-root of a Hanning window (or the half-right portion of a sine window) of 2.5-ms duration. The coder again needs a lookahead of 2.5 ms of the weighted speech.

In FIG. 4*b*, the case where the present frame is a TCX40 frame is considered. Depending on the past frame, the window applied can be:

1) If the previous frame was a 20-ms ACELP frame, the window is a concatenation of two window segments: a flat window of 40-ms duration followed by the half-right portion of the square-root of a Hanning window (or the half-right portion of a sine window) of 5-ms duration. The coder then needs a lookahead of 5 ms of the weighted speech.
2) If the previous frame was a TCX20 frame, the window is a concatenation of three window segments: first, the left-half of the square-root of a Hanning window (or the left-half portion of a sine window) of 2.5-ms duration, then a flat window of 37.5-ms duration, and finally the half-right portion of the square-root of a Hanning window (or the half-right portion of a sine window) of 5-ms duration. The coder again needs a lookahead of 5 ms of the weighted speech.
3) If the previous frame was a TCX40 frame, the window is a concatenation of three window segments: first, the left-half of the square-root of a Hanning window (or the left-half portion of a sine window) of 5-ms duration, then a flat window of 35-ms duration, and finally the half-right portion of the square-root of a Hanning window (or the half-right portion of a sine window) of 5-ms duration. The coder again needs a lookahead of 5 ms of the weighted speech.
4) If the previous frame was a TCX80 frame, the window is a concatenation of three window segments: first, the left-half of the square-root of the square-root of a Hanning window (or the left-half portion of a sine window) of 10-ms duration, then a flat window of 30-ms duration, and finally the half-right portion of the square-root of a Hanning window (or the half-right portion of a sine window) of 5-ms duration. The coder again needs a lookahead of 5 ms of the weighted speech.

Finally, in FIG. 4*c*, the case where the present frame is a TCX80 frame is considered. Depending on the past frame, the window applied can be:

1) If the previous frame was a 20-ms ACELP frame, the window is a concatenation of two window segments: a flat window of 80-ms duration followed by the half-right portion of the square-root of a Hanning window (or the half-right portion of a sine window) of 5-ms duration. The coder then needs a lookahead of 10 ms of the weighted speech.
2) If the previous frame was a TCX20 frame, the window is a concatenation of three window segments: first, the left-half of the square-root of a Hanning window (or the left-half portion of a sine window) of 2.5-ms duration, then a flat window of 77.5-ms duration, and finally the half-right portion of the square-root of a Hanning window (or the half-right portion of a sine window) of 10-ms duration. The coder again needs a lookahead of 10 ms of the weighted speech.
3) If the previous frame was a TCX40 frame, the window is a concatenation of three window segments: first, the left-half of the square-root of a Hanning window (or the left-half portion of a sine window) of 5-ms duration, then a flat window of 75-ms duration, and finally the half-right portion of the square-root of a Hanning window (or the half-right portion of a sine window) of 10-ms duration. The coder again needs a lookahead of 10 ms of the weighted speech.
4) If the previous frame was a TCX80 frame, the window is a concatenation of three window segments: first, the left-half of the square-root of a Hanning window (or the left-half portion of a sine window) of 10-ms duration, then a flat window of 70-ms duration, and finally the half-right portion of the square-root of a Hanning window (or the half-right portion of a sine window) of 10-ms duration. The coder again needs a lookahead of 10 ms of the weighted speech.

It is noted that all these window types are applied to the weighted signal, only when the present frame is a TCX frame. Frames of ACELP type are encoded substantially in accordance with AMR-WB coding, i.e. through analysis-by-synthesis coding of the excitation signal, so as to minimize the error in the target signal wherein the target signal is essentially the weighted signal to which the zero-input response of the weighting filter is removed. It is also noted that, upon coding a TCX frame that is preceded by another TCX frame, the signal windowed by means of the above-described windows is quantized directly in a transform domain, as will be disclosed herein below. Then after quantization and inverse transformation, the synthesized weighted signal is recombined using overlap-and-add at the beginning of the frame with memorized look-ahead of the preceding frame.

On the other hand, when encoding a TCX frame preceded by an ACELP frame, the zero-input response of the weighting filter, actually a windowed and truncated version of the zero-input response, is first removed from the windowed weighted signal. Since the zero-input response is a good approximation of the first samples of the frame, the resulting effect is that the windowed signal will tend towards zero both at the beginning of the frame (because of the zero-input response subtraction) and at the end of the frame (because of the half-Hanning window applied to the look-ahead as described above and shown in FIGS. 4*a*-4*c*). Of course, the windowed and truncated zero-input response is added back to the quantized weighted signal after inverse transformation.

Hence, a suitable compromise is achieved between an optimal window (e.g. Hanning window) prior to the transform used in TCX frames, and the implicit rectangular window that has to be applied to the target signal when encoding in ACELP mode. This ensures a smooth switching between ACELP and TCX frames, while allowing proper windowing in both modes.

Time Frequency Mapping—Transform Module 5.004

After windowing as described above, a transform is applied to the weighted signal in transform module 5.004. In the example of FIG. 5*a*, a Fast Fourier Transform (FFT) is used.

As illustrated In FIGS. 4*a*-4*c*, TCX mode uses overlap between successive frames to reduce blocking artifacts. The length of the overlap depends on the length of the TCX modes: it is set respectively to 2.5, 5 and 10 ms when the TCX mode works with a frame length of 20, 40 and 80 ms, respectively (i.e. the length of the overlap is set to $1/8^{th}$ of the frame length). This choice of overlap simplifies the radix in the fast computation of the DFT by the FFT. As a consequence the effective time support of the TCX20, TCX40 and TCX80 modes is 22.5, 45 and 90 ms, respectively, as shown in FIG. 2. With a sampling frequency of 12,800 samples per second (in the LF signal produced by pre-processor and analysis filterbank 1.001 of FIG. 1), and with frame+lookahead durations of 22.5, 45 and 90 ms, the time support of the FFT becomes 288, 576 and 1152 samples, respectively. These lengths can be expressed as 9 times 32, 9 times 64 and 9 times 128. Hence, a specialized radix-9 FFT can then be used to compute rapidly the Fourier spectrum.

Pre-Shaping (Low-Frequency Emphasis)—Pre-Shaping Module 5.005.

Once the Fourier spectrum (FFT) is computed, an adaptive low-frequency emphasis is applied to the signal spectrum by the spectrum pre-shaping module 5.005 to minimize the perceived distortion in the lower frequencies. An inverse low-frequency emphasis will be applied at the decoder, as well as in the coder through a spectrum de-shaping module 5.007 to produce the excitation signal used to encode the next frames. The adaptive low-frequency emphasis is applied only to the first quarter of the spectrum, as follows.

Figure 20:
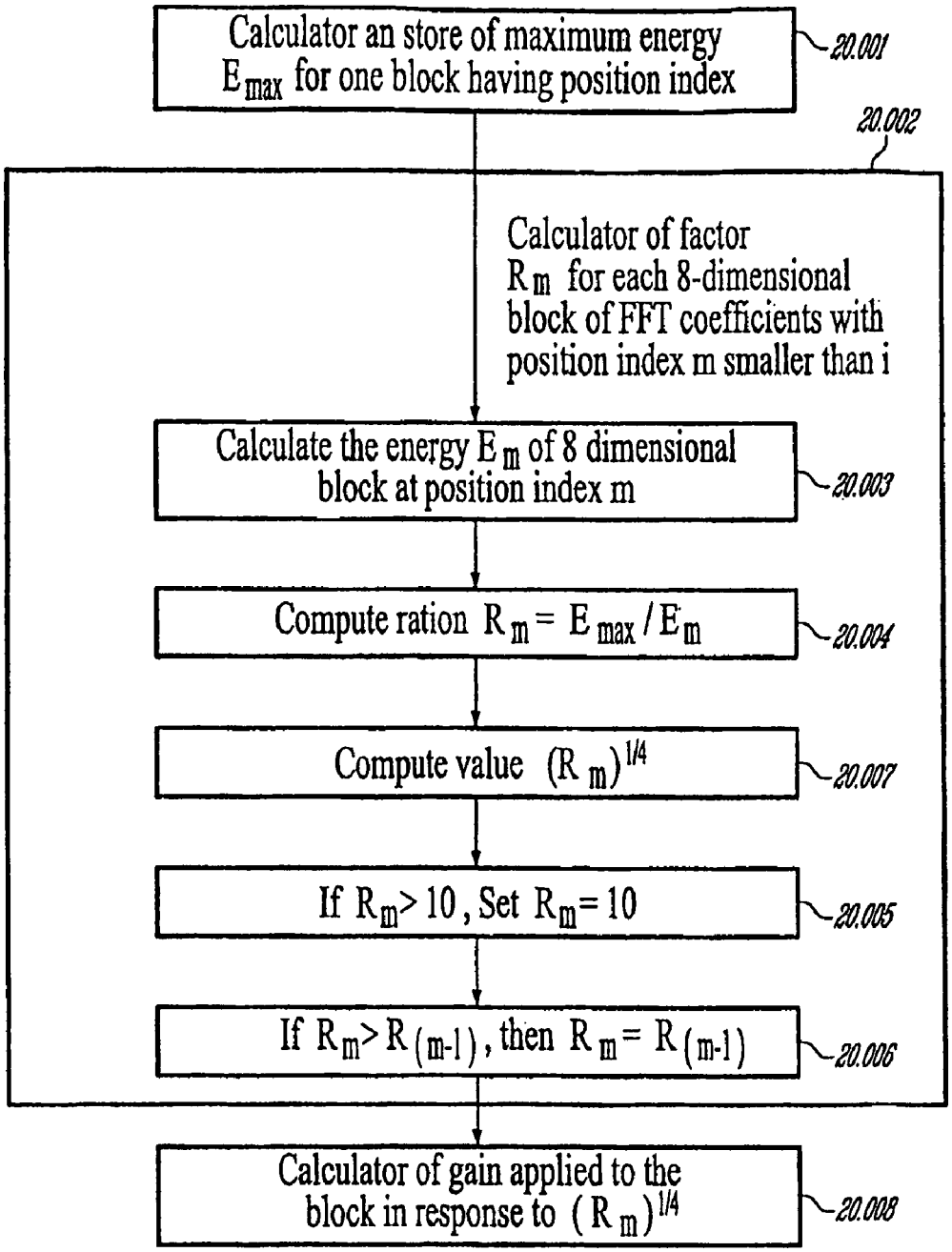
FIG. 20 is a schematic flow chart describing the operation of the spectrum pre-shaping module of the coder of FIG. 5*a*.

First, let's call X the transformed signal at the output of the FFT transform module 5.004. The Fourier coefficient at the Nyquist frequency is systematically set to 0. Then, if N is the number of samples in the FFT (N thus corresponding to the length of the window), the K=N/2 complex-value Fourier coefficients are grouped in blocks of four (4) consecutive coefficients, forming 8-dimensional real-value blocks. Just a word to mention that block lengths of size different from 8 can be used in general. In one embodiment, a block size of 8 is chosen to coincide with the 8-dimensional lattice quantizer used for spectral quantization. Referring to FIG. 20, the energy of each block is computed, up to the first quarter of the spectrum, and the energy $E_{max}$ and the position index i of the block with maximum energy are stored (calculator 20.001). Then a factor $R_m$ is calculated for each 8-dimensional block with position index m smaller than i (calculator 20.002) as follows:

calculate the energy $E_m$ of the 8-dimensional block at position index m (module 20.003);

compute the ratio $R_m=E_{max}/E_m$ (module 20.004);

if $R_m>10$, then set $R_m=10$ (module 20.005);

also, if $R_m>R_{(m-1)}$ then $R_m=R_{(m-1)}$ (module 20.006);

compute the value $(R_m)^{1/4}$ (module 20.007).

The last condition (if $R_m>R_{(m-1)}$ then $R_m=R_{(m-1)}$) ensures that the ratio function $R_m$ decreases monotonically. Further, limiting the ratio $R_m$ to be smaller or equal to 10 means that no spectral components in the low-frequency emphasis function will be modified by more than 20 dB.

After computing the ratio $(R_m)^{1/4}=(E_{max}/E_m)^{1/4}$ for all blocks with position index smaller that i (and with the limiting conditions described above), these ratios are applied as a gain for the transform coefficients each corresponding block (calculator 20.008). This has the effect of increasing the energy of the blocks with a relatively low energy compared to the block with maximum energy $E_{max}$. Applying this procedure prior to quantization has the effect of shaping the coding noise in the lower band.

Figure 5B:
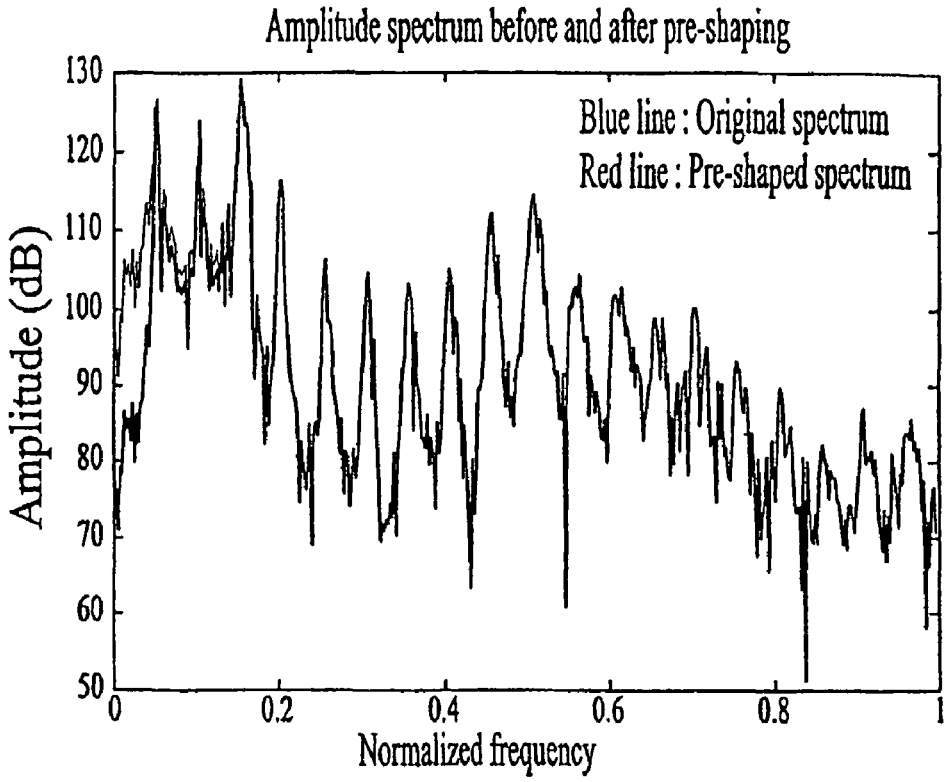
FIG. 5*b* is a graph illustrating a non-limitative example of amplitude spectrum before and after spectrum pre-shaping performed by the coder of FIG. 5*a;*
Figure 5C:
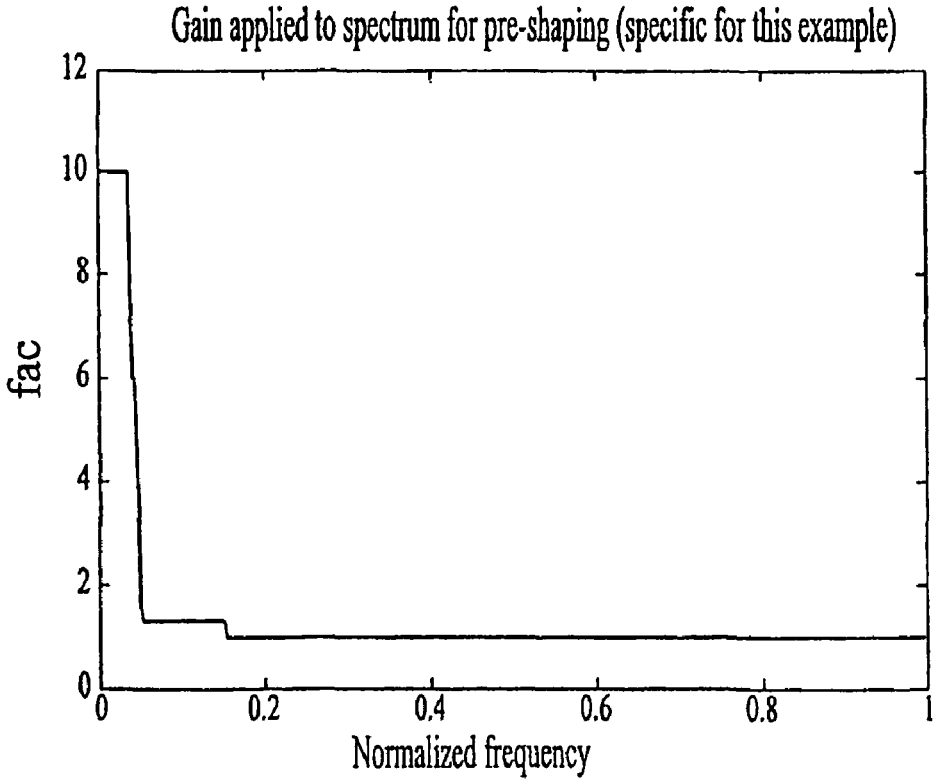
FIG. 5*c* is a graph illustrating a non-limitative example of weighting function determining the gain applied to the spectrum during spectrum pre-shaping.

FIG. 5*b* shows an example spectrum on which the above disclosed pre-shaping is applied. The frequency axis is normalized between 0 and 1, where 1 is the Nyquist frequency. The amplitude spectrum is shown in dB. In FIG. 5*b*, the bold line is the amplitude spectrum before pre-shaping, and the non-bold line portion is the modified (pre-shaped) spectrum. Hence, only the spectrum corresponding to the non-bold line is modified in this example. In FIG. 5*c*, the actual gain applied to each spectral component by the pre-shaping function is shown. It can be seen from FIG. 5*c* that the gain is limited to 10, and monotonically decreases to 1 as it reaches the spectral component with highest energy (here, the third harmonic of the spectrum) at the normalized frequency of about 0.18.

Split Multi-Rate Lattice Vector Quantization—Module 5.006

After low-frequency emphasis, the spectral coefficients are quantized using, in one embodiment, an algebraic quantization module 5.006 based on lattice codes. The lattices used are 8-dimensional Gosset lattices, which explains the splitting of the spectral coefficients in 8-dimensional blocks. The quantization indices are essentially a global gain and a series of indices describing the actual lattice points used to quantize each 8-dimensional sub-vector in the spectrum. The lattice quantization module 5.006 performs, in a structured manner, a nearest neighbor search between each 8-dimensional vector of the scaled pre-shaped spectrum from module 5.005 and the points in a lattice codebook used for quantization. The scale factor (global gain) actually determines the bit allocation and the average distortion. The larger the global gain, the more bits are used and the lower the average distortion. For each 8-dimensional vector of spectral coefficients, the lattice quantization module 5.006 outputs an index which indicates the lattice codebook number used and the actual lattice point chosen in the corresponding lattice codebook. The decoder will then be able to reconstruct the quantized spectrum using the global gain index along with the indices describing each 8-dimensional vector. The details of this procedure will be disclosed below.

Once the spectrum is quantized, the global gain from the output of the gain computing and quantization module 5.009 and the lattice vectors indices from the output of quantization module 5.006) can be transmitted to the decoder through a multiplexer (not shown).

Optimization of the Global Gain and Computation of the Noise-Fill Factor

A non-trivial step in using lattice vector quantizers is to determine the proper bit allocation within a predetermined bit budget. Contrary to stored codebooks, where the index of a codebook is basically its position in a table, the index of a lattice codebook is calculated using mathematical (algebraic) formulae. The number of bits to encode the lattice vector index is thus only known after the input vector is quantized. In principle, to stay within a pre-determined bit budget, trying several global gains and quantizing the normalized spectrum with each different gain to compute the total number of bits are performed. The global gain which achieves the bit allocation closest to the pre-determined bit budget, without exceeding it, would be chosen as the optimal gain. In one embodiment, a heuristic approach is used instead, to avoid having to quantize the spectrum several times before obtaining the optimum quantization and bit allocation.

For the sake of clarity, the key symbols related to the following description are gathered from Table A-1.

Referring from FIG. 5*a*, the time-domain TCX weighted signal x is processed by a transform T and a pre-shaping P, which produces a spectrum X to be quantized. Transform T can be a FFT and the pre-shaping may correspond to the above-described adaptive low-frequency emphasis.

Reference will be made to vector X as the pre-shaped spectrum. It is assumed that this vector has the form $X=[X_0\ X_1 \ldots X_{N-1}]^T$, where N is the number of transform coefficients obtained from transform T (the pre-shaping P does not change this number of coefficients).

Overview of the Quantization Procedure for the Pre-Shaped Spectrum

In one embodiment, the pre-shaped spectrum X is quantized as described in FIG. 6. The quantization is based on the device of [Ragot, 2002], assuming an available bit budget of $R_X$ bits for encoding X. As shown in FIG. 6, X is quantized by gain-shape split vector quantization in three main steps:

- An estimated global gain g, called hereafter the global gain, is computed by a split energy estimation module 6.001 and a global gain and noise level estimation module 6.002, and a divider 6.003 normalizes the spectrum X by this global gain g to obtain X'=X/g, where X' is the normalized pre-shaped spectrum.
- The multi-rate lattice vector quantization of [Ragot, 2002] is applied by a split self-scalable multirate $RE_8$ coding module 6.004 to all 8-dimensional blocks of coefficients forming the spectrum X', and the resulting parameters are multiplexed. To be able to apply this quantization scheme, the spectrum X' is divided into K sub-vectors of identical size, so that $X=[X'_0{}^T\ X'_1{}^T \ldots X'_{K-1}{}^T]^T$, where the $K^{th}$ sub-vector (or split) is given by $$X'_k=[x'_{8k} \ldots x'_{8k+K-1}], k=0,1, \ldots, K-1.$$

Since the device of [Ragot, 2002] actually implements a form of 8-dimensional vector quantization, K is simply set to 8. It is assumed that N is a multiple of K.
- A noise fill-in gain fac is computed in module 6.002 to later inject comfort noise in unquantized splits of the spectrum X'. The unquantized splits are blocks of coefficients which have been set to zero by the quantizer. The injection of noise allows to mask artifacts at low bit rates and improves audio quality. A single gain fac is used because TCX coding assumes that the coding noise is flat in the target domain and shaped by the inverse perceptual filter $W(z)^{-1}$. Although pre-shaping is used here, the quantization and noise injection relies on the same principle.

As a consequence, the quantization of the spectrum X shown in FIG. 6 produces three kinds of parameters, the global gain g, the (split) algebraic VQ parameters and the noise fill-in gain fac. The bit allocation, or bit budget $R_X$ is decomposed as:

$$R_X=R_g+R+R_{fac},$$

where $R_g$, R and $R_{fac}$ are the number of bits (or bit budget) allocated to the gain g, the algebraic VQ parameters, and the gain fac, respectively. In this illustrative embodiment, $R_{fac}=0$.

The multi-rate lattice vector quantization of [Ragot, 2002] is self-scalable and does not allow to control directly the bit allocation and the distortion in each split. This is the reason why the device of [Ragot, 2002] is applied to the splits of the spectrum X' instead of X. Optimization of the global gain g therefore controls the quality of the TCX mode. In one embodiment, the optimization of the gain g is based on log-energy of the splits.

In the following description, each block of FIG. 6 is described one by one.

Split Energy Estimation Module 6.001

The energy (i.e. square-norm) of the split vectors is used in the bit allocation algorithm, and is employed for determining the global gain as well as the noise level. Just a word to recall that the N-dimensional input vector $X=[x_0, x_1 \ldots x_{N-1}]^T$ is partitioned into K splits, 8-dimensional subvectors, such that the $k^{th}$ split becomes $x_k=[x_{8k}\ x_{8k+1} \ldots x_{8k+7}]^T$ for k=0, 1, . . . , K−1. It is assumed that N is a multiple of eight. The energy of the $k^{th}$ split vector is computed as $$e_k=x_k^T x_k=x_{8k}^2+ \ldots +x_{8k+7}^2, k=0,1, \ldots K-1$$

Global Gain and Noise Level Estimation Module 6.002

The global gain g controls directly the bit consumption of the splits and is solved from R(g)≈R, where R(g) is the number of bits used (or bit consumption) by all the split algebraic VQ for a given value of g. As indicated in the foregoing description, R is the bit budget allocated to the split algebraic VQ. As a consequence, the global gain g is optimized so as to match the bit consumption and the bit budget of algebraic VQ. The underlying principle is known as reverse water-filling in the literature.

To reduce the quantization complexity, the actual bit consumption for each split is not computed, but only estimated from the energy of the splits. This energy information together with an a prior knowledge of multi-rate $RE_8$ vector quantization allows to estimate R(g) as a simple function of g.

The global gain g is determined by applying this basic principle in the global gains and noise level estimation module 6.002. The bit consumption estimate of the split $X_k$ is a function of the global gain g, and is denoted as $R_k(g)$. With unity gain g=1 heuristics give:

$$R_k(1)=5 \log_2(\epsilon+e_k)/2, k=0,1, \ldots, K-1$$

as a bit consumption estimate. The constant $\epsilon>0$ prevents the computation of $\log_2 0$ and, for example, the value $\epsilon=2$ is used. In general the constant $\epsilon$ is negligible compared to the energy of the split $e_k$.

The formula of $R_k(1)$ is based on a priori knowledge of the multi-rate quantizer of [Ragot, 2002] and the properties of the underlying $RE_8$ lattice:

- For the codebook number $n_k>1$, the bit budget requirement for coding the $k^{th}$ split at most $5n_k$ bits as can be confirmed from Table 1. This gives a factor 5 in the formula when $\log_2(\epsilon+e_k)/2$ is as an estimate of the codebook number.
- The logarithm $\log_2$ reflects the property that the average square-norm of the codevectors is approximately doubled when using $Q_{nk}$ instead of $Q_{nk+1}$. The property can be observed from Table 4.
- The factor ½ applied to $\epsilon+e_k$ calibrates the codebook number estimate for the codebook $Q_2$. The average square-norm of lattice points in this particular codebook is known to be around 8.0 (see Table 4). Since $\log_2(\epsilon+e_2))/2\approx\log_2(2+8.0))/2\approx2$, the codebook number estimation is indeed correct for $Q_2$.

TABLE 4

Some statistics on the square norms of the lattice points in different codebooks.

| n | Average Norm |
|---|---|
| 0 | 0 |
| 2 | 8.50 |
| 3 | 20.09 |
| 4 | 42.23 |
| 5 | 93.85 |
| 6 | 182.49 |
| 7 | 362.74 |

When a global gain g is applied to a split, the energy of $x_k/g$ is obtained by dividing $e_k$ by $g^2$. This implies that bit consumption of the gain-scaled split can be estimated based on $R_k(1)$ by subtracting $5\log_2 g^2=10\log_2 g$ from it:

$$\begin{aligned} R_k(g) &= 5\log_2(\varepsilon+e_k)/2g^2 \\ &= 5\log_2(\varepsilon+e_k)/2+5\log_2 g^2 \\ &= R_k(1)-g_{log} \end{aligned} \tag{4}$$

in which $g_{log}=10\log_2 g$. The estimate $R_k(g)$ is lower bounded to zero, thus the relation $$R_k(g)=\max\{R_k(1)-g_{log},0\} \tag{5}$$

is used in practice.

The bit consumption for coding all K splits is now simply a sum over the individual splits, $$R(g)=R_0(g)+R_1(g)+\ldots+R_{K-1}(g). \tag{6}$$

The nonlinearity of equation (6) prevents solving analytically the global gain g that yields the bit consumption matching the given bit budget, R(g)=R. However, the solution can be found with a simple iterative algorithm because R(g) is a monotonous function of g.

In one embodiment, the global gain g Is searched efficiently by applying a bisection search to $g_{log}=10\log_2 g$, starting from the value $g_{log}=128$. At each iteration iter, R(g) is evaluated using equations (4), (5) and (6), and $g_{log}$ is respectively adjusted as $g_{log}=g_{log}\pm128/2^{iter}$. Ten iterations give a sufficient accuracy. The global gain can then be solved from $g_{log}$ as $g=2^{g_{log}/10}$.

Figure 7:
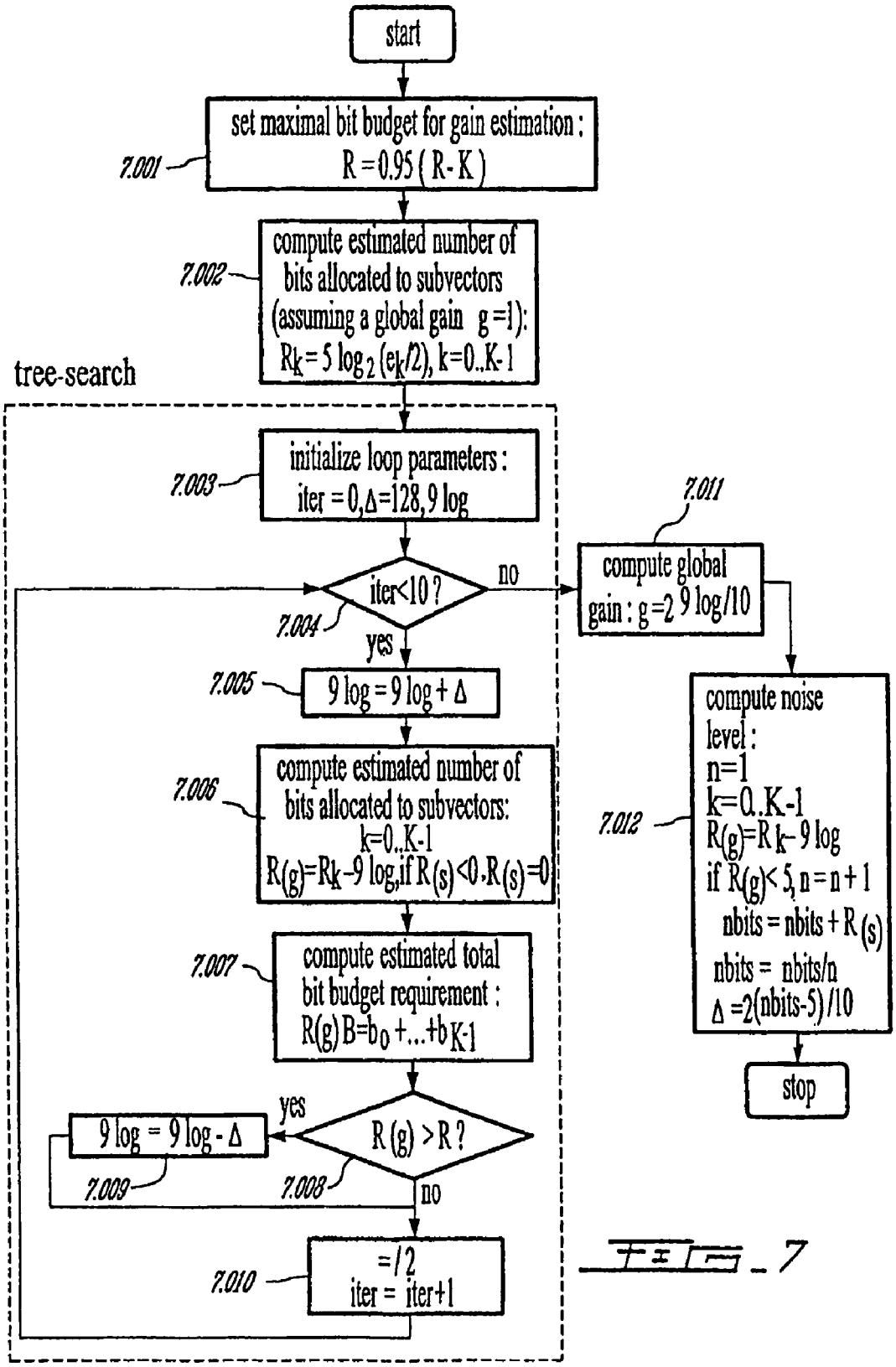
FIG. 7 is a flow chart describing a non-limitative example of iterative global gain estimation procedure in log-domain for a TCX coder, this global estimation procedure being a step implemented in TCX coding using a lattice quantizer, to reduce the complexity while remaining within the bit budget for a given frame.

The flow chart of FIG. 7 describes the bisection algorithm employed for determining the global gain g. The algorithm provides also the noise level as a side product. The algorithm starts by adjusting the bit budget R in operation 7.001 to the value 0.95(R−K). This adjustment has been determined experimentally in order to avoid an over-estimation of the optimal global gain g. The bisection algorithm requires as its initial value the bit consumption estimates $R_k(1)$ for k=0, 1, . . . , K−1 assuming a unity global gain. These estimates are computed employing equation (4) in operation 7.002 having first obtained the square-norms of the splits $e_k$. The algorithm starts from the initial values iter=0, $g_{log}=0$, and $fac=128/2^{iter}=128$ set in operation 7.004.

If iter<10 (operation 7.004), each iteration in the bisection algorithm comprises an increment $g_{log}=g_{log}+fac$ in operation 7.005, and the evaluation of the bit consumption estimate R(g) in operations 7.006 and 7.007 with the new value of $g_{log}$. If the estimate R(g) exceeds the bit budget R in operation 7.008, $g_{log}$ is updated in operation 7.009. The iteration ends by incrementing the counter iter and halving the step size fac in operation 7.010. After ten iterations, a sufficient accuracy for $g_{log}$ is obtained and the global gain can be solved $g=2^{g_{log}/10}$ in operation 7.011. The noise level $g_{ns}$ is estimated in operation 7.012 by averaging the bit consumption estimates of those splits that are likely to be left unquantized with the determined global gain $g_{log}$.

Figure 8:
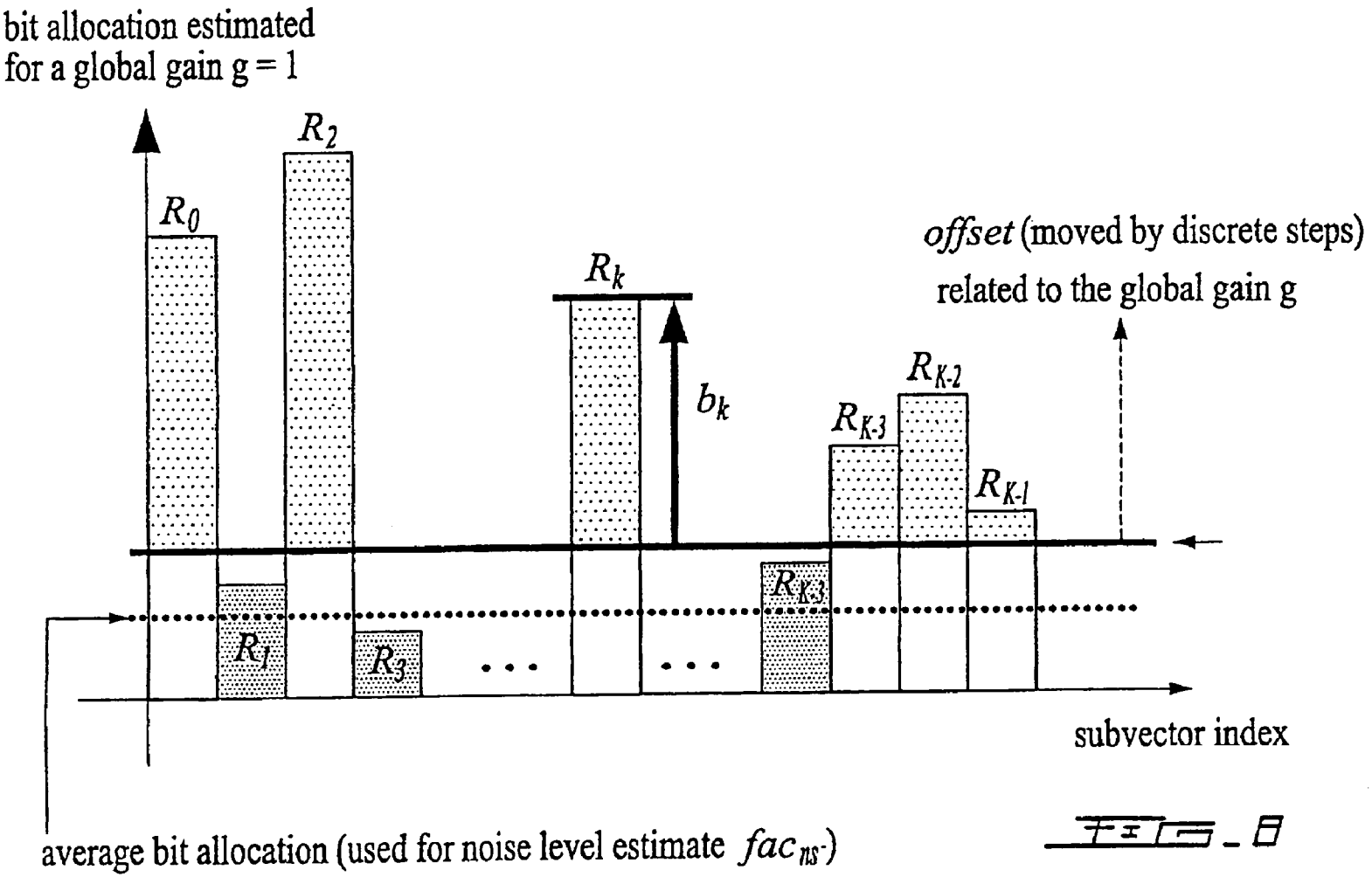
FIG. 8 is a graph illustrating a non-limitative example of global gain estimation and noise level estimation (reverse waterfilling) in TCX frames.

FIG. 8 shows the operations involved in determining the noise level fac. The noise level is computed as the square root of the average energy of the splits that are likely to be left unquantized. For a given global gain $g_{log}$, a split is likely to be unquantized if its estimated bit consumption is less than 5 bits, i.e. if $R_k(1)-g_{log}<5$. The total bit consumption of all such splits, $R_{ns}(g)$, is obtained by calculating $R_k(1)-g_{log}$ over the splits for which $R_k(1)-g_{log}<5$. The average energy of these splits can then be computed in log domain from $R_{ns}(g)$ as $R_{ns}(g)/nb$, where nb is the number of these splits. The noise level is $$fac=2^{Rns(g)/nb-5}$$

In this equation, the constant −5 in the exponent is a tuning factor which adjusts the noise factor 3 dB (in energy) below the real estimation based on the average energy.

Multi-Rate Lattice Vector Quantization Module 5.004

Quantization module 6.004 is the multi-rate quantization means disclosed and explained in [Ragot, 2002]. The 8-dimensional splits of the normalized spectrum X' are coded using multi-rate quantization that employs a set of $RE_8$ codebooks denoted as $\{Q_0, Q_2, Q_3, \ldots\}$. The codebook $Q_1$ is not defined in the set in order to improve coding efficiency. The $n^{th}$ codebook is denoted $Q_n$ where n is referred to as a codebook number. All codebooks $Q_n$ are constructed as subsets of the same 8-dimensional $RE_8$ lattice, $Q_n\subset RE_8$. The bit rate of the $n^{th}$ codebook defined as bits per dimension is 4n/8, i.e. each codebook $Q_n$ contains $2^{4n}$ codevectors. The multi-rate quantizer is constructed in accordance with the teaching of [Ragot, 2002].

For the $k^{th}$ 8-dimensional split $X'_k$, the coding module 6.004 finds the nearest neighbor $Y_k$ in the $RE_8$ lattice, and outputs:

the smallest codebook number $n_k$ such that $Y_k\epsilon Q_{nk}$; and the index $i_k$ of $Y_k$ in $Q_{nk}$.

The codebook number $n_k$ is a side information that has to be made available to the decoder together with the index $i_k$ to reconstruct the codevector $Y_k$. For example, the size of index $i_k$ is $4n_k$ bits for $n_k>1$. This Index can be represented with 4-bit blocks.

For $n_k=0$, the reconstruction $y_k$ becomes an 8-dimensional zero vector and $i_k$ is not needed.

Handling of Bit Budget Overflow and Indexing of Splits Module 6.005

For a given global gain g, the real bit consumption may either exceed or remain under the bit budget. A possible bit budget underflow is not addressed by any specific means, but the available extra bits are zeroed and left unused. When a bit budget overflow occurs, the bit consumption is accommodated into the bit budget $R_X$ in module 6.005 by zeroing some of the codebook numbers $n_0, n_1, \ldots, n_{K-1}$. Zeroing a codebook number $n_k>0$ reduces the total bit consumption at least by $5n_K-1$ bits. The splits zeroed in the handling of the bit budget overflow are reconstructed at the decoder by noise fill-in.

To minimize the coding distortion that occurs when the codebook numbers of some splits are forced to zero, these splits shall be selected prudently. In one embodiment, the bit consumption is accumulated by handling the splits one by one in a descending order of energy $e_k=x_k^T x_k$ for k=0, 1, . . . , K−1. This procedure is signal dependent and in agreement with the means used earlier in determining the global gain.

Before examining the details of overflow handling in module 6.005, the structure of the code used for representing the output of the multi-rate quantizers will be summarized. The unary code of $n_k>0$ comprises k−1 ones followed by a zero stop bit. As was shown in Table 1, $5n_k-1$ bits are needed to code the index $i_k$ and the codebook number $n_k$ excluding the stop bit. The codebook number $n_k=0$ comprises only a stop bit indicating zero split. When K splits are coded, only K−1 stop bits are needed as the last one is implicitly determined by the bit budget R and thus redundant. More specifically, when k last splits are zero, only k−1 stop bits suffice because the last zero splits can be decoded by knowing the bit budget R.

Figure 9:
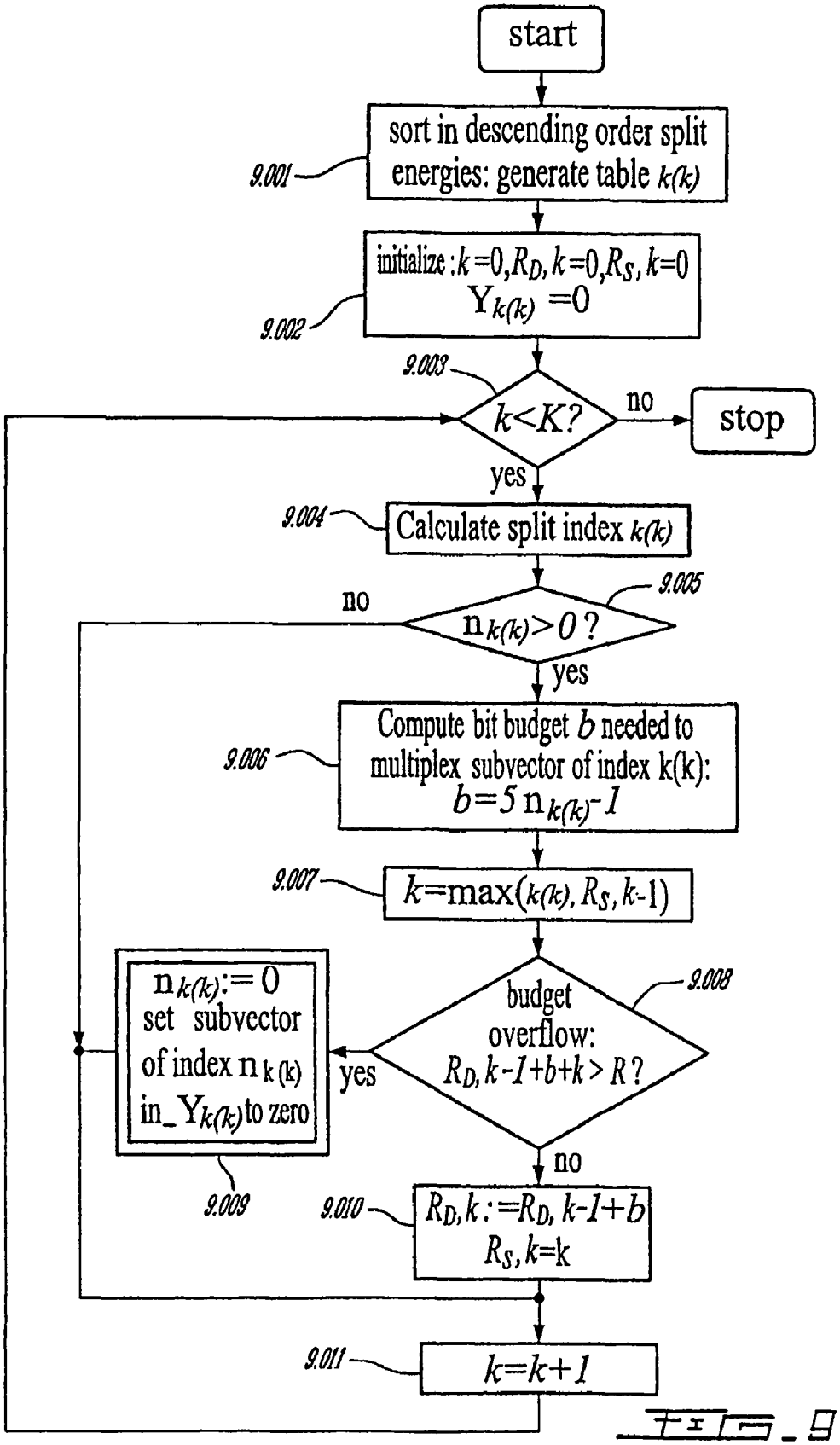
FIG. 9 is a flowchart showing an example of handling of the bit budget overflow in TCX coding, when calculating the lattice point indices of the splits.

Operation of the overflow bit budget handling module 6.005 of FIG. 6 is depicted in the flow chart of FIG. 9. This module 6.005 operates with split indices κ(0), κ(1), . . . , κ(K−1) determined in operation 9.001 by sorting the square-norms of splits in a descending order such that $e_{\kappa(0)} \geqq e_{\kappa(1)} \geqq \ldots \geqq e_{\kappa(K-1)}$. Thus the index κ(k) refers to the split $x_{\kappa(k)}$ that has the $k^{th}$ largest square-norm. The square norms of splits are supplied to overflow handling as an output of operation 9.001.

The $k^{th}$ iteration of overflow handling can be readily skipped when $n_{\kappa(k)}=0$ by passing directly to the next iteration because zero splits cannot cause an overflow. This functionality is implemented with logic operation 9.005, if k<K (Operation 9.003) and assuming that the $\kappa(k)^{th}$ split is a non-zero split, the $RE_8$ point $y_{\kappa(k)}$ is first indexed in operation 9.004. The multi-rate indexing provides the exact value of the codebook number $n_{\kappa(k)}$ and codevector Index $i_{\kappa(k)}$. The bit consumption of all splits up to and including the current $\kappa(k)^{th}$ split can be calculated.

Using the properties of the unary code, the bit consumption $R_k$ up to and including the current split is counted in operation block 9.008 as a sum of two terms: the $R_{D,k}$ bits needed for the data excluding stop bits and the $R_{S,k}$ stop bits:

$$R_k=R_{D,k}+R_{S,k} \tag{7}$$

where for $n_{k(k)}>0$ $$R_{D,k}=R_{D,k-1}+5n_{\kappa(k)}-1, \tag{8}$$

$$R_{S,k}=\max\{\kappa(k),R_{S,k-1}\}, \tag{9}$$

The required initial values are set to zero in operation 9.002. The stop bits are counted in operation 9.007 from Equation (9) taking into account that only splits up to the last non-zero split so far is indicated with stop bits, because the subsequent splits are known to be zero by construction of the code. The index of the last non-zero split can also be expressed as max{κ(0), κ(k), . . . , κ(k)}.

Since the overflow handling starts from zero initial values for $R_{D,k}$ and $R_{S,k}$ in equations (8) and (9), the by consumption up to the current split fits always into the bit budget, $R_{S,k-1}+R_{D,k-1}<R$. If the bit consumption $R_k$ including the current $\kappa(k)^{th}$ split exceeds the bit budget R as verified in logic operation 9.008, the codebook number $n_{\kappa(k)}$ and reconstruction $y_{\kappa(k)}$ are zeroed in block 9.009. The bit consumption counters $R_{D,k}$ and $R_{D,k}$ are accordingly updatedreset to their previous values in block 9.010. After this, the overflow handling can proceed to the next iteration by incrementing k by 1 In operation 9.011 and returning to logic operation 9.003.

Note that operation 9.004 produces the indexing of splits as an integral part of the overflow handling routines. The indexing can be stored and supplied further to the bit stream multiplexer 6.007 of FIG. 6.

Quantized Spectrum De-Shaping Module 5.007

Once the spectrum is quantized using the split multi-rate lattice VQ of module 5.006, the quantization indices (codebook numbers and lattice point indices) can be calculated and sent to a channel through a multiplexer (not shown). A nearest neighbor search in the lattice, and index computation, are performed as in [Ragot, 2002]. The TCX coder then performs spectrum de-shaping in module 5.007, in such a way as to invert the pre-shaping of module 5.005.

Spectrum de-shaping operates using only the quantized spectrum. To obtain a process that inverts the operation of module 5.005, module 5.007 applies the following steps:

calculate the position i and energy $E_{max}$ of the 8-dimensional block of highest energy in the first quarter (low frequencies) of the spectrum;

calculate the energy $E_m$ of the 8-dimensional block at position index m;

compute the ratio, $R_m=E_{max}/E_m$;

if $R_m>10$, then set $R_m=10$;

also, if $R_m>R_{(m-1)}$ then $R_m=R_{(m-1)}$;

compute the value $(R_m)^{1/2}$.

After computing the ratio $R_m=E_{max}/E_m$ for all blocks with position index smaller that i, a multiplicative inverse of this ratio is then applied as a gain for each corresponding block. Differences with the pre-shaping of module 5.005 are: (a) in the de-shaping of module 5.007, the square-root (and not the power ¼) of the ratio $R_m$ is calculated, and (b) this ratio is taken as a divider (and not a multiplier) of the corresponding 8-dimensional block. If the effect of quantizing in module 5.006 is neglected (perfect quantization), it can be shown that the output of module 5.007 is exactly equal to the input of module 5.005. The pre-shaping process is thus an invertible process.

HF Encoding

Figure 10A:
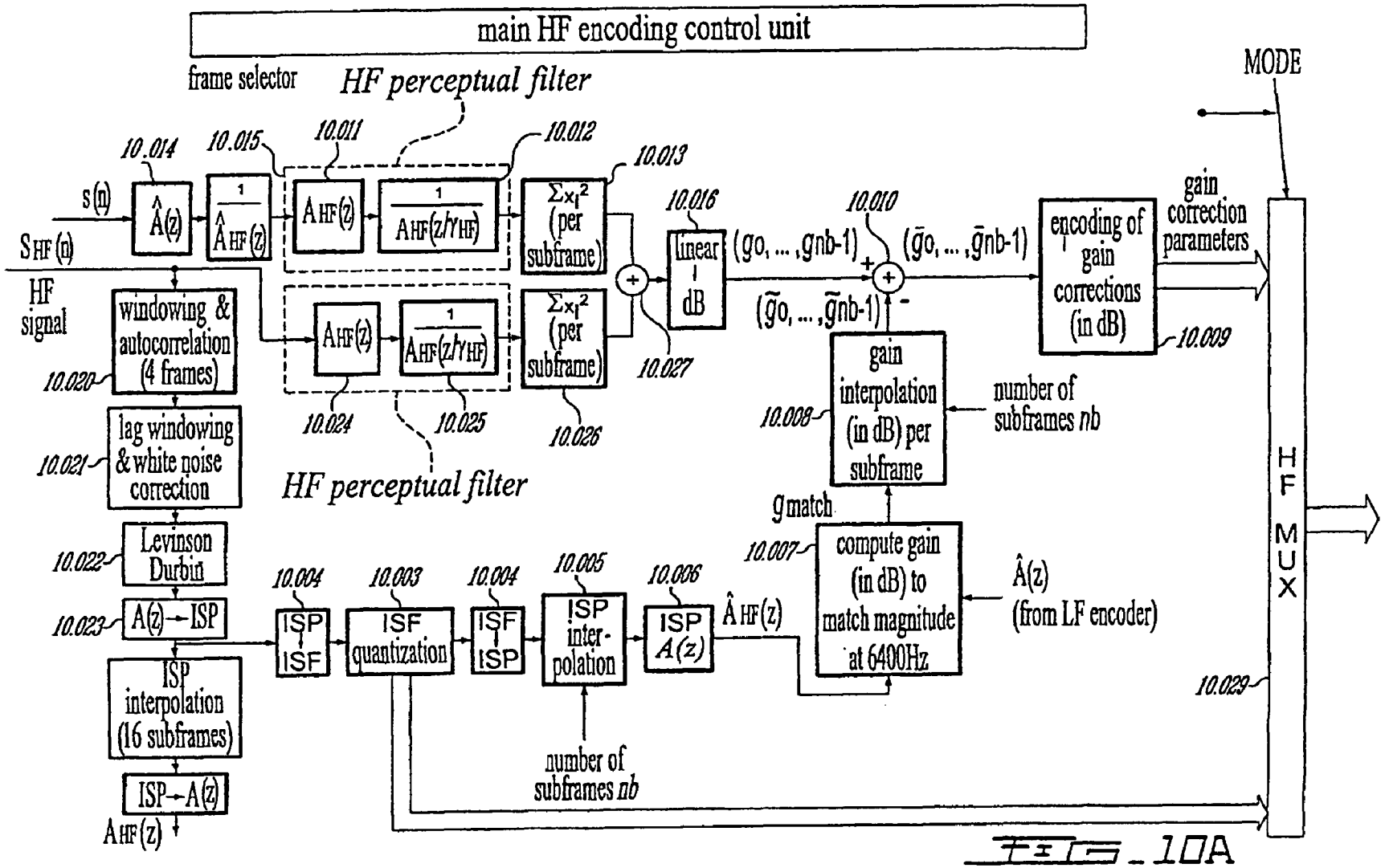
FIG. 10*a* is a schematic block diagram showing a non-limitative example of higher frequency (HF) coder based on bandwidth extension.

The operation of the HF coding module 1.003 of FIG. 1 is illustrated in FIG. 10*a*. As indicated in the foregoing description with reference to FIG. 1, the HF signal is composed of the frequency components of the input signal higher than 6400 Hz. The bandwidth of this HF signal depends on the input signal sampling rate. To code the HF signal at a low rate, a bandwidth extension (BWE) scheme is employed in one embodiment. In BWE, energy information is sent to the decoder in the form of spectral envelope and frame energy, but the fine structure of the signal is extrapolated at the decoder from the received (decoded) excitation signal from the LF signal which, according to one embodiment, is encoded in the switched ACELP/TCX coding module 1.002.

The down-sampled HF signal at the output of the preprocessor and analysis filterbank 1.001 is called $s_{HF}(n)$ in FIG. 10*a*. The spectrum of this signal can be seen as a folded version of the higher-frequency band prior to down-sampling. An LPC analysis as described hereinabove with reference to FIG. 18 is performed in modules 10.020-10.022 on the signal $s_{HF}(n)$ to obtain a set of LPC coefficients which (model the spectral envelope of this signal. Typically, fewer parameters are necessary than for the LF signal. In one embodiment, a filter of order 8 was used. The LPC coefficients A(z) are then transformed into the ISP domain in module 10.023, then converted from the ISP domain to the ISF domain in module 10.004, and quantized in module 10.003 for transmission through a multiplexer 10.029. The number of LPC analysis in an 80-ms super-frame depends on the frame lengths in the super-frame. The quantized ISF coefficients are converted back to ISP coefficients in module 10.004 and then interpolated (can we briefly describe the method of interpolation) in module 10.005 before being converted to quantized LPC coefficients $A_{HF}(z)$ by module 10.006.

A set of LPC filter coefficients can be represented as a polynomial in the variable i Also, A(z) is the LPC filter for the LF signal and $A_{HF}(z)$ the LPC filter for the HF signal. The quantized versions of these two filters are respectively $\hat{A}(z)$ and $\hat{A}_{HF}(z)$. From the LF signal s(n) of FIG. 10, a residual signal is first obtained by filtering s(n) through the residual filter $\hat{A}(z)$ identified by the reference 10.014. Then, this residual signal is filtered through the quantized HF synthesis filter $1/\hat{A}_{HF}(z)$ identified by the reference 10.015. Up to a gain factor, this produces a synthesized version of the HF signal, but in a spectrally folded version. The actual HF synthesis signal will be recovered after up-sampling has been applied.

Since the excitation is recovered from the LF signal, the proper gain is computed for the HF signal. This is done by comparing the energy of the reference HF signal $s_{HF}(n)$ with the energy of the synthesized HF signal. The energy is computed once per 5-ms subframe, with energy match ensured at the 6400 Hz sub-band boundary. Specifically, the synthesized HF signal and the reference HF signal are filtered through a perceptual filter (modules 10.011-10.012 and 10.024-10.025). In the embodiment of FIG. 10, this perceptual filter is derived from $A_{HF}(z)$ and is called "HF perceptual filter". The energy of these two filtered signals is computed every 5 ms in modules 10.013 and 10.026, respectively, the ratio between the energies calculated by the modules 10.013 and 10.126 is calculated by the divider 10.027 and expressed in dB in module 10.016. There are 4 such gains in a 20-ms frame (one for every 5-ms subframe). This 4-gain vector represents the gain that should be applied to the HF signal to property match the HF signal energy.

Figure 10B:
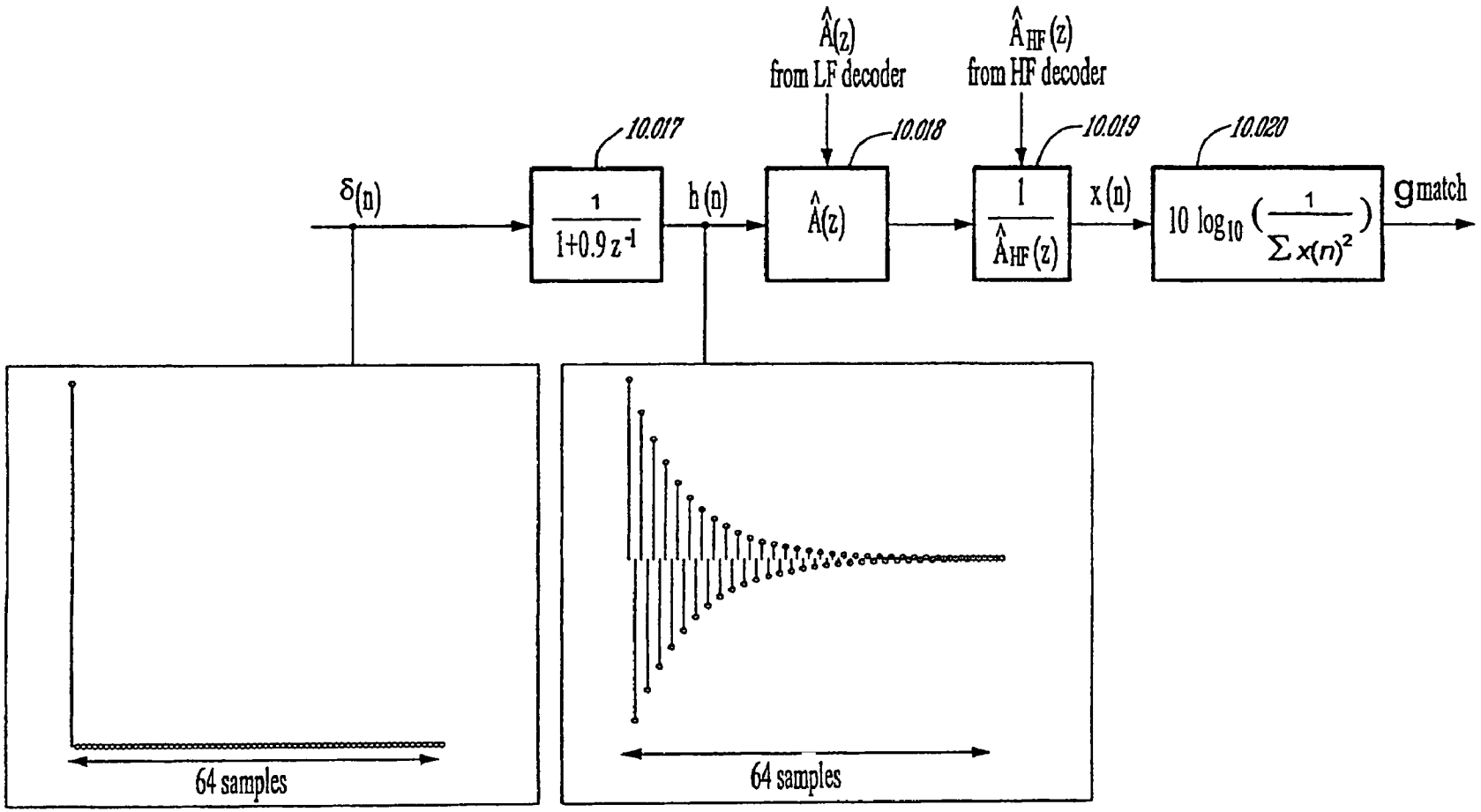
FIG. 10*b* are schematic block diagram and graphs showing a non-limitative example of gain matching procedure performed by the coder of FIG. 10*a* between lower and higher frequency envelope computed by the coder of FIG. 10*a;*

Instead of transmitting this gain directly, an estimated gain ratio is first computed by comparing the gains of the filters $\hat{A}(z)$ from the lower band and $\hat{A}_{HF}(z)$ from the higher band. This gain ratio estimation is detailed in FIG. 10*b* and will be explained in the following description. The gain ratio estimation is interpolated every 5-ms, expressed in dB and subtracted in module 10.010 from the measured gain ratio. The resulting gain differences or gain corrections, noted $\bar{g}_0$ to $\bar{g}_{nb-1}$ in FIG. 10, are quantized in module 10.009. The gain corrections can be quantized as 4-dimensional vectors, i.e. 4 values per 20-ms frame and then supplied to the multiplexer 10.029 for transmission.

The gain estimation computed in module 10.007 from filters $\hat{A}(z)$ and $\hat{A}_{HF}(z)$ is explained in FIG. 10*b*. These two filters are available at the decoder side. The first 64 samples of a decaying sinusoid at Nyquist frequency $\pi$ radians per sample is first computed by filtering a unit impulse $\delta(n)$ through a one-pole filter 10.017. The Nyquist frequency is used since the goal is to match the filter gains at around 6400 Hz. i.e. at the junction frequency between the LF and HF signals. Here, the 64-sample length of this reference signal is the sub-frame length (5 ms). The decaying sinusoid h(n) is then filtered first through filter $\hat{A}(z)$ 10.018 to obtain a low-frequency residual, then through filter $1/\hat{A}_{HF}(z)$ 10.019 to obtain a synthesis signal from the HF synthesis filter. If the filters $\hat{A}(z)$ and $\hat{A}_{HF}(z)$ have identical gains at the normalized frequency of $\pi$ radians per sample, the energy of the output x(n) of filter 10.019 would be equivalent to the energy of the input h(n) of filter 10.018 (the decaying sinusoid). If the gains differ, then this gain difference is taken into account in the energy of the signal x(n) at the output of filter 10.019. The correction gain should actually increase as the energy of the signal x(n) decreases. Hence, the gain correction is computed in module 10.028 as the multiplicative inverse of the energy of signal x(n), in the logarithmic domain (i.e. in dB). To get a true energy ratio, the energy of the decaying sinusoid h(n), in dB, should be removed from the output of module 10.028. However, since this energy offset is a constant, it will simply be taken into account in the gain correction coder in module 10.009. Finally the gain from module 10.007 is interpolated and expressed in dB before being subtracted by the module 10.010.

At the decoder, the gain of the HF signal can be recovered by adding the output of the HF coding device 1.003, known at the decoder, to the decoded gain corrections coded in module 11.009.

Detailed Description of the Decoder

Figure 11:
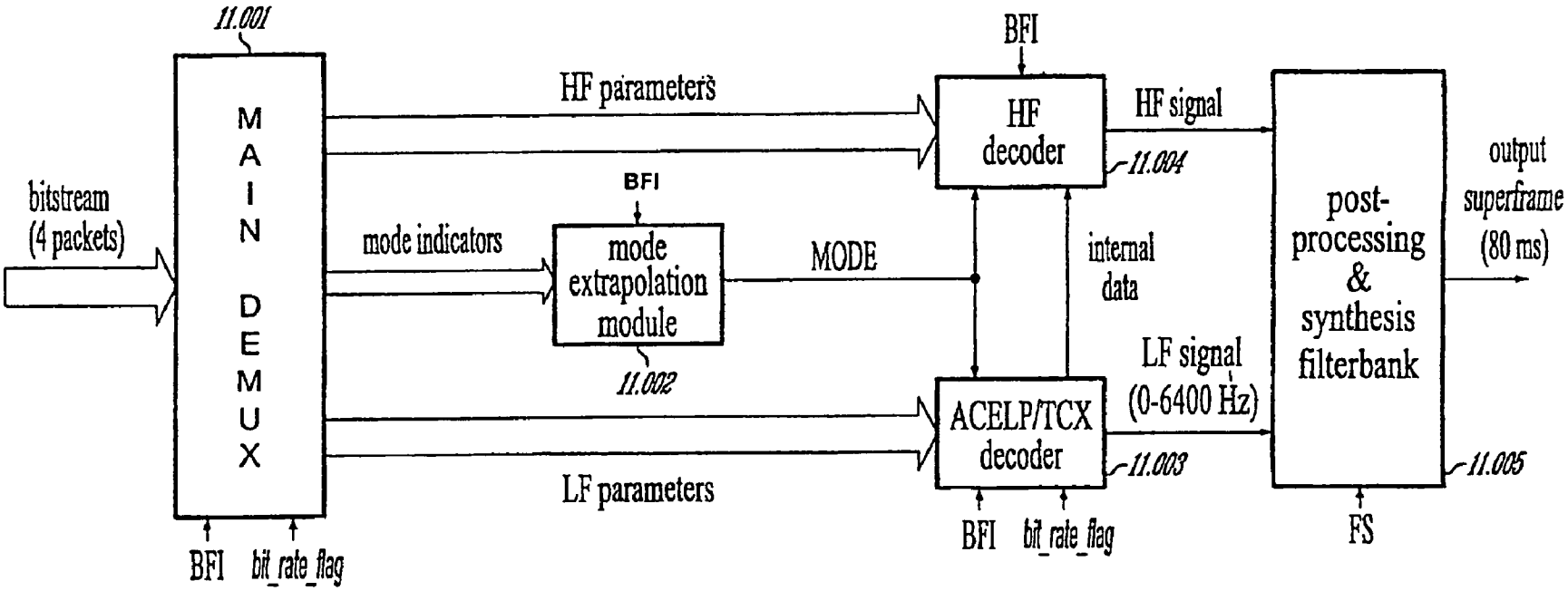
FIG. 11 is a high-level block diagram of one embodiment of a decoder in accordance with the present invention, showing recombination of a lower frequency signal coded with hybrid ACELP/TCX, and a HF signal coded using bandwidth extension.

The role of the decoder is to read the coded parameters from the bitstream and synthesize a reconstructed audio super-frame. A high-level block diagram of the decoder is shown in FIG. 11.

As indicated in the foregoing description, each 80-ms super-frame is coded into four (4) successive binary packets of equal size. These four (4) packets form the input of the decoder. Since all packets may not be available due to channel erasures, the main demultiplexer 11.001 also receives as input four (4) bad frame indicators BFI=($bfi_0$, $bfi_1$, $bfi_2$, $bfi_3$) which indicate which of the four packets have been received. It is assumed here that $bfi_k$=0 when the $k^{th}$ packet is received, and $bfi_k$=1 when the $k^{th}$ packet is lost. The size of the four (4) packets is specified to the demultiplexer 11.001 by the input bit_rate_flag indicative of the bit rate used by the coder.

Main Demultiplexing

The demultiplexer 11.001 simply does the reverse operation of the multiplexer of the coder. The bits related to the encoded parameters in packet k are extracted when packet k is available, i.e. when $bfi_k$=0.

As indicated in the foregoing description, the coded parameters are divided into three (3) categories: mode indicators, LF parameters and HF parameters. The mode indicators specify which encoding mode was used at the coder (ACELP, TCX20, TCX40 or TCX80). After the main demultiplexer 11.001 has recovered these parameters, they are decoded by a mode extrapolation module 11.002, an ACELP/TCX decoder 11.003) and an HF decoder 11.004, respectively. This decoding results into 2 signals, a LF synthesis signal and a HF synthesis signal, which are combined to form the audio output of the post-processing and synthesis filterbank 11.005. It is assumed that an input flag FS indicates to the decoder what is the output sampling rate. In one embodiment, the allowed sampling rates are 16 kHz and above.

The modules of FIG. 11 will be described in the following description.

LF Signal ACELP/TCX Decoder 11.003

The decoding of the LF signal involves essentially ACELP/TCX decoding. This procedure is described in FIG. 12. The ACELP/TCX demultiplexer 12.001 extracts the coded LF parameters based on the values of MODE. More specifically, the LF parameters are split into ISF parameters on the one hand and ACELP- or TCX-specific parameters on the other hand.

The decoding of the LF parameters is controlled by a main ACELP/TCX decoding control unit 12.002. In particular, this main ACELP/TCX decoding control unit 12.002 sends control signals to an ISF decoding module 12.003, an ISP interpolation module 12.005, as well as ACELP and TCX decoders 12.007 and 12.008. The main ACELP/TCX decoding control unit 12.002 also handles the switching between the ACELP decoder 12.007 and the TCX decoder 12.008 by setting proper inputs to these two decoders and activating the switch selector 12.009. The main ACELP/TCX decoding control unit 12.002 further controls the output buffer 12.010 of the LF signal so that the ACELP or TCX decoded frames are written in the right time segments of the 80-ms output buffer.

The main ACELP/TCX decoding control unit 12.002 generates control data which are internal to the LF decoder: BFI_ISF, nb (the number of subframes for ISP interpolation), bfi_acelp, $L_{TCX}$ (TCX frame length), BFI_TCX, switch_flag, and frame_selector (to set a frame pointer on the output LF buffer 12.010). The nature of these data is defined herein below:

- BFI_ISF can be expanded as the 2-D integer vector BFI_SF=($bfi_{1st_stage}$ $bfi_{2nd_stage}$) and consists of bad frame indicators for ISF decoding. The value $bfi_{1st_stage}$ is binary, and $bfi_{1st_stage}=0$ when the ISF $1^{st}$ stage is available and $bfi_{1st_stage}=1$ when it is lost. The value $0 \leqq bfi_{2nd_stage} \leqq 31$ is a 5-bit flag providing a bad frame indicator for each of the 5 splits of the ISF $2^{nd}$ stage: $bfi_{2nd_stage}=bfi_{1st_split}+2*bfi_{2nd_split}+4*bfi_{3rd_split}+8*bfi_{4th_split}+16*bfi_{5th_split}$, where $bfi_{kth_split}=0$ when split k is available and is equal to 1 otherwise. With the above described bitstream format, the values of $bfi_{1st_stage}$ and $bfi_{2nd_stage}$ can be computed from BFI=($bfi_0$ $bfi_1$ $bfi_2$ $bfi_3$) as follows:
  - For ACELP or TCX20 in packet k, BFI_ISF=($bfi_k$),
  - For TCX40 in packets k and k+1, BFI_ISF=($bfi_k$ $(31*bfi_{k+1})$),
  - For TCX80 in packets k=0 to 3, BFI_ISF=($bfi_0$ $(bfi_1+6*bfi_2+20*bfi_3)$)
- These values of BFI_ISF can be explained directly by the bitstream format used to pack the bits of ISF quantization, and how the stages and splits are distributed in one or several packets depending on the coder type (ACELP/TCX20 TCX40 or TCX80).
- The number of subframes for ISF interpolation refers to the number of 5-ms subframes in the ACELP or TCX decoded frame. Thus, nb=4 for ACELP and TCX20, 8 for TCX40 and 16 for TCX80.
- bfi_acelp is a binary flag indicating an ACELP packet loss. It is simply set as bfi_acelp=$bfi_k$ for an ACELP frame in packet k.
- The TCX frame length (in samples) is given by $L_{TCX}=256$ (20 ms) for TCX20, 512 (40 ms) for TCX40 and 1024 (80 ms) for TCX80. This does not take into account the overlap used in TCX to reduce blocking effects.
- BFI_TCX is a binary vector used to signal packet losses to the TCX decoder: BFI_TCX=($bfi_k$) for TCX20 in packet k, ($bfi_k$ $bfi_{k+1}$) for TCX40 in packets k and k+1, and BFI_TCX=BFI for TCX80.

Figure 12:
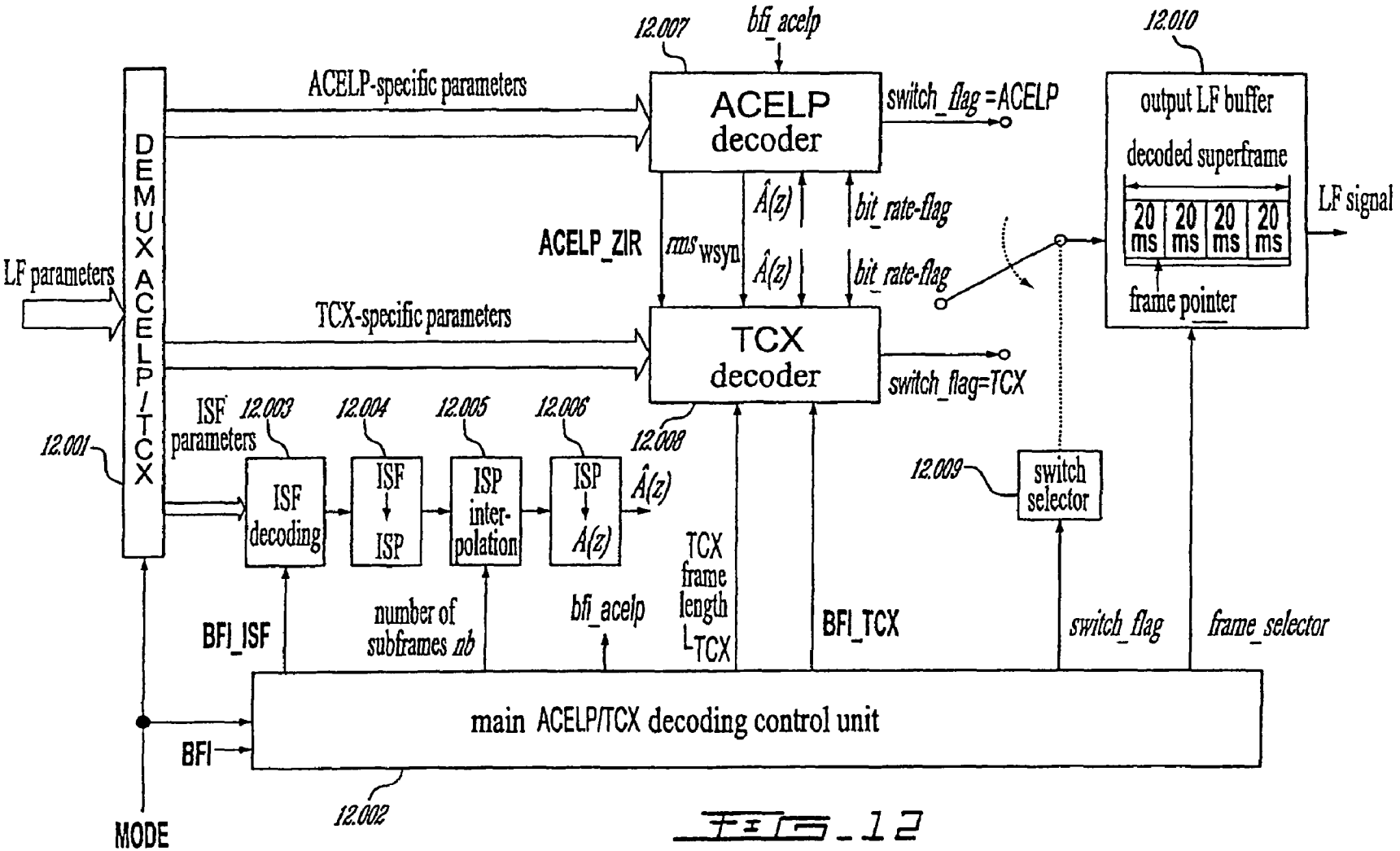
FIG. 12 is a schematic block diagram illustrating a non-limitative example of ACELP/TCX decoder for an LF signal.

The other data generated by the main ACELP/TCX decoding control unit 12.002 are quite self-explanatory. The switch selector 12.009 is controlled in accordance with the type of decoded frame (ACELP or TCX). The frame_selector data allows writing of the decoded frames (ACELP or TCX20, TCX40 or TCX80) into the right 20-ms segments of the super-frame. In FIG. 12 some auxiliary data also appear such as ACELP_ZIR and $rms_{wsyn}$. These data are defined in the subsequent paragraphs.

ISF decoding module 12.003 corresponds to the ISF decoder defined in the AMR-WB speech coding standard, with the same MA prediction and quantization tables, except for the handling of bad frames. A difference compared to the AMR-WB device is the use of BFI_ISF=($bfi_{1st_stage}$ $bfi_{2nd_stage}$) instead of a single binary bad frame indicator. When the $1^{st}$ stage of the ISF quantizer is lost (i.e., $bfi_{1st_stage}=1$) the ISF parameters are simply decoded using the frame-erasure concealment of the AMR-WB ISF decoder. When the $1^{st}$ stage is available (i.e., $bfi_{1st_stage}=0$), this $1^{st}$ stage is decoded. The $2^{nd}$ stage split vectors are accumulated to the decoded $1^{st}$ stage only if they are available. The reconstructed ISF residual is added to the MA prediction and the ISF mean vector to form the reconstructed ISF parameters.

Converter 12.004 transforms ISF parameters (defined in the frequency domain) into ISP parameters (in the cosine domain). This operation is taken from AMR-WB speech coding.

ISP interpolation module 12.005 realizes a simple linear interpolation between the ISP parameters of the previous decoded frame (ACELP/TCX20, TCX40 or TCX80) and the decoded ISP parameters. The interpolation is conducted in the ISP domain and results in ISP parameters for each 5-ms subframe, according to the formula:

$$isp_{subframe\text{-}i}=i/nb*isp_{new}+(1-i/nb)*isp_{old},$$

where nb is the number of subframes in the current decoded frame (nb=4 for ACELP and TCX20, 8 for TCX40, 16 for TCX80), i=0, . . . , nb−1 is the subframe index, $isp_{old}$ is the set of ISP parameters obtained from the decoded ISF parameters of the previous decoded frame (ACELP, TCX20/40/80) and $isp_{new}$ is the set of ISP parameters obtained from the ISF parameters decoded in decoder 12.003. The interpolated ISP parameters are then converted into linear-predictive coefficients for each subframe in converter 12.006.

The ACELP and TCX decoders 12.007 and 12.008 will be described separately at the end of the overall ACELP/TCX decoding description.

ACELP/TCX Switching

Figure 13:
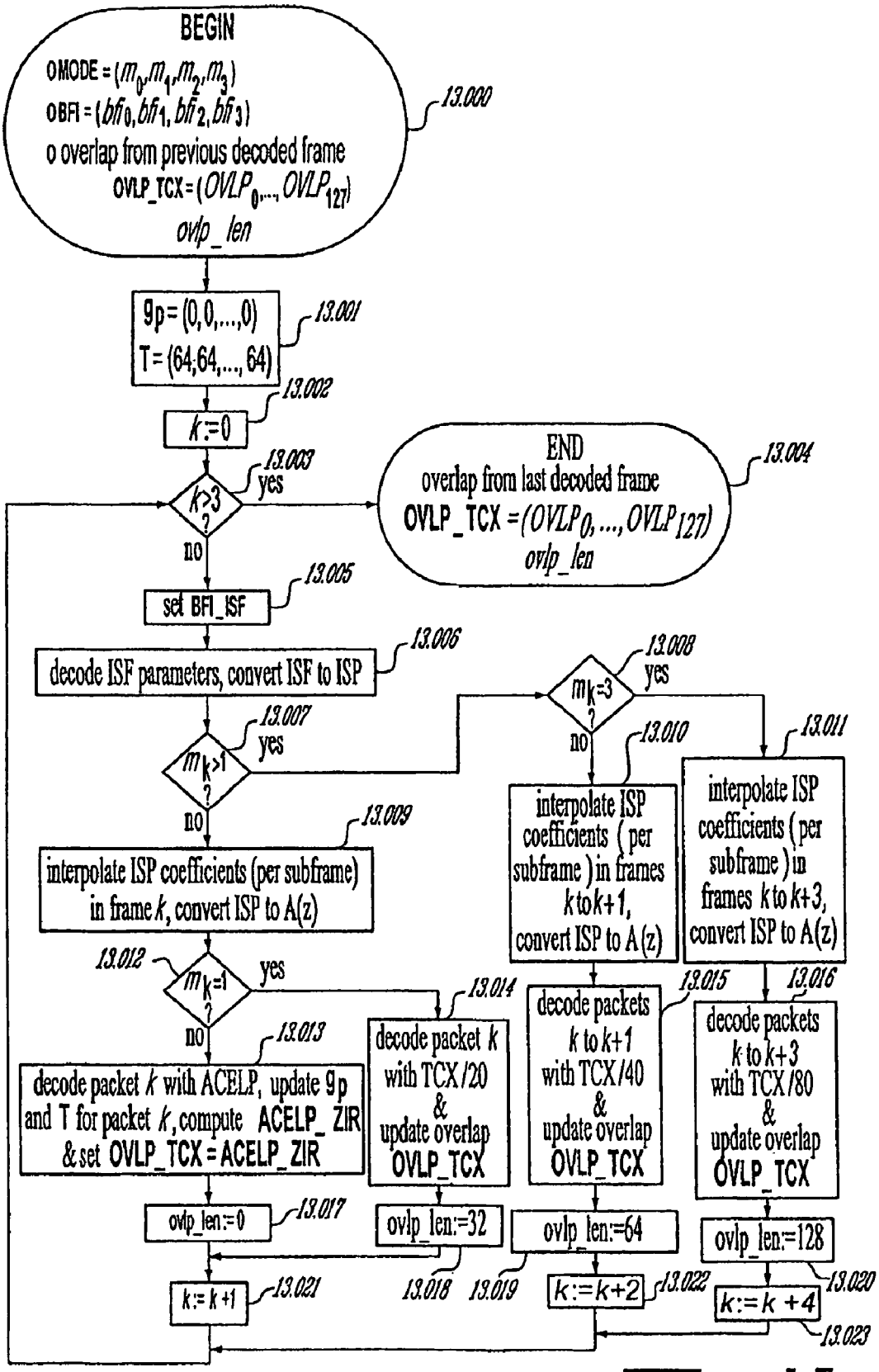
FIG. 13 is a flow chart showing a non-limitative example of logic behind ACELP/TCX decoding, upon processing four (4) packets forming an 80-ms frame.

The description of FIG. 12 in the form of a block diagram is completed by the flow chart of FIG. 13, which defines exactly how the switching between ACELP and TCX is handled based on the super-frame mode indicators in MODE. Therefore FIG. 13 explains how the modules 12.003 to 12.006 of FIG. 12 are used.

One of the key aspects of ACELP/TCX decoding is the handling of an overlap from the past decoded frame to enable seamless switching between ACELP and TCX as well as between TCX frames. FIG. 13 presents this key feature in details for the decoding side.

The overlap consists of a single 10-ms buffer: OVLP_TCX. When the past decoded frame is an ACELP frame, OVLP_TCX=ACELP_ZIR memorizes the zero-impulse response (ZIR) of the LP synthesis filter (1/A(z)) in the weighted domain of the previous ACELP frame. When the past decoded frame is a TCX frame, only the first 2.5 ms (32 samples) for TCX20, 5 ms (64 samples) for TCX40, and 10 ms (128 samples) for TCX80 are used in OVLP_TCX (the other samples are set to zero).

As illustrated in FIG. 13, the ACELP/TCX decoding relies on a sequential interpretation of the mode indicators in MODE. The packet number and decoded frame index k is incremented from 0 to 3. The loop realized by operations 13.002, 13.003 and 13.021 to 13.023 allows to sequentially process the four (4) packets of an 80-ms super-frame. The description of operations 13.005, 13.006 and 13.009 to 13.011 is skipped because they realize the above described ISF decoding, ISF to ISP conversion, ISP interpolation and ISP to A(z) conversion.

When decoding ACELP (i.e. when $m_k=0$ as detected in operation 13.012), the buffer ACELP_ZIR is updated and the length ovp_len of the TCX overlap is set to 0 (operations 13.013 and 16.017). The actual calculation of ACELP_ZIR is explained in the next paragraph dealing with ACELP decoding.

When decoding TCX, the buffer OVLP_TCX is updated (operations 13.014 to 13.016) and the actual length ovp_len of the TCX overlap is set to a number of samples equivalent to 2.5, 5 and 10 ms for TCX20, TCX40 and TCX80, respectively (operations 13.018 to 13.020). The actual calculation of OVLP_TCX is explained in the next paragraph dealing with TCX decoding.

The ACELP/TCX decoder also computes two parameters for subsequent pitch post-filtering of the LF synthesis: the pitch gains $g_p=(g_0, g_1, \ldots, g_{15})$ and pitch lags $T=(T_0, T_1, \ldots, T_{15})$ for each 5-ms subframe of the 80-ms super-frame. These parameters are initialized in Processor 13.001. For each new super-frame, the pitch gains are set by default to $g_{pk}=0$ for k=0, . . . , 15, while the pitch lags are all initialized to 64 (i.e. 5 ms). These vectors are modified only by ACELP in operation 13.013: if ACELP is defined in packet k, $g_{4k}$, $g_{4k+1}, \ldots, g_{4k+3}$ correspond to the pitch gains in each decoded ACELP subframe, while $T_{4k}, T_{4k+1}, \ldots, T_{4k+3}$ are the pitch lags.

ACELP Decoding

Figure 14A:
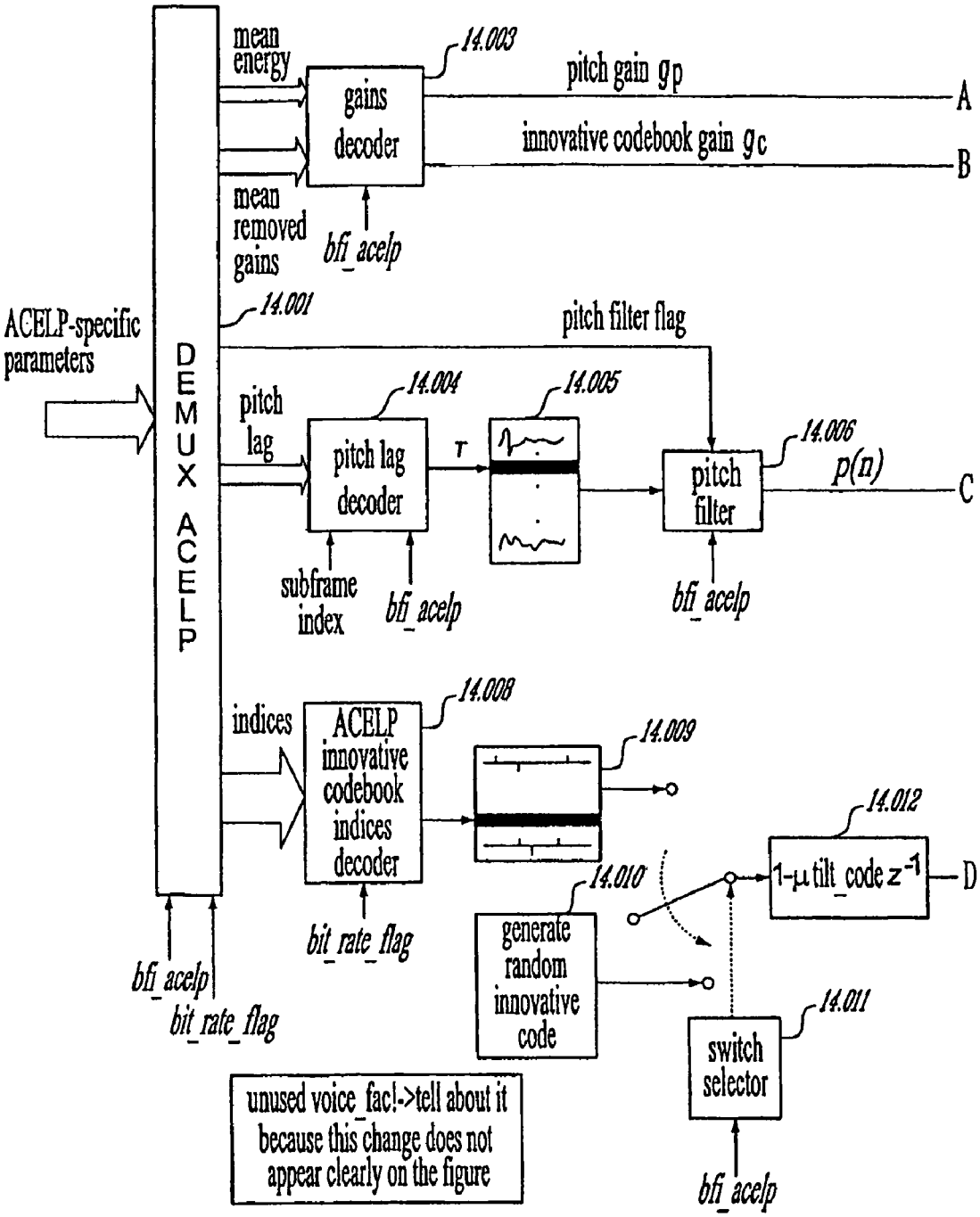
FIG. 14 is a schematic block diagram illustrating a non-limitative example of ACELP decoder used in the ACELP/TCX decoder of FIG. 12.
Figure 14B:
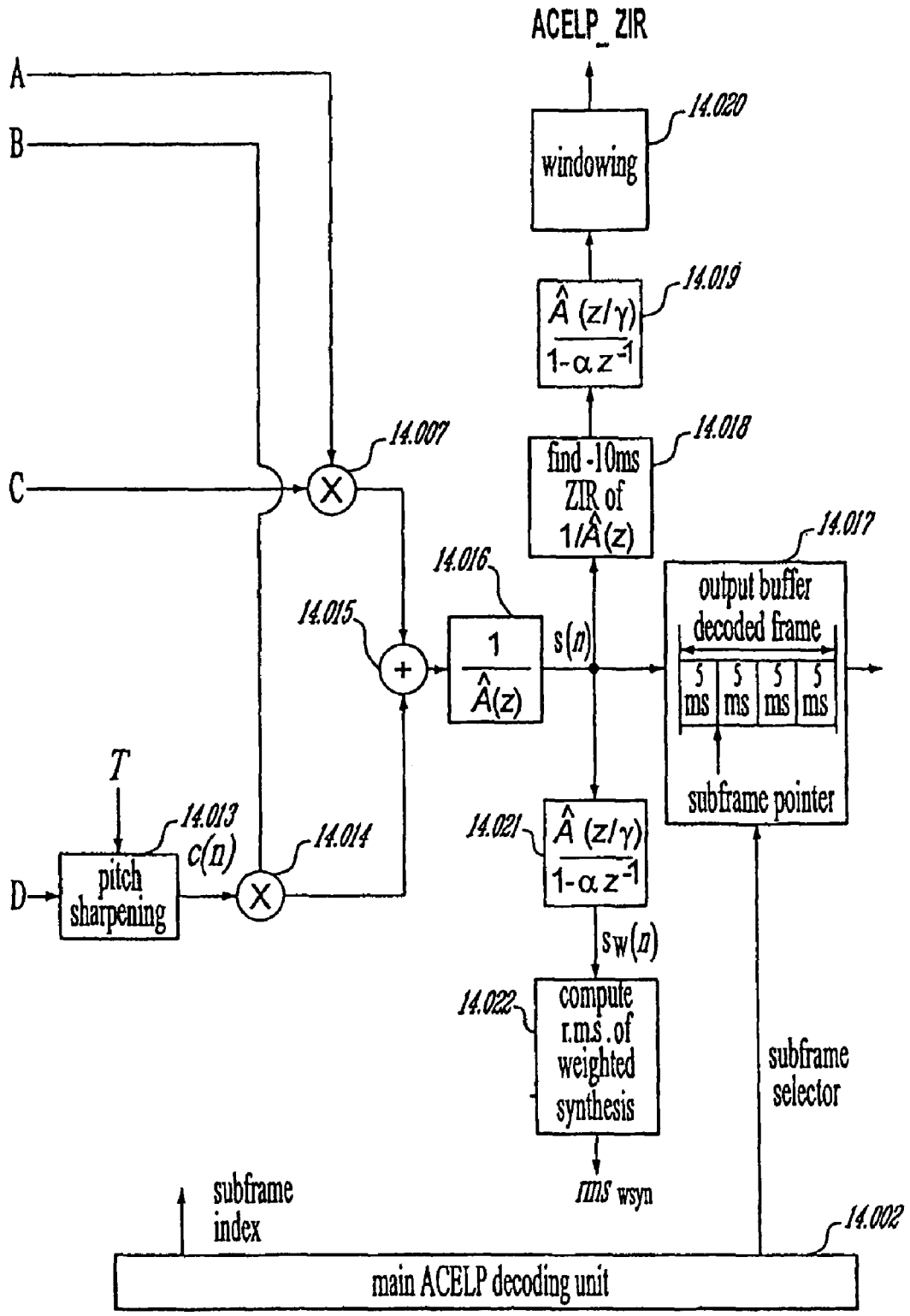

The ACELP decoder presented in FIG. 14 is derived from the AMR-WB speech coding algorithm [Bessette et al, 2002]. The new or modified blocks compared to the ACELP decoder of AMR-WB are highlighted (by shading these blocks) in FIG. 14.

In a first step, the ACELP-specific parameter are demultiplexed through demultiplexer 14.001.

Still referring to FIG. 14, ACELP decoding consists of reconstructing the excitation signal r(n) as the linear combination $g_p$ p(n)+$g_c$ c(n), where $g_p$ and $g_c$ are respectively the pitch gain and the fixed-codebook gain, T the pitch lag, p(n) is the pitch contribution derived from the adaptive codebook 14.005 through the pitch filter 14.006, and c(n) is a post-processed codevector of the innovative codebook 14.009 obtained from the ACELP innovative-codebook indices decoded by the decoder 14.008 and processed through modules 14.012 and 14.013; p(n) is multiplied by gain $g_p$ in multiplier 14.007, c(n) is multiplied by the gain $g_c$ in multiplier 14.014, and the products $g_p$ p(n) and $g_c$ c(n) are added in the adder module 14.015. When the pitch lag T is fractional, p(n) involves interpolation in the adaptive codebook 14.005. Then, the reconstructed excitation is passed through the synthesis filter $1/\hat{A}(z)$ 14.016 to obtain the synthesis s(n). This processing is performed on a sub-frame basis on the interpolated LP coefficients and the synthesis is processed through an output buffer 14.017. The whole ACELP decoding process is controlled by a main ACELP decoding unit 14.002. Packet erasures (signalled by bfi_acelp=1) are handled by a switch selector 14.011 switching from the innovative codebook 14.009 to a random innovative codebook 14.010, extrapolating pitch and gain parameters from their past values in gain decoders 14.003 and 14.004, and relying on the extrapolated LP coefficients.

The changes compared to the ACELP decoder of AMR-WB are concerned with the gain decoder 14.003, the computation of the zero-impulse response (ZIR) of $1/\hat{A}(z)$ in weighted domain in modules 14.018 to 14.020, and the update of the r.m.s value of the weighted synthesis ($rms_{wsyn}$) in modules 14.021 and 14.022. The gain decoding has been already disclosed when bfi_acelp=0 or 1. It is based on a mean energy parameter so as to apply mean-removed VQ.

The ZIR of $1/\hat{A}(z)$ is computed here in weighted domain for switching from an ACELP frame to a TCX frame while avoiding blocking effects. The related processing is broken down into three (3) steps and its result is stored in a 10-ms buffer denoted by ACELP_ZIR:

1) a calculator computes the 10-ms ZIR of $1/\hat{A}(z)$ where the LP coefficients are taken from the last ACELP subframe (module 14.018);
2) a filter perceptually weights the ZIR (module 14.019),
3) ACELP_ZIR is found after applying an hybrid flat-triangular windowing (through a window generator) to the 10-ms weighted ZIR in module 14.020. This step uses a 10-ms window w(n) defined below:

$$w(n)=1 \text{ if } n=0, \ldots, 63,$$

$$w(n)=(128-n)/64 \text{ if } n=64, \ldots, 127$$

It should be noted that module 14.020 always updates OVLP_TCX as OVLP_TCX=ACELP_ZIR.

The parameter $rms_{wsyn}$ is updated in the ACELP decoder because it is used in the TCX decoder for packet-erasure concealment. Its update in ACELP decoded frames consists of computing per subframe the weighted ACELP synthesis $s_w(n)$ with the perceptual weighting filter 14.021 and calculating in module 14.022:

$$rms_{wysn} = \sqrt{\frac{1}{L}(s_w(0)^2 + s_w(1)^2 + \ldots + s_w(L-1)^2)}$$

where L=256 (20 ms) is the ACELP frame length.

TCX Decoding

Figure 15A:
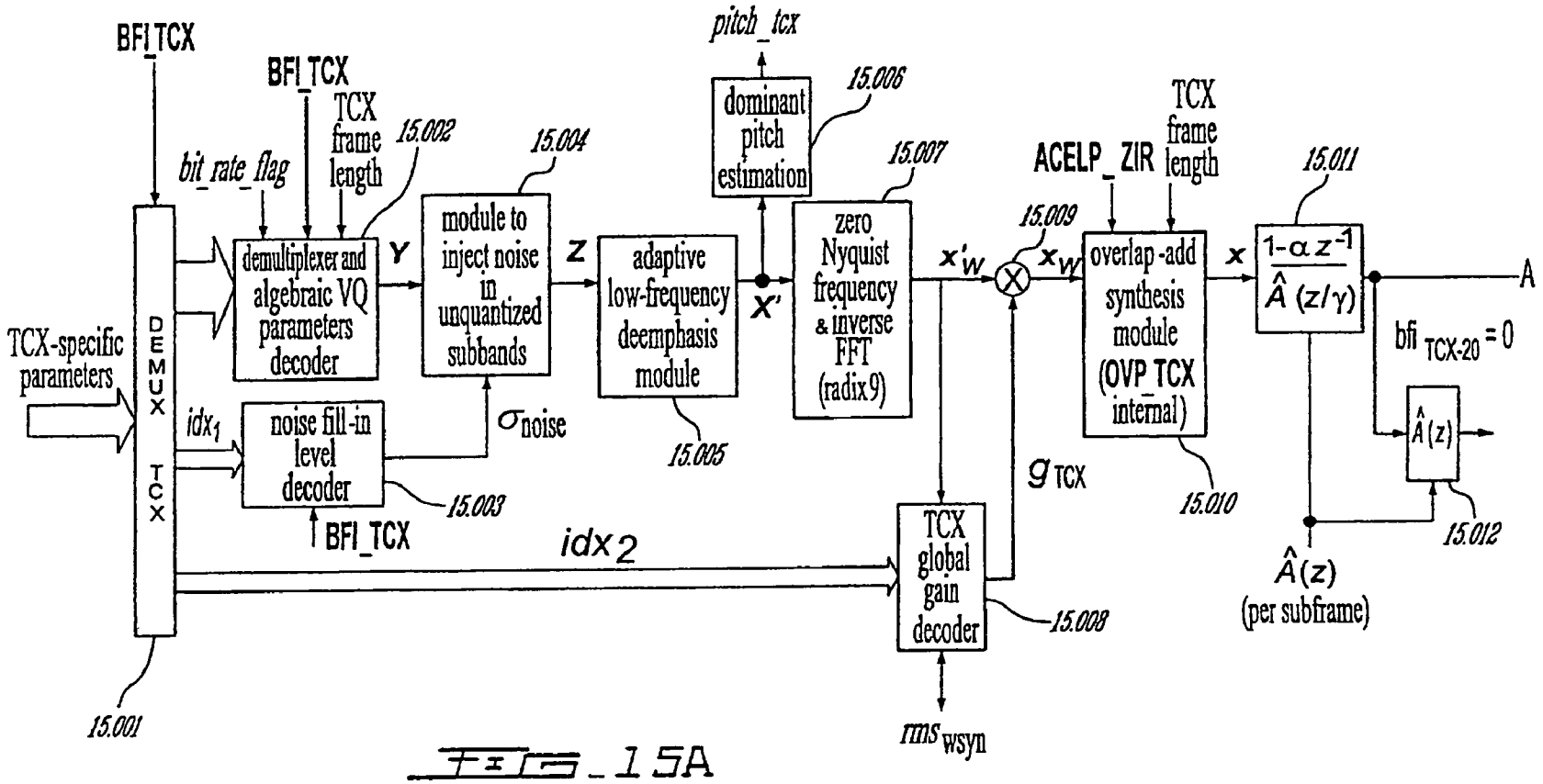
FIG. 15 is a schematic block diagram showing a non-limitative example of TCX decoder as used in the ACELP/TCX decoder of FIG. 12.
Figure 15B:
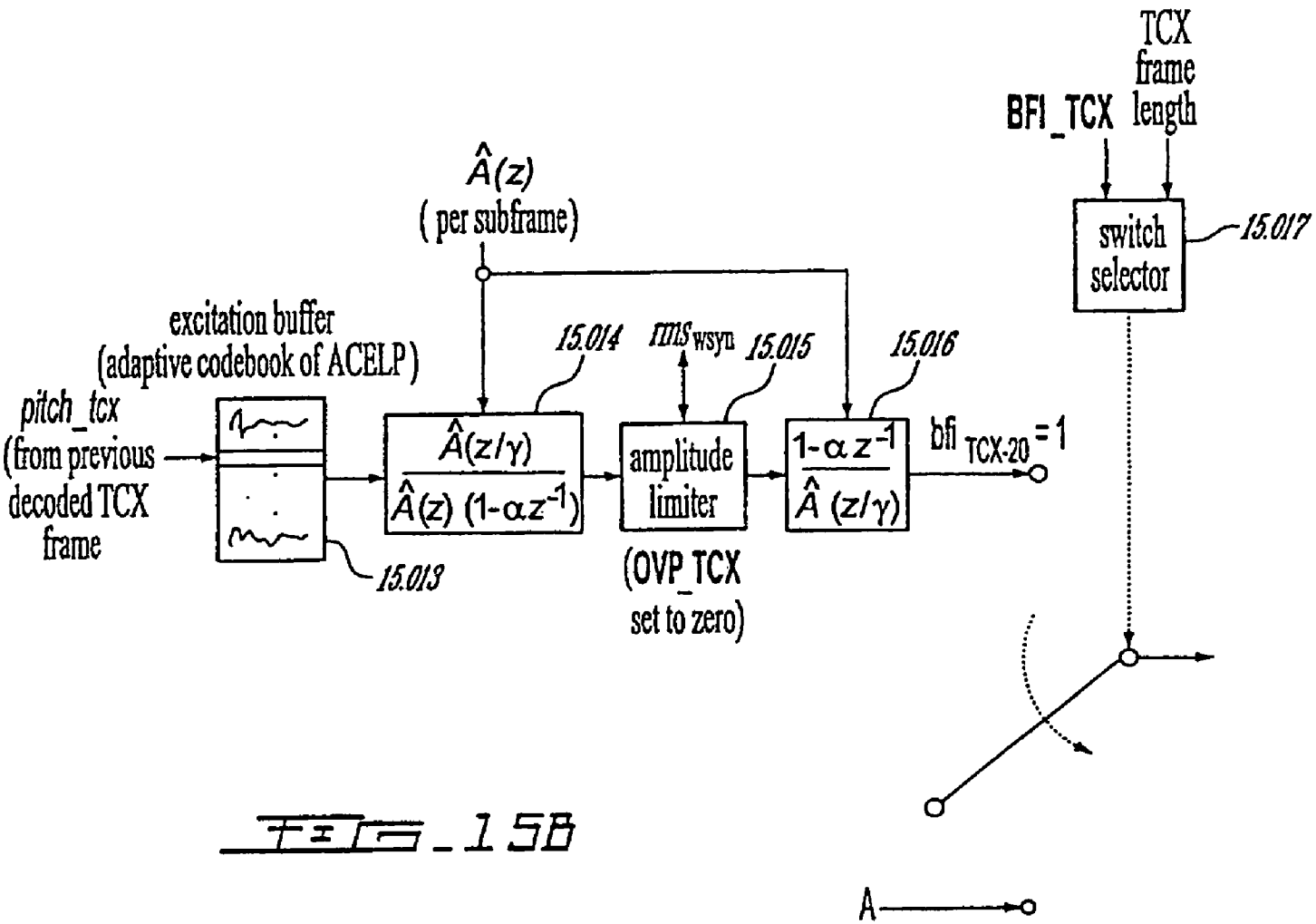

One embodiment of TCX decoder is shown in FIG. 15. A switch selector 15.017 is used to handle two different decoding cases:

Case 1: Packet-erasure concealment in TCX20 through modules 15.013 to 15.016 when the TCX frame length is 20 ms and the related packet is lost, i.e. BFI_TCX=1; and Case 2: Normal TCX decoding, possibly with partial packet losses through modules 15.001 to 15.012.

In Case 1, no information is available to decode the TCX20 frame. The TCX synthesis is made by processing, through a non-linear filter roughly equivalent to $1/\hat{A}(z)$ (modules 15.014 to 15.016), the past excitation from the previous decoded TCX frame stored in the excitation buffer 15.013 and delayed by T, where T=pitch_tcx is a pitch lag estimated in the previously decoded TCX frame. A non-linear filter is used instead of filter $1/\hat{A}(z)$ to avoid clicks in the synthesis. This filter is decomposed in three (3) blocks: a filter 15.014 having a transfer function $\hat{A}(z/\gamma)/\hat{A}(z)/(1-\alpha z^{-1})$ to map the excitation delayed by T into the TCX target domain, limiter 15.015 to limit the magnitude to $\pm rms_{wsyn}$, and finally filter 15.016 having a transfer function $(1-\alpha z^{-1}))/\hat{A}(z/\gamma)$ to find the synthesis. The buffer OVLP_TCX is set to zero in this case.

In Case 2, TCX decoding involves decoding the algebraic VQ parameters through the demultiplexer 15.001 and VQ parameter decoder 15. This decoding operation is presented in another part of the present description. As indicated in the foregoing description, the set of transform coefficients $Y=[Y_0 Y_1 \ldots Y_{N-1}]$, where N=288, 576 and 1152 for TCX20, TCX40 and TCX80 respectively, is divided into K subvectors (blocks of consecutive transform coefficients) of dimension 8 which are represented in the lattice $RE_8$. The number K of subvectors is 36, 72 and 144 for TCX20, TCX40 and TCX80. respectively. Therefore, the coefficients Y can be expanded as $Y=[Y_0 Y_1 \ldots Y_{K-1}]$ with $Y_k=[Y_{8k} \ldots Y_{8k+7}]$ and k=0, . . . , K−1.

The noise fill-in level $\sigma_{noise}$ is decoded in noise-fill-in level decoder 15.003 by Inverting the 3-bit uniform scalar quantization used at the coder. For an index $0 \leqq idx_1 \leqq 7$, $\sigma_{noise}$ is given by: $\sigma_{noise}=0.1*(8-idx_1)$. However, it may happen that the index $idx_1$ is not available. This is the case when BFI_TCX=(1) in TCX20, (1 x) in TCX40 and (x 1 x x) in TCX80, with x representing an arbitrary binary value. In this case, $\sigma_{noise}$ is set to its maximal value, i.e. $\sigma_{noise}=0.8$.

Comfort noise is injected in the subvectors $Y_k$ rounded to zero and which correspond to a frequency above 6400/6=1067 Hz (module 15.004). More precisely, Z is initialized as Z=Y and for K/6≦k≦K (only), if $Y_k$=(0, 0, . . . , 0), $Z_k$ is replaced by the 8-dimensional vector:

$$\sigma_{noise}*[\cos(\theta_1)\sin(\theta_1)\cos(\theta_2)\sin(\theta_2)\cos(\theta_3)\sin(\theta_3)\cos(\theta_4)\sin(\theta_4)],$$

where the phases $\theta_1$, $\theta_2$, $\theta_3$ and $\theta_4$ are randomly selected.

Figure 21:
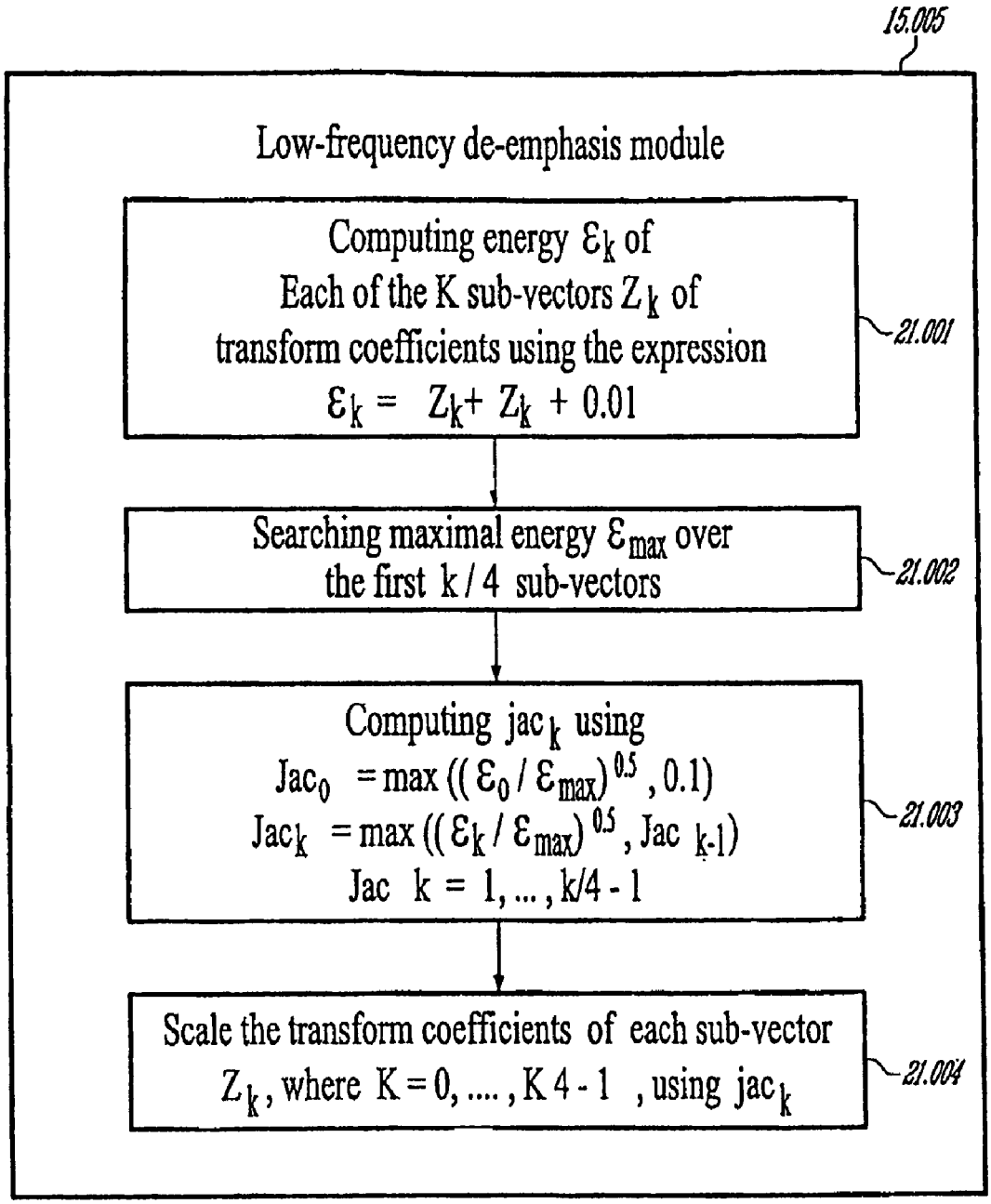
FIG. 21 is a schematic flow chart describing the operation of the adaptive low-frequency de-emphasis module of the decoder of FIG. 15.

The adaptive low-frequency de-emphasis module 15.005 scales the transform coefficients of each sub-vector $Z_k$, for k=0 . . . K/4−1, by a factor $fac_k$ (module 21.004 of FIG. 21) which varies with k:

$$X'_k=fac_k \cdot Z_k, k=0, \ldots, K/4-1.$$

The factor $fac_k$ is actually a piecewise-constant monotone-increasing function of k and saturates at 1 for a given $k=k_{max}<K/4$ (i.e. $fac_k<1$ for $k<k_{max}$ and $fac_k=1$ for $k \geqq k_{max}$). The value of $k_{max}$ depends on Z. To obtain $fac_k$, the energy $\epsilon_k$ of each sub-vector $Z_k$ is computed as follows (module 21.001):

$$\epsilon_k=Z_k^T Z_k+0.01$$

where the term 0.01 is set arbitrarily to avoid a zero energy (the inverse of $\epsilon_k$ is later computed). Then, the maximal energy over the first K/4 subvectors is searched (module 21.002):

$$\epsilon_{max}=\max(\epsilon_0, \ldots, \epsilon_{K/4-1})$$

The actual computation of $fac_k$ is given by the formula below (module 21.003):

$$fac_0=\max((\epsilon_0/\epsilon_{max})^{0.5}, 0.1)$$

$$fac_k=\max((\epsilon_k/\epsilon_{max})^{0.5}, fac_{k-1}) \text{ for } k=1, \ldots, K/4-1$$

The estimation of the dominant pitch is performed by estimator 15.006 so that the next frame to be decoded can be properly extrapolated if it corresponds to TCX20 and if the related packet is lost. This estimation is based on the assumption that the peak of maximal magnitude in spectrum of the TCX target corresponds to the dominant pitch. The search for the maximum M is restricted to a frequency below 400 Hz $$M=\max_{i=1 \ldots N/32}(X'_{2i})^2+(X'_{2i+1})^2$$

and the minimal index $1 \leqq i_{max} \leqq N/32$ such that $(X'_{2i})^2+(X'_{2i+1})^2=M$ is also found. Then the dominant pitch is estimated in number of samples as $T_{est}=N/i_{max}$ (this value may not be an integer). The dominant pitch is calculated for packet-erasure concealment in TCX20. To avoid buffering problems (the excitation buffer 15.013 being limited to 20 ms), if $T_{est}>256$ samples (20 ms), pitch_tcx is set to 256; otherwise, if $T_{est} \leqq 256$, multiple pitch period in 20 ms are avoided by setting pitch_tcx to $$\text{pitch_tcx}=\max\{\lfloor nT_{est} \rfloor | n \text{ integer}>0 \text{ and } nT_{est} \leqq 256\}$$

where $\lfloor . \rfloor$ denotes the rounding to the nearest integer towards −∞.

The transform used is, in one embodiment, a DFT and is implemented as a FFT. Due to the ordering used at the TCX coder, the transform coefficients $X'=(X'_0, \ldots, X'_{N-1})$ are such that:

- $X'_0$ corresponds to the DC coefficient;
- $X'_1$ corresponds to the Nyquist frequency (i.e. 6400 Hz since the time-domain target signal is sampled at 12.8 kHz); and
- the coefficients $X'_{2k}$ and $X'_{2k+1}$, for k=1 . . . N/2−1, are the real and imaginary parts of the Fourier component of frequency k(/N/2)*6400 Hz.

FFT module 15.007 always forces $X'_1$ to 0. After this zeroing, the time-domain TCX target signal $x'_w$ is found in FFT module 15.007 by inverse FFT.

The (global) TCX gain $g_{TCX}$ is decoded in TCX global gain decoder 15.008 by inverting the 7-bit logarithmic quantization used in the TCX coder. To do so, decoder 17.008 computes the r.m.s. value of the TCX target signal $x'_w$ as:

$$rms=\text{sqrt}(1/N(x'^2_{w0}+x_{w1}^2+\ldots+x'^2_{wL-1}))$$

From an index $0 \leqq idx_2 \leqq 127$, the TCX gain is given by:

$$g_{TCX}=10^{idx_2/28/(4\times rms)}$$

The (logarithmic) quantization step is around 0.71 dB.

This gain is used in multiplier 15.009 to scale $x'_w$ into $x_w$. From the mode extrapolation and the gain repetition strategy as used in this illustrative embodiment, the index $idx_2$ is available to multiplier 15.009. However, in case of partial packet losses (1 loss for TCX40 and up to 2 losses for TCX80) the least significant bit of $idx_2$ may be set by default to 0 in the demultiplexer 15.001.

Since the TCX coder employs windowing with overlap and weighted ZIR removal prior to transform coding of the target signal, the reconstructed TCX target signal $x=(x_0, x_1, \ldots, x_{N-1})$ is actually found by overlap-add in synthesis module 15.010. The overlap-add depends on the type of the previous decoded frame (ACELP or TCX). A first window generator multiply the TCX target signal by an adaptive window $w=[w_0\ w_1 \ldots w_{N-1}]$:

$$x_i:=x_i*w_i, i=0, \ldots, L-1$$

where w is defined by $$w_i=\sin(\pi/\text{ovlp_len}*(i+1)/2), i=0, \ldots, \text{ovlp_len}-1$$

$$w_i=1, i=\text{ovlp_len}, \ldots, L-1$$

$$w_i=\cos(\pi/(L-N)*(i+1-L)/2), i=L, \ldots, N-1$$

If ovlp_len=0, i.e. if the previous decoded frame is an ACELP frame, the left part of this window is skipped by suitable skipping means. Then, the overlap from the past decoded frame (OVLP_TCX) is added through a suitable adder to the windowed signal x:

$$[x_0 \ldots x_{128}]:=[x_0 \ldots x_{128}]+\text{OVLP_TCX}$$

If ovlp_len=0, OVLP_TCX is the 10-ms weighted ZIR of ACELP (128 samples) of x. Otherwise, $$\text{OVLP_TCX}=[\underbrace{x\ x\ \ldots\ x}_{olvp_len\ samples}\ 0\ 0\ \ldots\ 0],$$

where ovlp_len may be equal to 32, 64 or 128 (2.5, 5 or 10 ms) which indicates that the previously decoded frame is TCX20, TCX40 or TCX80, respectively.

The reconstructed TCX target signal is given by $[x_0 \ldots x_L]$ and the last N−L samples are saved in the buffer OVLP_TCX:

$$\text{OVLP_TCX}:=[x_L\ \ldots\ x_{N-1}\ \underbrace{0\ 0\ \ldots\ 0}_{olvp_len\ samples}]$$

The reconstructed TCX target is filtered in filter 15.011 by the inverse perceptual filter $W^{-1}(z)=(1-\alpha z^{-1})/\hat{A}(z/\gamma)$ to find the synthesis. The excitation is also calculated in module 15.012 to update the ACELP adaptive codebook and allow to switch from TCX to ACELP in a subsequent frame. Note that the length of the TCX synthesis is given by the TCX frame length (without the overlap): 20, 40 or 80 ms.

Decoding of the Higher-Frequency (HF) Signal

Figure 16:
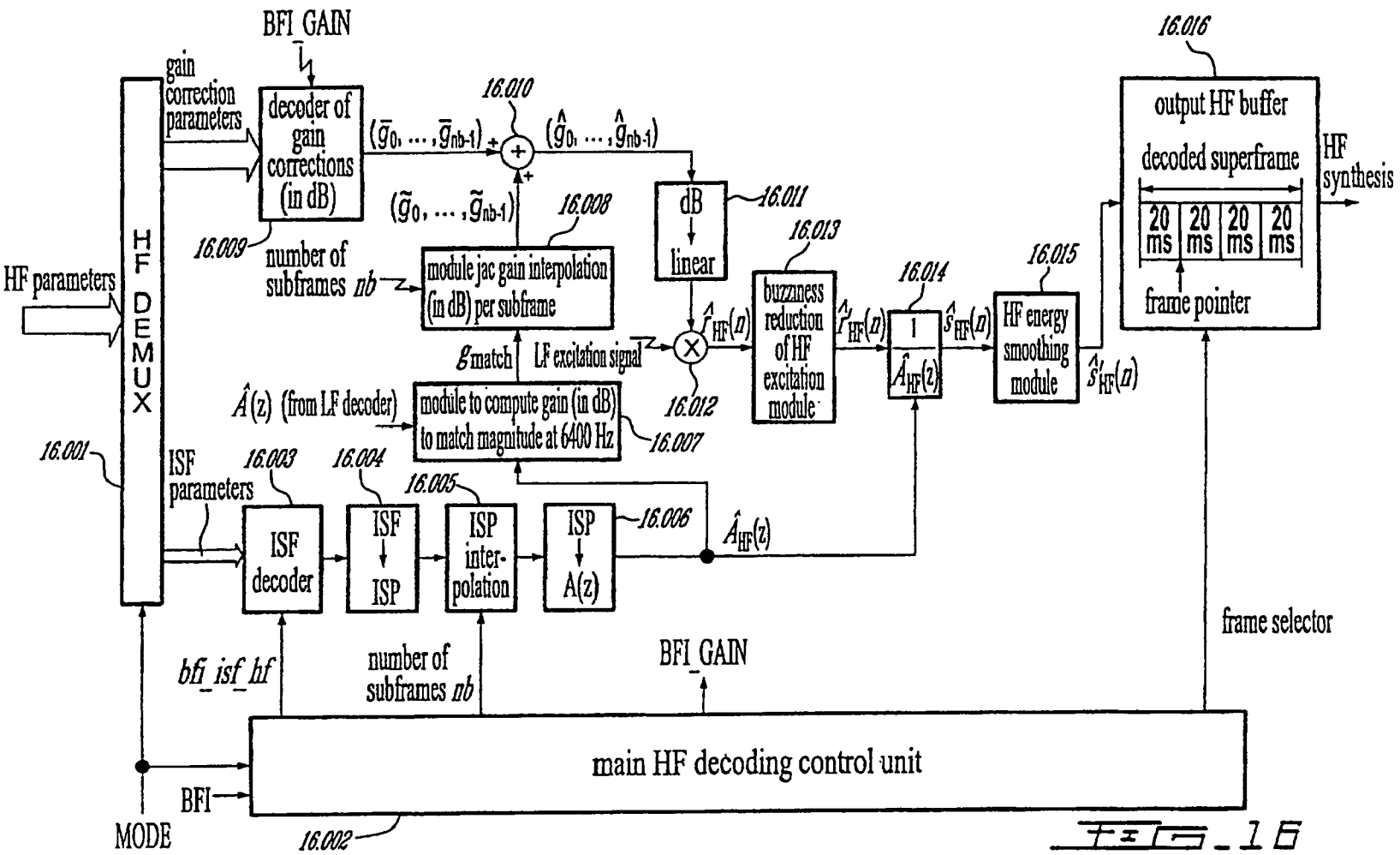
FIG. 16 is a schematic block diagram of a non-limitative example of HF decoder operating on the basis of the bandwidth extension method.

The decoding of the HF signal implements a kind of bandwidth extension (BWE) mechanism and uses some data from the LF decoder. It is an evolution of the BWE mechanism used in the AMR-WB speech decoder. The structure of the HF decoder is illustrated under the form of a block diagram in FIG. 16. The HF synthesis chain consists of modules 16.012 to 16.014. More precisely, the HF signal is synthesized in 2 steps: calculation of the HF excitation signal, and computation of the HF signal from the HF excitation signal. The HF excitation is obtained by shaping in time-domain (multiplier 16.012) the LF excitation signal with scalar factors (or gains) per 5-ms subframes. This HF excitation is post-processed in module 16.013 to reduce the "buzziness" of the output, and then filtered by a HF linear-predictive synthesis filter 06.014 having a transfer function $1/A_{HF}(z)$. As indicated in the foregoing description, the LP order used to encode and then decode the HF signal is 8. The result is also post-processed to smooth energy variations in HF energy smoothing module 16.015.

The HF decoder synthesizes a 80-ms HF super-frame. This super-frame is segmented according to MODE=($m_0$, $m_1$, $m_2$, $m_3$). To be more specific, the decoded frames used in the HF decoder are synchronous with the frames used in the LF decoder. Hence, $m_k \leqq 1$, $m_k=2$ and $m_k=3$ indicate respectively a 20-ms, 40-ms and 80-ms frames. These frames are referred to as HF-20, HF-40 and HF-80, respectively.

From the synthesis chain described above, it appears that the only parameters needed for HF decoding are the ISF and gain parameters. The ISF parameters represent the filter 18.014 ($1/\hat{A}_{HF}(z)$), while the gain parameters are used to shape the LF excitation signal using multiplier 16.012. These parameters are demultiplexed from the bitstream in demultiplexer 16.001 based on MODE and knowing the format of the bitstream.

The decoding of the HF parameters is controlled by a main HF decoding control unit 16.002. More particularly, the main HF decoding control unit 16.002 controls the decoding (ISF decoder 16.003) and interpolation (ISP interpolation module 16.005) of linear-predictive (LP) parameters. The main HF decoding control unit 16.002 sets proper bad frame indicators to the ISF and gain decoders 16.003 and 16.009. It also controls the output buffer 16.016 of the HF signal so that the decoded frames get written in the right time segments of the 80-ms output buffer.

The main HF decoding control unit 16.002 generates control data which are internal to the HF decoder: bfi_isf_hf, BFI_GAIN, the number of subframes for ISF interpolation and a frame selector to set a frame pointer on the output buffer 16.016. Except for the frame selector which is self-explanatory, the nature of these data is defined in more details herein below:

bfi_isf_hf is a binary flag indicating loss of the ISF parameters. Its definition is given below from BFI=($bfi_0$, $bfi_1$, $bfi_2$, $bfi_3$):

For HF-20 in packet k, bfi_isf_hf=$bfi_k$,

For HF-40 in packets k and k+1, bfi_isf_hf=$bfi_k$,

For HF-80 (in packets k=0 to 3), bfi_isf_hf=$bfi_0$

This definition can be readily understood from the bitstream format. As indicated in the foregoing description, the ISF parameters for the HF signal are always in the first packet describing HF-20, HF-40 or HF-80 frames.

BFI_GAIN is a binary vector used to signal packet losses to the HF gain decoder: BFI_GAIN=($bfi_k$) for HF-20 in packet k, ($bfi_k$ $bfi_{k+1}$) for HF-40 in packets k and k+1, BFI_GAIN=BFI for HF-80.

The number of subframes for ISF interpolation refers to the number of 5-ms subframe in the decoded frame. This number if 4 for HF-20, 8 for HF-40 and 16 for HF-80.

The ISF vector isf_hf_q is decoded using AR(1) predictive VQ in ISF decoder 16.003. If bfi_isf_hf=0. the 2-bit index $i_1$ of the $1^{st}$ stage and the 7-bit index $i_2$ of the $2^{nd}$ stage are available and isf_hf_q is given by $$\text{isf_hf_q}=cb1(i_1)+cb2(i_2)+\text{mean_isf_hf}+\mu_{isf_hf}*\text{mem_isf_hf}$$

where $cb1(i_1)$ is the $i_1$-th codevector of the $1^{st}$ stage, $cb2(i_2)$ is the $i_2$-th codevector of the $2^{st}$ stage, mean_isf_hf is the mean ISF vector, $\mu_{isf_hf}=0.5$ is the AR(1) prediction coefficient and mem_isf_hf is the memory of the ISF predictive decoder. If bfi_isf_hf=1, the decoded ISF vector corresponds to the previous ISF vector shifted towards the mean ISF vector:

$$\text{isf_hf_q}=\alpha_{isf_hf}*\text{mem_isf_hf}+\text{mean_isf_hf}$$

with a $\alpha_{isf_hf}=0.9$. After calculating isf_hf_q, the ISF reordering defined in AMR-WB speech coding is applied to isf_hf_q with an ISF gap of 180 Hz. Finally the memory mem_isf_hf is updated for the next HF frame as:

$$\text{mem_isf_hf}=\text{isf_hf_q}-\text{mean_isf_hf}$$

The initial value of mem_isf_hf (at the reset of the decoder) is zero. Converter 16.004 converts the ISF parameters (in frequency domain) into ISP parameters (in cosine domain).

ISP interpolation module 16.005 realizes a simple linear interpolation between the ISP parameters of the previous decoded HF frame (HF-20, HF-40 or HF-80) and the new decoded ISP parameters. The interpolation is conducted in the ISF domain and results in ISF parameters for each 5-ms subframe, according to the formula:

$$\text{isp}_{subframe\text{-}i}=i/nb*\text{isp}_{new}+(1-i/nb)*\text{isp}_{old},$$

where nb is the number of subframes in the current decoded frame (nb=4 for HF-20, 8 for HF-40, 16 for HF-80), i=0, . . . , nb−1 is the subframe index, $\text{isp}_{old}$ is the set of ISP parameters obtained from the ISF parameters of the previously decoded HF frame and $\text{isp}_{new}$ is the set of ISP parameters obtained from the ISF parameters decoded in Processors 18.003. The converter 10.006 then converts the interpolated ISP parameters into quantized linear-predictive coefficients $\hat{A}_{FZ}(z)$ for each subframe.

Computation of the gain $g_{match}$ in dB in module 16.007 is described in the next paragraphs. This gain is interpolated in module 16.008 for each 5-ms subframe based on its previous value old_$g_{match}$ as:

$$\tilde{g}_i=i/nb*g_{match}+(1-i/nb)*\text{old_}g_{match},$$

where nb is the number of subframes in the current decoded frame (nb=4 for HF-20, 8 for HF-40, 16 for HF-80), i=0, . . . , nb−1 is the subframe index. This results in a vector ($\tilde{g}_0$, . . . $\tilde{g}_{nb-1}$).

Gain Estimation Computation to Match Magnitude at 6400 Hz (Module 16.007)

Processor 16.007 is described in FIG. 10*b*. Since this process uses only the quantized version of the LPC filters, it is identical to what the coder has computed at the equivalent stage. A damped sinusoid of frequency 6400 Hz is generated by computing the first 64 samples [h(0) h(1) . . . h(63)] of the impulse response h(n) of the $1^{st}$-order autoregressive filter $1/(1+0.9\,z^{-1})$ having a pole z=−0.9 (filter 10.017). This 5-ms signal h(n) is processed through the (zero-state) predictor $\hat{A}(z)$ of order 16 whose coefficients are taken from the LF decoder (filter 10.018), and then the result is processed through the (zero-state) synthesis filter $1/\hat{A}_{HF}(z)$ of order 8 whose coefficients are taken from the HF decoder (filter 10.018) to obtain the signal x(n). The 2 sets of LP coefficients correspond to the last subframe of the current decoded HF-20, HF-40 or HF-80 frame. A correction gain is then computed in dB as $g_{match}=10\log_{10}[1/(x(0)^2+x(1)^2+\ldots+x(63)^2)]$ as illustrated in module 10.028.

Recall that the sampling frequency of both the LF and HF signals is 12800 Hz. Furthermore, the LF signal corresponds to the low-passed audio signal, while the HF signal is spectrally a folded version of the high-passed audio signal. If the HF signal is a sinusoid at 6400 Hz, it becomes after the synthesis filterbank a sinusoid at 6400 Hz and not 12800 Hz. As a consequence it appears that $g_{match}$ is designed so that the magnitude of the folded frequency response of $10\hat{}(g_{match}/20)/A_{HF}(z)$ matches the magnitude of the frequency response of 1/A(z) around 6400 Hz.

Decoding of Correction Gains and Gain Computation (Gain Decoder 16.009)

As described in the foregoing description, after gain interpolation, the HF decoder gets from module 16.008 the estimated gains ($g^{est}_0, g^{est}_1, \ldots g^{est}_{nb-1}$) in dB for each of the nb subframes of the current decoded frame. Furthermore, nb=4, 8 and 16 in HF-20, HF-40 and HF-80, respectively. The role of the gain decoder 16.009 is to decode correction gains in dB which will be added, through adder 16.010, to the estimated gains per subframe to form the decode gains $\hat{g}_0, \hat{g}_1, \ldots, \hat{g}_{nb-1}$:

$$(\hat{g}_0\,(\text{dB}), \hat{g}_1\,(\text{dB}), \ldots, \hat{g}_{nb-1}\,(\text{dB}))=(\tilde{g}_0, \tilde{g}_1, \ldots, \tilde{g}_{nb-1})+(\bar{g}_0, \bar{g}_1, \ldots, \bar{g}_{nb-1})$$

where $$(\bar{g}_0, \bar{g}_1, \ldots, \bar{g}_{nb-1})=(g^{c1}_1, g^{c1}_1, \ldots, g^{c1}_{nb-1})+(g^{c2}_0, g^{c2}_1, \ldots, g^{c2}_{nb-1})$$

Therefore, the gain decoding corresponds to the decoding of predictive two-stage VQ-scalar quantization, where the prediction is given by the interpolated 6400 Hz junction matching gain. The quantization dimension is variable and is equal to nb.

Decoding of the $1^{st}$ Stage:

The 7-bit index $0 \leqq idx \leqq 127$ of the $1^{st}$ stage 4-dimensional HF gain codebook is decoded into 4 gains ($G_0, G_1, G_2, G_3$). A bad frame indicator bfi=$BFI_GAIN_0$ in HF-20, HF-40 and HF-80 allows to handle packet losses. If bfi=0, these gains are decoded as $$(G_0, G_1, G_2, G_3)=\text{cb_gain_hf}(idx)+\text{mean_gain_hf}$$

where cb_gain_hf(idx) is the idx-th codevector of the codebook cb_gain_hf. If bfi=1, a memory past_gain_hf_q is shifted towards −20 dB:

$$\text{past_gain_hf}_q:=\alpha_{gain_hf}*(\text{past_gain_hf}_q+20)-20.$$

where $\alpha_{gain_hf}=0.9$ and the 4 gains ($G_0, G_1, G_2, G_3$) are set to the same value:

$$G_k=\text{past_gain_hf_q}+\text{mean_gain_hf}, \text{ for } k=0, 1, 2 \text{ and } 3$$

Then the memory past_gain_hf_q is updated as:

$$\text{past_gain_hf}_q:=(G_0+G_1+G_2+G_3)/4-\text{mean_gain}_hf.$$

The computation of the $1^{st}$ stage reconstruction is then given as:

HF-20: $(g^{c1}_0, g^{c1}_1, g^{c1}_2, g^{c1}_3)=(G_0, G_1, G_2, G_3)$.

HF-40: $(g^{c1}_0, g^{c1}_1, \ldots, g^{c1}_7)=(G_0, G_0, G_1, G_1, G_2, G_2, G_3, G_3)$.

HF-80: $(g^{c1}_0, g^{c1}_1, \ldots, g^{c1}_{15})=(G_0, G_0, G_0, G_0, G_1, G_1, G_1, G_1, G_2, G_2, G_2, G_2, G_3, G_3, G_3, G_3)$ Decoding of $2^{nd}$ Stage:

In TCX-20, ($g^{c2}_0, g^{c2}_1, g^{c2}_2, g^{c2}_3$) is simply set to (0,0,0,0) and there is no real $2^{nd}$ stage decoding. In HF-40, the 2-bit index $0 \leqq idx_i \leqq 3$ of the i-th subframe, where i=0, . . . , 7, is decoded as:

$$\text{If } bfi=0, g^{c2}_i=3*idx_i-4.5 \text{ else } g^{c2}_i=0.$$

In TCX-80, 16 subframes 3-bit index the $0 \leqq idx_i \leqq 7$ of the i-th subframe, where i=0, . . . , 15, is decoded as:

$$\text{If } bfi=0, g^{c2}_i=3*idx-10.5 \text{ else } g^{c2}_i=0.$$

In TCX-40 the magnitude of the second scalar refinement is up to ±4.5 dB and in TCX-80 up to ±10.5 dB. In both cases, the quantization step is 3 dB.

HF Gain Reconstruction:

The gain for each subframe is then computed in module 16.011 as: $10^{\hat{g}_i/20}$ Buzziness Reduction Module 16.013 and HF Energy Smoothing Module 16.015)

The role of buzziness reduction module 16.013 is to attenuate pulses in the time-domain HF excitation signal $r_{HF}(n)$, which often cause the audio output to sound "buzzy". Pulses are detected by checking if the absolute value $|r_{HF}(n)|>2*thres(n)$, where thres(n) is an adaptive threshold corresponding to the time-domain envelope of $r_{HF}(n)$. The samples $r_{HF}(n)$ which are detected as pulses are limited to ±2*thres(n), where ± is the sign of $r_{HF}(n)$.

Each sample $r_{HF}(n)$ of the HF excitation is filtered by a $1^{st}$ order low-pass filter $0.02/(1-0.98\,z^{-1})$ to update thres(n). The initial value of thres(n) (at the reset of the decoder) is 0. The amplitude of the pulse attenuation is given by:

$$\Delta=\max(|r_{HF}(n)|-2*thres(n), 0.0).$$

Thus, Δ is set to 0 if the current sample is not detected as a pulse, which will let $r_{HF}(n)$ unchanged. Then, the current value thres(n) of the adaptive threshold is changed as:

$$thres(n):=thres(n)+0.5*\Delta.$$

Finally each sample $r_{HF}(n)$ is modified to: $r'_{HF}(n)=r_{HF}(n)-\Delta$ if $r_{HF}(n)\div 0$, and $r'_{HF}(n)=r_{HF}(n)+\Delta$ otherwise.

The short-term energy variations of the HF synthesis $s_{HF}(N)$ are smoothed in module 16.015. The energy is measured by subframe. The energy of each subframe is modified by up to ±1.5 dB based on an adaptive threshold.

For a given subframe [$s_{HF}(0)\ s_{HF}(1)\ \ldots\ s_{HF}(63)$], the subframe energy is calculated as $$\epsilon^2=0.0001+s_{HF}(0)^2+s_{HF}(1)^2+\ldots+s_{HF}(63)2.$$

The value t of the threshold is updated as:

$$t=\min(\epsilon^2*1.414, t), \text{ if } \epsilon^2<t$$

$$\max(\epsilon^2/1.414, t), \text{ otherwise.}$$

The current subframe is then scaled by $\sqrt{(t/\epsilon^2)}$:

$$[s'_{HF}(0)s'_{HF}(1)\ \ldots\ s'_{HF}(63)]=\sqrt{(t/\epsilon^2)}*[s_{HF}(0)s_{HF}(1)\ldots s_{HF}(63)]$$

Post-Processing & Synthesis Filterbank

Figure 17:
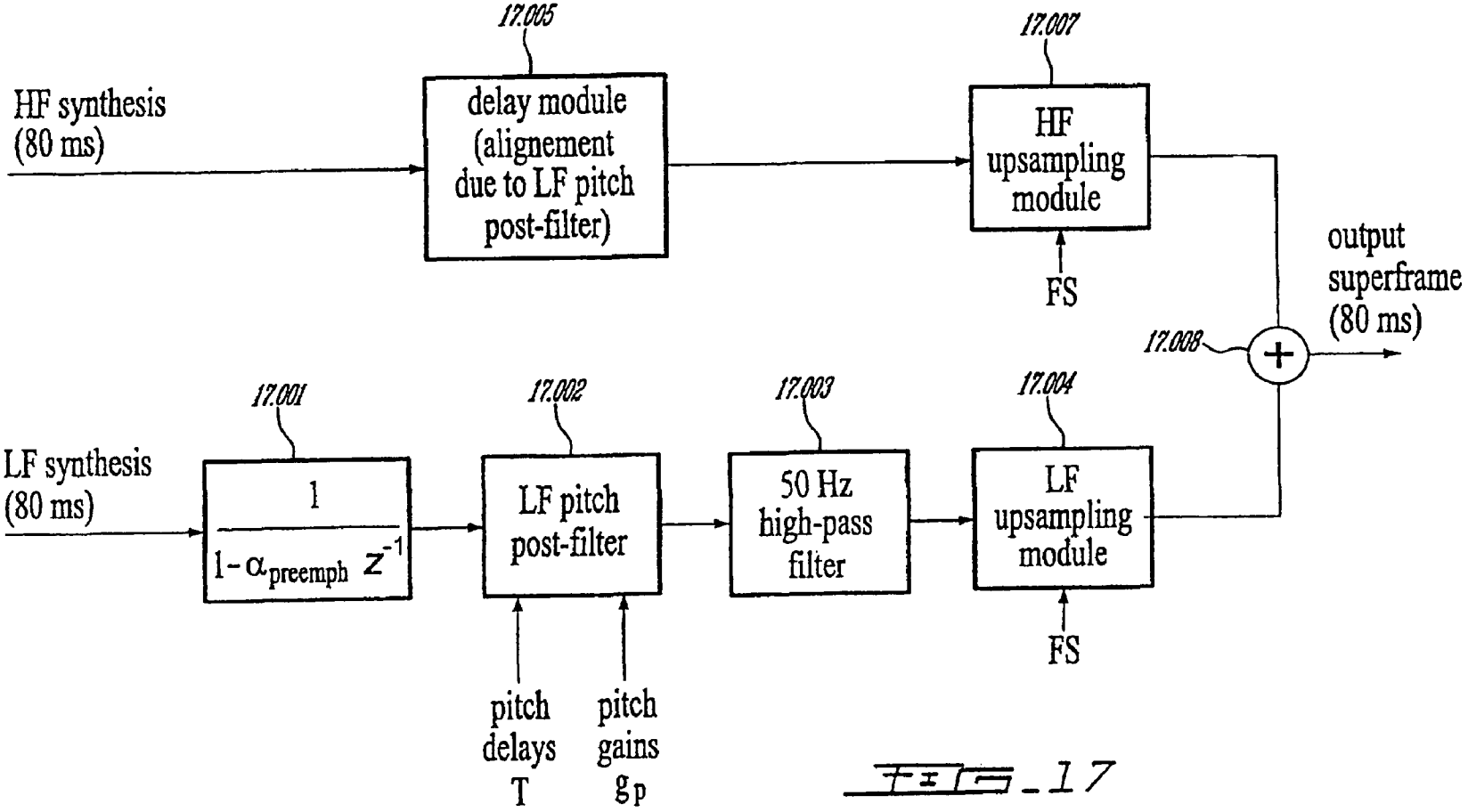
FIG. 17 is a schematic block diagram of a non-limitative example of post-processing and synthesis filterbank at the decoder side.

The post-processing of the LF and HF synthesis and the recombination of the two bands into the original audio bandwidth are illustrated in FIG. 17.

The LF synthesis (which is the output of the ACELP/TCX decoder) is first pre-emphasized by the filter 17.001 of transform function $1/(1-\alpha_{preemph}\,z^{-1})$ where $\alpha_{preemph}=0.75$. The result is passed through a LF pitch post-filter 17.002 to reduce the level of coding noise between pitch harmonics only in ACELP decoded segments. This post-filter takes as parameters the pitch gains $g_p=(g_{p0}, g_{p1}, \ldots, g_{p15})$ and pitch lags $T=(T_0, T_1, \ldots, T_{15})$ for each 5-ms subframe of the 80-ms super-frame. These vectors, $g_p$ and T are taken from the ACELP/TCX decoder. Filter 17.003 is the $2^{nd}$-order 50 Hz high-pass filter used in AMR-WB speech coding.

The post-processing of the HF synthesis is made through a delay module 17.005, which realizes a simple time alignment of the HF synthesis to make it synchronous with the post-processed LF synthesis. The HF synthesis is thus delayed by 76 samples so as to compensate for the delay generated by LF pitch post-filter 17.002.

The synthesis filterbank is realized by LP upsampling module 17.004, HF upsampling module 17.007 and the adder 17.008. The output sampling rate FS=16000 or 24000 Hz is specified as a parameter. The upsampling from 12800 Hz to FS in modules 17.004 and 17.007 is implemented in a similar way as in AMR-WB speech coding. When FS=16000, the LF and HF post-filtered signals are upsampled by 5, processed by a 120-th order FIR filter, then downsampled by 4 and scaled by 5/4. The difference between upsampling modules 17.004 and 17.007 is concerned with the coefficients of the 120-th order FIR filter. Similarly, when FS=24000, the LF and HF post-filtered signals are upsampled by 15, processed by a 368-th order FIR filter, then downsampled by 8 and scaled by 15/8. Adder 17.008 finally combines the two upsampled LF and HF signals to form the 80-ms super-frame of the output audio signal.

Although the present invention has been described hereinabove by way of non-restrictive illustrative embodiment, it should be kept in mind that these embodiments can be modified at will, within the scope of the appended claims without departing from the scope, nature and spirit of the present invention.

TABLE A-1

List of the key symbols in accordance with the illustrative embodiment of the invention

| Symbol | Meaning | Note |
|---|---|---|
| | (a) self-scalable multirate $RE_8$ vector quantization. | |
| N | dimension of vector quantizatlon | |
| Λ | (regular) lattice in dimension N | |
| $RE_8$ | Gosset lattice in dimension 8. | |
| x or X | Source vector in dimension 8. | |
| y or Y | Closest lattice point to $\underline{x}$ in $RE_8$. | |
| n | Codebook number, restricted to the set {0, 2, 3, 4, 5, . . . }. | |
| $Q_n$ | Lattice codebook in Λof index n. | In the self-scalable multirate $RE_8$ vector quantizer, $Q_n$ is indexed with 4n bits. |
| i | Index of the lattice pointy in a codebook $Q_n$. | In the self-scalable multirate $RE_8$ vector quantizer, the index |
| | (b) split self-scalable multirate $RE_8$ vector quantization. | |
| $\lceil . \rceil$ | rounding to the nearest integer towards $+\infty$ | sometimes called ceil( ) |
| N | dimension of vector quantization | multiple of 8 |
| K | number of 8-dimensional subvectors | N = 8K |
| $RE_8$ | Gosset lattice in dimension 8. | |
| $RE_8^K$ | cartesian product of $RE_8$ (K times): $RE_8^K = RE_8 \otimes \ldots \otimes RE_8$ | this is a N-dimensional lattice |
| $\underline{z}$ | N-dimensional source vector | |
| $\underline{x}$ | N-dimensional input vector for split $RE_8$ vector quantization | $\underline{x} = 1/g\ \underline{z}$ |
| g | gain parameter of gain-shape vector quantization. | |
| $\underline{e}$ | vector of split energies (K-tuple) | $\underline{e} = (e(0), \ldots, e(K-1))$ $e(k) = z(8k)^2 + \ldots +$ i is represented with 4n bits. |
| $n_E$ | Binary representation of the codebook number n | See Table 2 for an example. |
| R | bit allocation to self-scalable multirate $RE_8$ vector quantization (i.e. available bit budget to quantize x) | $z(8k+7)^2, 0 \leqq k \leqq K-1$ |
| $\underline{R}$ | vector of estimated split bit budget (K-tuple) for g = 1 | $\underline{R} = (R(0), \ldots, R(K-1))$ |
| $\underline{b}$ | vector of estimated split bit allocations (K-tuple) for a given offset | $\underline{b} = (b(0), \ldots, b(K-1))$ for a given offset, $b(k) = R(k) - \text{offset}$, if $b(k) < 0, b(k) := 0$ |
| offset | integer offset in logarithmic domain used in the discrete search for the optimal g | $g = 2^{offset/10}$ $0 \leqq \text{offset} \leqq 255$ |
| fac | noise level estimate | |
| $\underline{y}$ | closest lattice point to $\underline{x}$ in $RE_8^K$ | |

TABLE A-1-continued

| List of the key symbols in accordance with the illustrative embodiment of the invention | | |
|---|---|---|
| Symbol | Meaning | Note |
| nq | vector of codebook numbers (K-tuple) | nq = (nq(0), . . . , nq(K − 1)$_1$) each entry nq(k) is restricted to the set {0, 2, 3, 4, 5, . . . }. |
| $Q_n$ | Lattice codebook in $RE_8$ of index n. | $Q_n$ is indexed with 4n bits. |
| iq | vector of indices (K-tuple) | iq = (iq(0), . . . , iq(K − 1)) the index iq(k) is represented with 4nq(k) bits. |
| $nq_E$ | vector of (variable-length) binary representations for the codebook numbers in nq' | See Table 2 for an example. |
| R | bit allocation to split self-scalable multirate $RE_8$ vector quantization (i.e. available bit budget to quantize x) | — |
| nq' | vector of codebook numbers (K-tuple) such that the bit budget necessary to multiplex of $nq_E$ and iq (until subvecotr last) does not exceed R | nq' = (nq'(0), . . . , nq'(K − 1)) each entry nq'(k)$_{(\ )}$ is restricted to the set {0, 2, 3, 4, 5, . . . }. |
| last | Index of the last subvector to be multiplexed in formatting table parm | 0 ≦ last ≦ K − 1 |
| pos | indices of subvectors sorted with respect to their split energies | pos = (ps(0), . . . , pos(K − 1)$_1$) pos is a permutation of (0, 1, . . . , K − 1) e(pos(0)) ≧ e(pos((1)) ≧ . . . ≧ e(pos(K − 1)) |
| parm | integer formatting table for multiplexing | ⌈R/4⌉ integer entries each entry has 4 bits, except for the last one which has (R mod 4) bits if R is not a multiple of 4, otherwise 4 bits. |
| $pos_i$ | pointer to write/read indices in formatting table parm | in the single-packet case: initialized to 0, incremented by integer steps multiple of 4 |
| $pos_n$ | pointer to write/read codebook numbers in formatting table parm | in the single-packet case: initialized to R − 1, decremented by integer steps |
| (c) transform coding based on split self-scalable multirate $RE_8$ vector quantization: | | |
| N | dimension of vector quantization | |
| $RE_8$ | Gosset lattice in dimension 8. | |
| R | bit allocation to self-scalable multirate $RE_8$ vector quantization (i.e. available bit budget to quantize x) | |

| | |
|---|---|
| (Jayant, 1984) | N. S. Jayant and P. Noll, Digital Coding of Waveforms-Principles and Applications to Speech and Video, Prentice-Hall, 1984 |
| (Gersho, 1992) | A. Gersho and R. M. Gray, Vector quantization and signal compression, Kluwer Academic Publishers, 1992 |
| (Kleijn, 1995) | W. B. Kleijn and K. P. Paliwal, Speech coding and synthesis, Elsevier, 1995 |
| (Gibson, 1988) | J. D. Gibson and K. Sayood, "Lattice Quantization," Adv. Electron. Phys., vol. 72, pp. 259-331, 1988 |
| (Lefebvre, 1994) | R. Lefebvre and R. Salami and C. Laflamme and J.-P. Adoul, "High quality coding of wideband audio signals using transform coded excitation (TCX)," Proceedings IEEE International Conference on Acoustics, Speech, and Signal Processing (ICASSP), vol. 1, 19-22 Apr. 1994, pp. I/193-I/196 |
| (Xie, 1996) | M. Xie and J-P. Adoul, "Embedded algebraic vector quantizers (EAVQ) with application to wideband speech coding," Proceedings IEEE International Conference on Acoustics, Speech, and Signal Processing (ICASSP), vol. 1, 7-10 May 1996, pp. 240-243 |

-continued

| | |
|---|---|
| (Ragot, 2002) | S. Ragot, B. Bessette and J.-P. Adoul, A Method and System for Multi-Rate Lattice Vector Quantization of a Signal, PCT application WO03103151A1 |
| (Jbira, 1998) | A. Jbira and N. Moreau and P. Dymarski, "Low delay coding of wideband audio (20 Hz-15 kHz) at 64 kbps," Proceedings IEEE International Conference on Acoustics, Speech, and Signal Processing (ICASSP), vol. 6, 12-15 May 1998, pp. 3645-3648 |
| (Schnitzler, 1999) | J. Schnitzler et al., "Wideband speech coding using forward/backward adaptive prediction with mixed time/frequency domain excitation," Proceedings IEEE Workshop on Speech Coding Proceedings, 20-23 Jun. 1999, pp. 4-6 |
| (Moreau, 1992) | N. Moreau and P. Dymarski, "Successive orthogonalizations in the multistage CELP coder," Proceedings IEEE International Conference on Acoustics, Speech, and Signal Processing (ICASSP), 1992, pp. 61-64 |
| (Bessette, 2002) | B. Bessette et al., "The adaptive multirate wideband speech codec (AMR-WB)," IEEE Transactions on Speech and Audio Processing, vol. 10, no. 8, November 2002, pp. 620-636 |
| (Bessette, 1999) | B. Bessette and R. Salami and C. Laflamme and R. Lefebvre, "A wideband speech and audio codec at 16/24/32 kbit/s using hybrid ACELP/TCX techniques," Proceedings IEEE Workshop on Speech Coding Proceedings, 20-23 Jun. 1999, pp. 7-9 |
| (Chen, 1997) | J.-H. Chen, "A candidate coder for the ITU-T's new wideband speech coding standard," Proceedings IEEE International Conference on Acoustics, Speech, and Signal Processing (ICASSP), vol. 2, 21-24 Apr. 1997, pp. 1359-1362 |
| (Chen, 1996) | J.-H. Chen and D. Wang, "Transform predictive coding of wideband speech signals," Proceedings IEEE International Conference on Acoustics, Speech, and Signal Processing (ICASSP), vol. 1, 7-10 May 1996, pp. 275-278 |
| (Ramprashad, 2001) | S. A. Ramprashad, "The multimode transform predictive coding paradigm," IEEE Transactions on Speech and Audio Processing, vol. 11, no. 2, March 2003, pp. 117-129 |
| (Combescure, 1999) | P. Combescure et al., "A 16, 24, 32 kbit/s wideband speech codec based on ATCELP," Proceedings IEEE International Conference on Acoustics, Speech, and Signal Processing (ICASSP), vol. 1, 15-19 Mar. 1999, pp. 5-8 |
| (3GPP TS 26.190) | 3GPP TS 26.190, "AMR Wideband Speech Codec; Transcoding Functions". |
| (3GPP TS 26.173) | 3GPP TS 26.173, "ANSI-C code for AMR Wideband speech codec". |

TABLE 4

Bit allocation for a 20-ms ACELP frame.

| | Bit Allocation per 20-ms Frame | | | | |
|---|---|---|---|---|---|
| Parameter | 13.6k | 16.8k | 19.2k | 20.8k | 24k |
| ISF Parameters | | | 46 | | |
| Mean Energy | | | 2 | | |
| Pitch Lag | | | 32 | | |
| Pitch Filter | | | 4 × 1 | | |
| ISF Parameters | | | 46 | | |
| Mean Energy | | | 2 | | |
| Pitch Lag | | | 32 | | |
| Pitch Filter | | | 4 × 1 | | |
| Fixed-codebook Indices | 4 × 36 | 4 × 52 | 4 × 64 | 4 × 72 | 4 × 88 |
| Codebook Gains | | | 4 × 7 | | |
| Total in bits | 254 | 318 | 366 | 398 | 462 |

TABLE 5a

Bit allocation for a 20-ms TCX frame.

| | Bit allocation per 20-ms frame | | | | |
|---|---|---|---|---|---|
| Parameter | 13.6k | 16.8k | 19.2k | 20.8k | 24k |
| ISF Parameters | | | 46 | | |
| Noise Factor | | | 3 | | |
| Global Gain | | | 7 | | |

TABLE 5a-continued

Bit allocation for a 20-ms TCX frame.

| | Bit allocation per 20-ms frame | | | | |
|---|---|---|---|---|---|
| Parameter | 13.6k | 16.8k | 19.2k | 20.8k | 24k |
| Algebraic VQ | 198 | 262 | 310 | 342 | 406 |
| Total in bits | 254 | 318 | 366 | 398 | 462 |

TABLE 5b

Bit allocation for a 40-ms TCX frame.

| | Bit allocation per 40-ms frame ($1^{st}$ 20-ms frame $2^{nd}$ 20-ms frame) | | | | |
|---|---|---|---|---|---|
| Parameter | 13.6k | 16.8k | 19.2k | 20.8k | 24k |
| ISF Parameters | | | 46 (16, 30) | | |
| Noise Factor | | | 3 (3, 0) | | |
| Global Gain | | | 13 (7, 6) | | |
| Algebraic VQ | 446 (228, 218) | 574 (292, 282) | 670 (340, 330) | 734 (372, 362) | 862 (436, 426) |
| Total in bits | 508 | 636 | 732 | 796 | 924 |

TABLE 5c

| Bit allocation for a 80-ms TCX frame. | | | | | |
|---|---|---|---|---|---|
| | Bit allocation per 80-ms frame ($1^{st}$, $2^{nd}$, $3^{rd}$, $4^{th}$ 20-ms frame) | | | | |
| Parameter | 13.6k | 16.8k | 19.2k | 20.8k | 24k |
| ISF Parameters | | | 46 (16, 6, 12, 12) | | |
| Noise Factor | | | 3 (0, 3, 0, 0) | | |
| Global Gain | | | 16 (7, 3, 3, 3) | | |
| Algebraic VQ | 960 (231, 242, 239, 239) | 1207 (295, 306, 303, 303) | 1399 (343, 354, 359, 359) | 1536 (375, 386, 383, 383) | 1792 (439, 450, 447, 447) |
| Total in bits | 1016 | 1272 | 1464 | 1592 | 1848 |

TABLE 6

| Bit allocation for bandwidth extension. | |
|---|---|
| Parameter | Bit allocation per 20/40/80-ms frame |
| ISF Parameters | 9 (2 + 7) |
| Gain | 7 |
| Gain Corrections | 0/8 × 2/16 × 3 |
| Total in bits | 16/32/64 |

What is claimed is:

1. A method for low-frequency emphasizing the spectrum of a sound signal transformed in a frequency domain and comprising transform coefficients grouped in a number of blocks, comprising:

calculating a maximum energy for one block having a position index;

calculating a factor for each block having a position index smaller than the position index of the block with maximum energy, the calculation of a factor comprising, for each block:

computing an energy of the block; and computing the factor from the calculated maximum energy and the computed energy of the block; and for each block, determining from the factor a gain applied to the transform coefficients of the block;

wherein the method for low-frequency emphasizing the spectrum of a sound signal further comprises applying an adaptive low-frequency emphasis to the spectrum of the sound signal to minimize a perceived distortion in lower frequencies of the spectrum.

2. A method for low-frequency emphasizing the spectrum of a sound signal as defined in claim 1, wherein the transform coefficients are Fast Fourier Transform coefficients.

3. A method for low-frequency emphasizing the spectrum of a sound signal transformed in a frequency domain and comprising transform coefficients grouped in a number of blocks, comprising:

calculating a maximum energy for one block having a position index;

calculating a factor for each block having a position index smaller than the position index of the block with maximum energy, the calculation of a factor comprising, for each block:

computing an energy of the block; and computing the factor from the calculated maximum energy and the computed energy of the block; and for each block determining from the factor a gain applied to the transform coefficients of the block;

wherein the method for low-frequency emphasizing the spectrum of a sound signal further comprises grouping the transform coefficients in blocks of a predetermined number of consecutive transform coefficients.

4. A method for low-frequency emphasizing the spectrum of a sound signal transformed in a frequency main and comprising transform coefficients grouped in a number of blocks, comprising:

calculating a maximum energy for one block having a position index;

calculating a factor for each block having a position index smaller than the position index of the block with maximum energy, the calculation of a factor comprising, for each block:

computing an energy of the block; and computing the factor from the calculated maximum energy and the computed energy of the block; and for each block determining from the factor a gain applied to the transform coefficients of the block;

wherein:

calculating a maximum energy for one block comprises: computing the energy of each block up to a given position in the spectrum; and storing the energy of the block with maximum energy; and determining a position index comprises: storing the position index of the block with maximum energy.

5. A method for low-frequency emphasizing the spectrum of a sound signal as defined in claim 4, wherein computing the energy of each block up to a given position in the spectrum comprises:

computing the energy of each block up to the first quarter of the spectrum.

6. A method for low-frequency emphasizing the spectrum of a sound signal transformed in a frequency domain and comprising transform coefficients grouped in a number of blocks, comprising:

calculating a maximum energy for one block having a position index;

calculating a factor for each block having a position index smaller than the position index of the block with maximum energy, the calculation of a factor comprising, for each block:

computing an energy of the block; and computing the factor from the calculated maximum energy and the computed energy of the block; and for each block, determining from the factor a gain applied to the transform coefficients of the block;

wherein computing the factor for each block comprises:

computing a ratio $R_m$ for each block with a position index m smaller than the position index of the block with maximum energy, using the relation $R_m=E_{max}/E_m$ where $E_{max}$ is the calculated maximum energy and $E_m$ the computed energy for block corresponding to position index m.

7. A method for low-frequency emphasizing the spectrum of a sound signal as defined in claim 6, comprising setting the ratio $R_m$ to a predetermined value when $R_m$ is larger than said predetermined value.

8. A method for low-frequency emphasizing the spectrum of a sound signal as defined in claim 6, comprising setting the ratio $R_m=R_{(m-1)}$ when $R_m>R_{(m-1)}$.

9. A method for low-frequency emphasizing the spectrum of a sound signal as defined in claim 6, wherein computing the factor further comprises calculating a value $(R_m)^{1/4}$, and applying the value $(R_m)^{1/4}$ as a gain for the transform coefficient of the corresponding block.

10. A method for low-frequency emphasizing the spectrum of a sound signal transformed in a frequency domain and comprising transform coefficients grouped in a number of blocks, comprising:

calculating a maximum energy for one block having a position index;

calculating a factor for each block having a position index smaller than the position index of the block with maximum energy, the calculation of a factor comprising, for each block:

computing an energy of the block; and computing the factor from the calculated maximum energy and the computed energy of the block; and for each block, determining from the factor a gain applied to the transform coefficients of the block;

wherein computing the factor comprises setting the factor to a predetermined value when the factor is larger than said predetermined value.

11. A method for low-frequency emphasizing the spectrum of a sound signal transformed in a frequency domain and comprising transform coefficients grouped in a number of blocks, comprising:

calculating a maximum energy for one block having a position index;

calculating a factor for each block having a position index smaller than the position index of the block with maximum energy, the calculation of a factor comprising, for each block:

computing an energy of the block; and computing the factor from the calculated maximum energy and the computed energy of the block; and for each block, determining from the factor a gain applied to the transform coefficients of the block;

wherein computing the factor comprises setting the factor for one block to the factor of the preceding block when the factor of said one block is larger than the factor of the preceding block.

12. A device for low-frequency emphasizing the spectrum of a sound signal transformed in a frequency domain and comprising transform coefficients grouped in a number of blocks, comprising:

a calculator of a maximum energy for one block having a position index;

a calculator of a factor for each block having a position index smaller than the position index of the block with maximum energy, wherein the factor calculator, for each block:

computes an energy of the block; and computes the factor from the calculated maximum energy and the computed energy of the block; and a calculator of a gain, for each block and in response to the factor, the gain being applied to the transform coefficients of the block;

wherein the transform coefficients are grouped in blocks of a predetermined number of consecutive transform coefficients.

13. A device for low-frequency emphasizing the spectrum of a sound signal as defined in claim 12, wherein the transform coefficients are Fast Fourier Transform coefficients.

14. A device for low-frequency emphasizing the spectrum of a sound signal transformed in a frequency domain and comprising transform coefficients grouped in a number of blocks, comprising:

a calculator of a maximum energy for one block having a position index;

a calculator of a factor for each block having a position index smaller than the position index of the block with maximum energy, wherein the factor calculator, for each block:

computes an energy of the block; and computes the factor from the calculated maximum energy and the computed energy of the block; and a calculator of a gain, for each block and in response to the factor, the gain being applied to the transform coefficients of the block;

wherein the maximum energy calculator:

computes the energy of each block up to a predetermined position in the spectrum; and comprises a store for the maximum energy; and comprises a store for the position index of the block with maximum energy.

15. A device for low-frequency emphasizing the spectrum of a sound signal as defined in claim 14, wherein the maximum energy calculator computes the energy of each block up to the first quarter of the spectrum.

16. A device for low-frequency emphasizing the spectrum of a sound signal transformed in a frequency domain and comprising transform coefficients grouped in a number of blocks, comprising:

a calculator of a maximum energy for one block having a position index;

a calculator of a factor for each block having a position index smaller than the position index of the block with maximum energy, wherein the factor calculator, for each block:

computes an energy of the block; and computes the factor from the calculated maximum energy and the computed energy of the block; and a calculator of a gain, for each block and in response to the factor, the gain being applied to the transform coefficients of the block;

wherein the factor calculator:

computes a ratio $R_m$ for each block with a position index m smaller than the position index of the block with maximum energy, using the relation $R_m=E_{max}/E_m$ where $E_{max}$ is the calculated maximum energy and $E_m$ the computed energy for the block corresponding to the position index m.

17. A device for low-frequency emphasizing the spectrum of a sound signal as defined in claim 16, wherein the factor calculator sets the ratio $R_m$ to a predetermined value when $R_m$ is larger than said predetermined value.

18. A device for low-frequency emphasizing the spectrum of a sound signal as defined in claim 16, wherein the factor calculator sets the ratio $R_m=R_{(m-1)}$ when $R_m>R_{(m-1)}$.

19. A device for low-frequency emphasizing the spectrum of a sound signal as defined in claim 16, wherein:

the factor calculator computes a value $(R_m)^{1/4}$; and the gain calculator applies the value $\{R_m)^{1/4}$ as a gain for the transform coefficient of the corresponding block.

20. A device for low-frequency emphasizing the spectrum of a sound signal transformed in a frequency domain and comprising transform coefficients grouped in a number of blocks, comprising:

a calculator of a maximum energy for one block having a position index;

a calculator of a factor for each block having a position index smaller than the position index of the block with maximum energy, wherein the factor calculator, for each block:

computes an energy of the block; and computes the factor from the calculated maximum energy and the computed energy of the block; and a calculator of a gain, for each block and in response to the factor, the gain being applied to the transform coefficients of the block;

wherein the factor calculator sets the factor to a predetermined value when the factor is larger than said predetermined value.

21. A device for low-frequency emphasizing the spectrum of a sound signal transformed in a frequency domain and comprising transform coefficients grouped in a number of blocks, comprising:

a calculator of a maximum energy for one block having a position index;

a calculator of a factor for each block having a position index smaller than the position index of the block with maximum energy, wherein the factor calculator, for each block:

computes an energy of the block; and computes the factor from the calculated maximum energy and the computed energy of the block; and a calculator of a gain, for each block and in response to the factor, the gain being applied to the transform coefficients of the block;

wherein the factor calculator sets the factor for one block to the factor of the preceding block when the factor of said one block is larger than the factor of the preceding block.

22. A method for processing a received, coded sound signal comprising:

extracting coding parameters from the received, coded sound signal, the extracted coding parameters including transform coefficients of a frequency transform of said sound signal, wherein the transform coefficients are grouped in a number of blocks and are low-frequency emphasized using following steps:

(i) calculating a maximum energy for one block having a position index;

(ii) calculating a factor for each block having a position index smaller than the position index of the block with maximum energy, the calculation of a factor comprising, for each block:

computing an energy of the block; and computing the factor from the calculated maximum energy and the computed energy of the block; and (iii) for each block, determining from the factor a gain applied to the transform coefficients of the block; and processing the extracted coding parameters to synthesize the sound signal; and processing the extracted coding parameters comprising low-frequency de-emphasizing the low-frequency emphasized transform coefficients.

23. A method for processing a received, coded sound signal as defined in claim 22, wherein:

extracting coding parameters comprises dividing the low-frequency emphasized transform coefficients into a number K of blocks of transform coefficients; and low-frequency de-emphasizing the low-frequency emphasized transform coefficients comprises scaling the transform coefficients of at least a portion of the K blocks to cancel the low-frequency emphasis of the transform coefficients.

24. A method for processing a received, coded sound signal as defined in claim 23, wherein:

low-frequency de-emphasizing the low-frequency emphasized transform coefficients comprises scaling the transform coefficients of the first K/s blocks of said K blocks of transform coefficients, s being an integer.

25. A method for processing a received, coded sound signal as defined in claim 24, wherein scaling the transform coefficients comprises:

computing the energy $\epsilon_k$ of each of the K blocks of transform coefficients;

computing the maximum energy $\epsilon_{max}$ of one block amongst the first K/s blocks; and computing for each of the first K/s blocks a factor $fac_k$; and scaling the transform coefficients of each of the first K/s blocks using the factor $fac_k$ of the corresponding block.

26. A method for processing a received, coded sound signal as defined in claim 25, wherein computing for each of the first K/s blocks, up to a position index of the block with maximum energy, a factor $fac_k$ comprises using the following expressions:

$$fac_0=\max((\epsilon_0/\epsilon_{max})^{0.5},0.1)$$

$$fac_k=\max((\epsilon_k/\epsilon_{max})^{0.5},fac_{k-1}) \text{ for } k=1, \ldots, K/s-1,$$

where $\epsilon_k$ is the energy of the block with index k.

27. A decoder for processing a received, coded sound signal comprising:

an input decoder portion supplied with the received, coded sound signal and implementing an extractor of coding parameters from the received, coded sound signal, the extracted coding parameters including transform coefficients of a frequency transform of said sound signal, wherein the transform coefficients are low-frequency emphasized using a device for low-frequency emphasizing the spectrum of the sound signal transformed in a frequency domain and comprising transform coefficients grouped in a number of blocks, the device including (i) a calculator of a maximum energy for one block having a position index;

(ii) a calculator of a factor for each block having a position index smaller than the position index of the block with maximum energy, wherein the factor calculator, for each block:

(a) computes an energy of the block; and (b) computes the factor from the calculated maximum energy and the computed energy of the block; and (iii) a calculator of a gain, for each block and in response to the factor, the gain being applied to the transform coefficients of the block; and a processor of the extracted coding parameters to synthesize the sound signal, said processor comprising a low-frequency de-emphasis module supplied with the low-frequency emphasized transform coefficients.

28. A decoder as defined in claim 27, wherein:

the extractor divides the low-frequency emphasized transform coefficients into a number K of blocks of transform coefficients; and the low-frequency de-emphasis module scales the transform coefficients of at least a portion of the K blocks to cancel the low-frequency emphasis of the transform coefficients.

29. A decoder as defined in claim 28, wherein:

the low-frequency de-emphasis module scales the transform coefficients of the first K/s blocks of said K blocks of transform coefficients, s being an integer.

30. A decoder as defined in claim 29, wherein the low-frequency de-emphasis module:

computes the energy $\epsilon_k$ of each of the K/s blocks of transform coefficients;

computes the maximum energy $\epsilon_{max}$ of one block amongst the first K/s blocks; and computes for each of the first K/s blocks a factor $fac_k$; and scales the transform coefficients of each of the first K/s blocks using the factor $fac_k$ of the corresponding block.

31. A decoder as defined in claim 30, wherein the low-frequency de-emphasis module calculates the factor $fac_k$ using the following expressions:

$$fac_0=\max((\epsilon_0/\epsilon_{max})^{0.5},0.1)$$

$$fac_k=\max((\epsilon_k/\epsilon_{max})^{0.5},fac_{k-1}) \text{ for } k=1, \ldots, K/s-1,$$

where $\epsilon_k$ is the energy of the block with index k.

* * * * *